US009266704B1

(12) United States Patent
Hall

(10) Patent No.: US 9,266,704 B1
(45) Date of Patent: Feb. 23, 2016

(54) MECHANICAL LINKAGE FOR LIFTING

(71) Applicant: Shawn A Hall, Pleasantville, NY (US)

(72) Inventor: Shawn A Hall, Pleasantville, NY (US)

( * ) Notice: Subject to any disclaimer, the term of this patent is extended or adjusted under 35 U.S.C. 154(b) by 596 days.

(21) Appl. No.: 13/668,340

(22) Filed: Nov. 5, 2012

(51) Int. Cl.
*B66F 3/22* (2006.01)
*B66F 3/24* (2006.01)

(52) U.S. Cl.
CPC .. *B66F 3/22* (2013.01); *B66F 3/247* (2013.01)

(58) Field of Classification Search
CPC ..... B66F 3/22; B66F 3/247; B66F 7/065; B66F 7/0666; B66F 7/0675; B66F 7/0683; B66F 7/08; B66F 7/085
See application file for complete search history.

(56) References Cited

U.S. PATENT DOCUMENTS 3,034,765 A * 5/1962 Ludowici ..... B66F 3/22 182/69.5

2009/0200527 A1* 8/2009 Christie ..... B66F 3/12 254/122

* cited by examiner

*Primary Examiner* — Monica Carter
*Assistant Examiner* — Nirvana Deonauth
(74) *Attorney, Agent, or Firm* — Leason Ellis LLP

(57) ABSTRACT

A "hex-plus-X" linkage for lifting applications, comprising a hexagonal assembly, an X assembly, and actuation means. The hexagonal assembly comprises six bars, B1 through B6, pivotally attached end-to-end in a closed hexagonal loop, B1-B2-B3-B4-B5-B6-B1. B1 is a base bar; B4 is a top bar. The X assembly, comprising two bars B7 and B8 pivotally attached to each other, is pivotally and slidably attached to B1 and B4, thereby eliminating two unwanted degrees of freedom from the hexagonal assembly without limiting the size of B1 or B4. The actuation means is pivotally attached at knee joints between B2-B3 and B5-B6. To save space and eliminate tripping hazards, the knee joints are concave, so that B2-B3 and B5-B6 do not protrude. When actuated, the linkage lifts a load by modulating a distance between B1 and B4. Mechanical advantage is high. Slidable joints bear modest loads, minimizing wear. None of B4 is cantilevered.

20 Claims, 29 Drawing Sheets

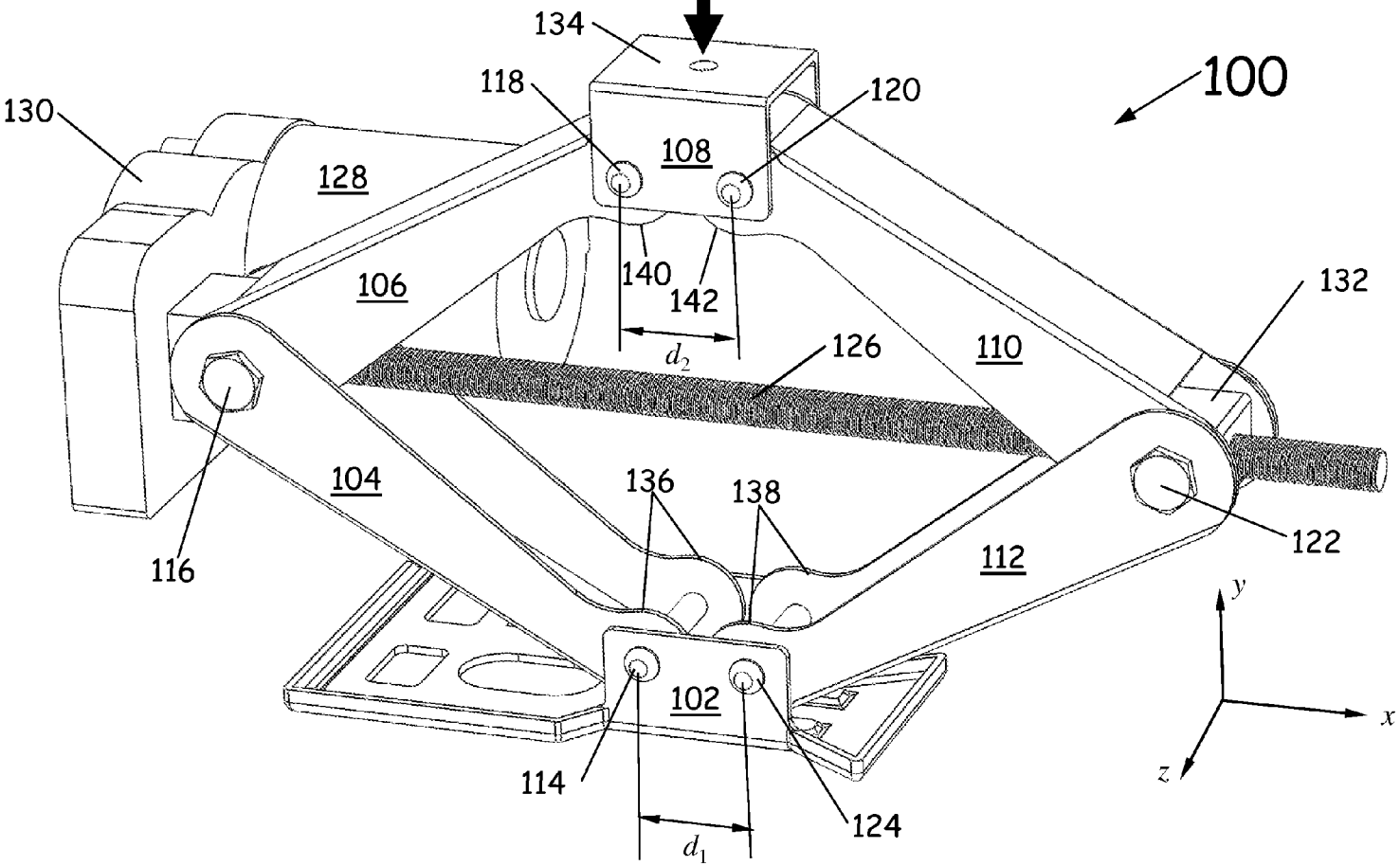
Fig. 1 -- Prior Art

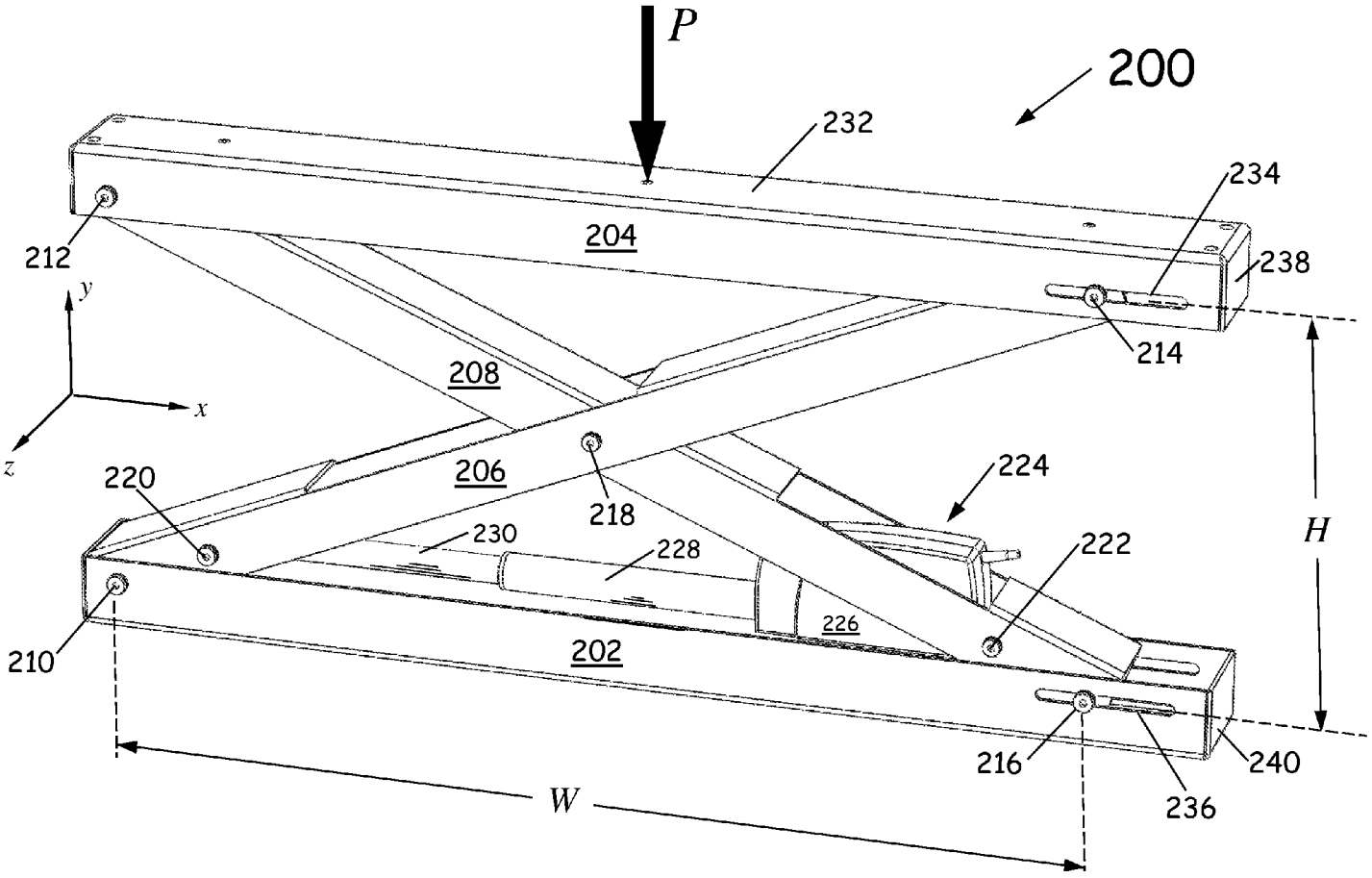
Fig. 2 -- Prior Art

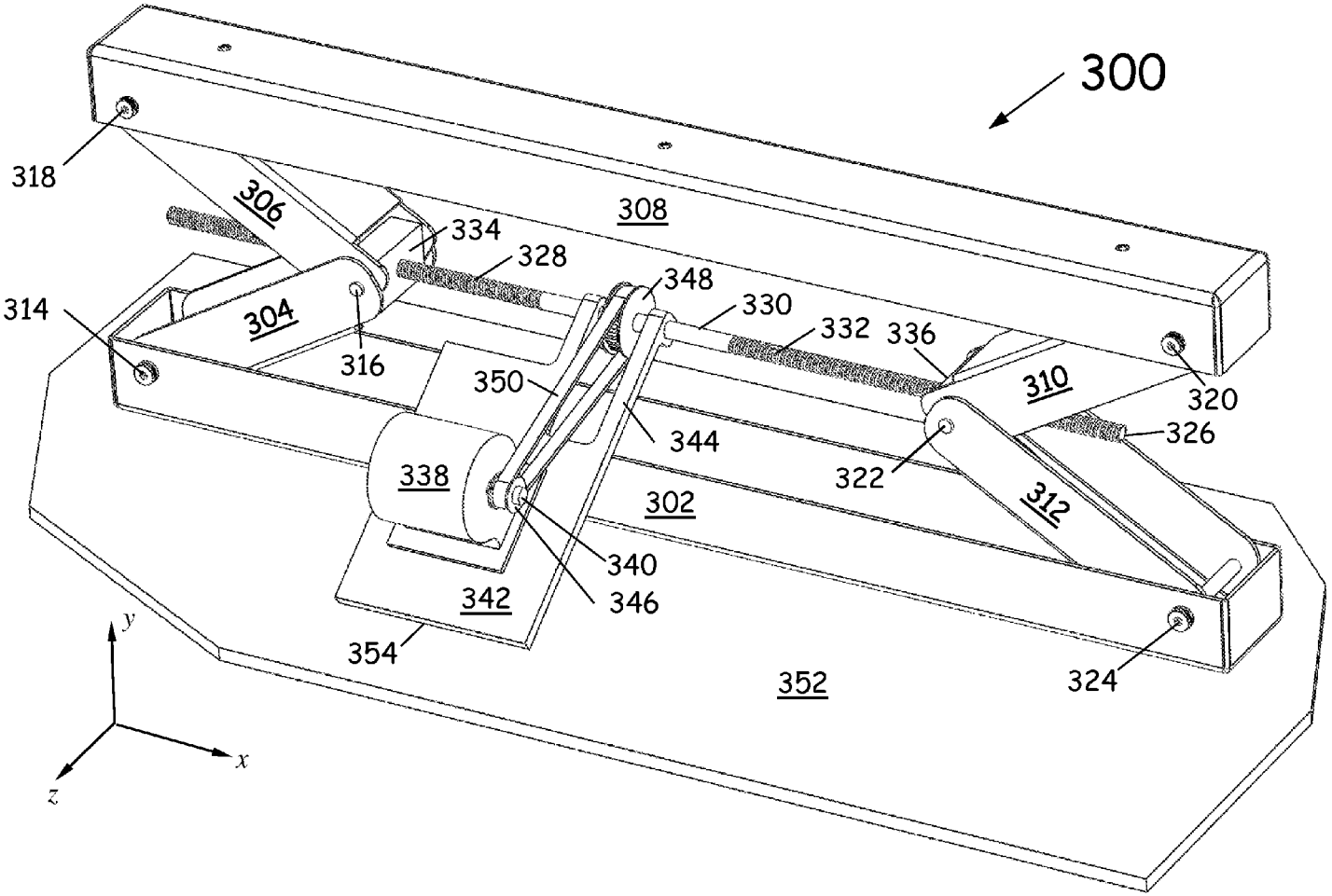
Fig. 3 -- Prior Art (Hulsart)

N* = 4

N* = 2

N = 1

N* = 5

N = 3

$\beta_1 > 0$ $\beta_1 < 0$ $\beta_2 > 0$ $\beta_2 < 0$ $N_A = 3$ $N_B = 6$ $N_C = N_B - 2 = 4$ $N_D = N_A + N_C = 7$ $N_E = N_D - 2 = 5$ $N_F = N_E - 2 = 3$ $N_G = N_F - 1 = 2$ $N_H = N_G - 1 = 1$

2200

J8
B10
J16
B9
1016
J3
B3
B4
J2
B2
J9
B5
J5
J4
1010
y
x
z
J1
J7
B7
B1
B6
J11
B8
1020
J10
J6

2200

2202
2204
J14
B7
J11
B8
J13
B4
1010
J4
B5
J5
B3
J2
J3
y
z
x
B6
B2
B1
J6
2206
J15
2208
B10
J16
B9
J12
J1

MECHANICAL LINKAGE FOR LIFTING

1. BACKGROUND

Prior Art

The following is a tabulation of some prior art that presently appears relevant:

| U.S. patents | | | |
|---|---|---|---|
| U.S. Pat. No. | Kind Code | Issue Date | Patentee |
| 2,661,927 | B1 | 1950 Aug. 14 | Hulsart |
| 3,700,070 | B1 | 1972 Oct. 24 | King |
| 3,806,093 | B1 | 1974 Apr. 23 | Itazu |
| 4,653,727 | B1 | 1987 Mar. 31 | Chang |
| 5,022,105 | B2 | 2006 Nov. 28 | Catoe |
| 7,140,055 | B1 | 2006 Nov. 28 | Bishop |

Mechanical linkages for raising and lowering an upper bar or platform with respect to a lower bar or platform have many applications, including lifting machines, automobiles, people, and materiel.

1.1 Description and Disadvantages of Prior-Art, Six-Bar, Convex Hexagonal Linkages (FIG. 1)

Prior-art mechanical linkages for these purposes include six-bar linkages that have a convex hexagonal shape, as typified by U.S. Pat. No. 3,806,093 to Itazu (1974) and U.S. Pat. No. 4,653,727 to Chang (1987). Such convex hexagonal linkages are often used as automobile jacks. FIG. 1 shows a typical, convex hexagonal linkage 100 and an imaginary, Cartesian coordinate system xyz. The linkage comprises a base bar 102, a top bar 108, and two pairs of articulating bars (104, 106) and (110, 112). Bars 102 and 104 are pivotally connected at joint 114; bars 104 and 106 are pivotally connected at joint 116; bars 106 and 108 are pivotally connected at joint 118; bars 108 and 110 are pivotally connected at joint 120; bars 110 and 112 are pivotally connected at joint 122; and bars 112 and 102 are pivotally connected at joint 124. The six bars thereby form a convex hexagon whose interior angles vary as the joints pivot. Such prior-art, convex hexagonal linkages typically also comprise a lead screw 126, which is connected between joints 116 and 122. The lead screw is disposed parallel to an imaginary x direction of a Cartesian coordinate system xyz. The lead screw is driven by a motor 128 connected to a gearbox 130 whose output shaft is connected to the lead screw 126 near its intersection with joint 116. At its intersection with joint 122, the lead screw passes through a lead nut 132 whose threads engage the threads of the lead screw. Consequently, when the motor turns in one direction, joint 122 moves closer to joint 116, and the distance between bars 102 and 108 is increased. When the motor turns in the opposite direction, joint 122 is moved farther from joint 116, and the distance between bars 102 and 108 is decreased. Thus a load P applied to a load-bearing top surface 134 of bar 108 is raised and lowered.

A shortcoming of the convex hexagonal linkage 100 is that bars 104, 106, 110, and 112, as well as the motor 128 and gearbox 130, protrude well beyond the footprint (i.e., the xz extent) of the load-bearing top surface 134, thereby making such linkages inappropriate for applications in which such protrusions will not fit in available space, or in which the protrusions pose a tripping hazard for people.

A second disadvantage of the convex hexagonal linkage 100 is that the supported top surface 134 of bar 108, between joints 118 and 120, is limited to a small size in the x direction compared to the overall size of the linkage in that direction. The reason for this limitation is discussed in the next paragraph. This limitation restricts the usefulness of linkage 100 to applications where it must lift only one location on a large object, with at least two additional locations on the object supported by other means, thereby creating a three-point support. For example, linkage 100 is suitable for jacking up one small area on an automobile chassis to change a tire, because the two tires on the opposite side of the chassis remain on the ground, supported by the two good tires on that side. Lifting the entire car, or any other sizable object, would require three instances of linkage 100 operating in a coordinated fashion.

In linkage 100, a base length $d_1$ between joints 114 and 124, and likewise a supported length $d_2$ between joints 118 and 120, may not simply be increased to overcome this second disadvantage. Although not shown in FIG. 1, linkage 100 typically includes gear teeth on lobes 136 of bar 104 that mesh with similar gear teeth on lobes 138 of bar 112, as shown by Chang. Linkage 100 also typically includes gear teeth on lobes 140 of bar 106 that mesh with similar gear teeth on lobes 142 of bar 110, as discussed by Itazu. Consequently, the base length $d_1$ is limited to the mean pitch diameter of the meshing gears on lobes 136 and 138, and likewise, the supported length $d_2$ is limited to the mean pitch diameter of the meshing gears on lobes 140 and 142. Inspection of FIG. 1 illustrates that these mean pitch diameters are limited vis-à-vis the overall size of the linkage 100, so the supported length $d_2$ is thereby limited. The reason for the two sets of meshing gears is to stabilize linkage 100; that is, to remove two extraneous degrees of freedom, as discussed further in Section 1.12 following a general discussion of degrees of freedom.

1.2 Description and Disadvantages of Prior-Art, Four-Bar X Linkages (FIG. 2)

Other prior-art mechanical linkages for lifting purposes include four-bar linkages that are X-shaped, as typified by U.S. Pat. No. 5,022,105 to Catoe (1991) and U.S. Pat. No. 7,140,055 to Bishop et. al. (2006). FIG. 2 shows a typical X linkage 200 and an imaginary Cartesian coordinate system xyz. The linkage 200 comprises a base bar 202, a top bar 204, and a pair of X bars (206, 208). Bars 202 and 206 are pivotally connected at joint 210; bars 206 and 204 are pivotally and slidably connected at joint 214; bars 204 and 208 are pivotally connected at joint 212; and bars 208 and 202 are pivotally and slidably connected at joint 216. In addition, bars 206 and 208 are pivotally connected at joint 218. Joint 214 is a sliding joint: as linkage 200 moves to modulate a distance H between bars 202 and 204, joint 214 slides along a slot 234. Likewise, joint 216 is a sliding joint: as linkage 200 moves to modulate the distance H, joint 216 slides along a slot 236.

Additionally, prior-art X linkages typically comprise either a lead screw arrangement such as that previously described, or an alternative actuation mechanism such as a linear actuator 224 comprising an actuator body 226, an actuator column 228, and a actuator piston 230. The actuator body 226 is pivotally attached to a joint 222, and the actuator piston 230 is pivotally attached to a joint 220. Internally, and therefore not visible in FIG. 2, the actuator body 226 contains a motor and typically a gearbox, the actuator column 228 typically encloses a lead screw attached to the shaft of the motor, and the actuator piston 230 is typically attached to a lead nut that engages the lead screw. Consequently, as the motor turns in one direction, actuator piston 230 retracts, thus applying an inwardly directed actuator force F to each of joints 220 and 222. If the actuator force F is large enough to overcome the resistance of an applied load P acting upon a load-bearing top surface 232 of top bar 204, a width W between joints 210 and 216 thereby decreases, and consequently the distance H between bars 202 and 204 increases. As the motor turns in the opposite direction, actuator piston 230 extends, thus applying an outwardly directed actuator force F to each of joints 220 and 222, such that the width W increases and the distance H decreases. The applied load P is thus raised and lowered.

The four-bar X linkage 200 has several shortcomings. First, its mechanical advantage is low, as will be demonstrated mathematically later. In general, mechanical advantage MA of a linkage is defined as the ratio of an applied load P to an actuator load F; that is, $$MA \equiv \frac{P}{F}. \tag{1}$$

Consequently, a maximum applied load P that can be lifted by a linkage, denoted $P_{max}$, is limited to $$P_{max}=(\mathrm{MA})F_{max}, \tag{2}$$

where $F_{max}$ is a maximum force that the actuator is capable of delivering. Because the mechanical advantage MA of the X linkage 200 is low, the X linkage cannot lift the applied load P if the actuator 224 cannot produce the force $$F = \frac{P}{MA}.$$

The actuator 224 may be unable to produce this force F because its size is limited by available space between bars 202, 204, 206, and 208. Even if a more forceful actuator 224 can be found that fits in the available space, it will typically be more expensive and often noisier than a smaller actuator that would be possible if the mechanical advantage MA of the linkage 200 were larger.

A second shortcoming of the four-bar X linkage 200 is that, because the sliding joints 214 and 216 carry considerable load, slots 234 and 236 may undergo considerable wear on their lower surfaces unless a bearing arrangement is provided. Such bearings are expensive; they are typically more expensive the greater the load they must carry.

A third shortcoming of X linkages is that, due to the sliding joints 214 and 216, a portion of the surface 232 to which load P is applied becomes cantilevered beyond joint 214 when the linkage is raised. Such cantilevering, shown clearly in FIG. 2 of Bishop, et. al., may cause dangerous tipping of the linkage if the load P is concentrated near a cantilevered end 238 of bar 204. The likelihood of such tipping is greatest if the cantilevered end 238 extends beyond end 240 of the base bar 202, as is true in FIG. 2 of Bishop et. al. Even if the cantilevered end 238 does not extend beyond end 240, the cantilevered end 238 is nevertheless subject to bending stresses associated with cantilevering, which requires a heavier, more-expensive top bar 204 than could be used if cantilevering of the applied load P beyond the supporting joint 214 were absent.

1.3 Description of Prior-Art, Six-Bar, Concave Hexagonal Linkage per Hulsart (FIG. 3)

U.S. Pat. No. 2,661,927 to Hulsart (1950) shows a mechanical linkage for raising materiel in which an X-shaped linkage is actuated by connection to a concave hexagonal linkage lying in an orthogonal plane. Hulsart's concave hexagonal linkage 300 is illustrated in FIG. 3. It comprises a base bar 302, a top bar 308, and two articulating pairs of V bars (304, 306) and (310, 312). Bars 302 and 304 are pivotally connected at joint 314, bars 304 and 306 are pivotally connected at joint 316, bars 306 and 308 are pivotally connected at joint 318, bars 308 and 310 are pivotally connected at joint 320, bars 310 and 312 are pivotally connected at joint 322, and bars 312 and 302 are pivotally connected at joint 324. The six bars thereby form a hexagon whose interior angles vary as the joints pivot. Hulsart's hexagonal linkage 300 further comprises a lead screw 326 having a right-threaded portion 328, a smooth center portion 330, and a left-threaded portion 332. The right-threaded portion 328 engages a right-threaded lead nut 334 with projecting trunnions that are pivotally connected to pivoting joint 316. Likewise the left-threaded portion 332 engages a left-threaded lead nut 336 with projecting trunnions that are pivotally connected to pivoting joint 322. Hulsart's hexagonal linkage further comprises a motor 338 with a protruding shaft 340, a motor platform 342 having two arms 344 that are pivotally hung on the smooth portion 330 of the lead screw 326, a motor sprocket 346 rigidly connected to the motor shaft 340, a lead-screw sprocket 348 rigidly connected to smooth portion 330 of the lead screw, a belt or chain 350 that is driven by motor sprocket 346 and that drives lead-screw sprocket 348, and a floor surface 352 upon which rests an edge 354 of the motor platform 342. The motor 338 is rigidly mounted upon the motor platform 342, so that the motor and motor platform together may rotate about the lead screw. The weight of the motor and the motor platform act to keep edge 354 of the motor platform in contact with the floor surface 352. As the motor shaft 340 rotates counterclockwise as observed from the view shown in FIG. 3, the lead screw 326 rotates so that its right-threaded portion 328 drives the right-threaded lead nut 334 outward toward the left of FIG. 3, and its left-threaded portion 332 drives the left-threaded lead nut 336 outward toward the right of FIG. 3. Thus the top bar 308 is raised. Similarly, rotating the motor shaft 340 in the opposite direction causes the top bar 308 to be lowered.

1.4 First Disadvantage of Hulsart's Linkage

Hulsart's hexagonal linkage 300 is distinguished from the more common hexagonal linkage 100 by the fact that it's articulating pairs of V bars (304, 306) and (310, 312) point inward like this > < rather than outward like this < >. This appears to overcome an aforementioned shortcoming of linkage 100; namely, that the outwardly pointing V bars (104, 106) and (110, 112) of linkage 100 form an encumbrance parallel to the plane of the linkage, an encumbrance that not only occupies space beyond the supported extent of the top bar 108, but also poses a tripping hazard. By contrast, the inwardly pointing V bars (304, 306) and (310, 312) of Hulsart's linkage 300 do not extend beyond the supported extent of top bar 308, and thus do not form an encumbrance parallel to the plane of the linkage. However, this apparent advantage of linkage 300 is undone by the disadvantage that the motor 338 and motor platform 342 together form an even-more-awkward encumbrance orthogonal to the plane of the linkage, an encumbrance that not only occupies space beyond the supported extent of the top bar 308, but also poses a tripping hazard. This defect renders linkage 300 unsuitable for many lifting applications.

1.5 Second Disadvantage of Hulsart's Linkage (FIGS. 4A and 4B)

A second disadvantage of Hulsart's hexagonal linkage 300 may be understood by referring to FIGS. 4A and 4B. Linkage 300 uses the floor surface 352 to oppose rotation of the motor platform 344 that otherwise would swing freely about the lead screw. Thus, edge 354 of the motor platform slides along the floor surface 352 as top bar 308 is raised and lowered. This is illustrated by contrasting FIGS. 4A and 4B, which show two configurations of the linkage: FIG. 4A shows a configuration where bar 308 is in a low position; FIG. 4B shows a configuration where bar 308 is in a high position. In FIG. 4A, edge 354 is further from bar 302 than it is in FIG. 4B. Moving between these two configurations, edge 354 slides upon the floor surface 352, causing wear. Even if edge 354 is chamfered as shown by Hulsart, wear still occurs: if the floor surface 352 is hard, such as concrete, edge 354 will wear; if the floor surface 352 is soft, such as carpet, the floor surface 352 will wear. Neither of these alternatives is acceptable in many lifting applications.

1.6 Third Disadvantage of Hulsart's Linkage—Extraneous Degrees of Freedom

I have discovered, by the ensuing analysis, a third disadvantage of Hulsart's hexagonal linkage 300; namely, that it is not properly constrained to avoid unwanted motions. These unwanted motions allow the top bar 308 to move laterally and also to tip at an angle with respect to the base bar 302. Hulsart's linkage is therefore unable to perform properly and safely the task of raising and lowering the top bar 308 parallel to the base bar 302. The existence of these unwanted motions is demonstrated analytically in Section 1.10. The unwanted motions are illustrated by figures discussed in connection with Section 1.11.

1.7 the Concept of Degrees of Freedom (FIG. 5)

To understand the third disadvantage of Hulsart's linkage 300, it is useful to understand the concept of "degrees of freedom", which is well known in the engineering art. A mechanical linkage formed of rigid links is said to have N degrees of freedom if N coordinates are required to describe its position. Thus, for example, referring to FIG. 5A, consider a system comprising a rigid bar 502 pivotally attached to a clevis 504, the clevis being mounted upon a fixed base 506. This system has one degree of freedom because a single angle, denoted 9, completely describes its position. As another example, referring to FIG. 5B, consider a robot arm comprising three pivoting bars 508, 510, 512 pivotally connected end-to-end in series, with a first end of bar 508 connected to the clevis 504. This system has three degrees of freedom, namely, angles $\theta_1$, $\theta_2$, and $\theta_3$ of the three bars 508, 510, and 512 with respect to the horizontal base plane 506.

1.8 A Technique for Degrees-of-Freedom Analysis

To discern the number of degrees of freedom N for more complicated linkages, it is often useful to compute first the number of degrees of freedom N* for a modified, imaginary linkage in which one or more connections between bars and joints are missing, and then to subtract from N* the number of degrees of freedom that are removed by reattaching the missing connections. Such a degrees-of-freedom analysis will be applied in Section 1.10 to demonstrate the third disadvantage of Hulsart's linkage; namely, that it has extraneous degrees of freedom that make it unsuitable for typical lifting applications. As a preamble to this demonstration, it is instructive first to apply such a degrees-of-freedom analysis to a prior-art linkage that does not have this disadvantage; that is, a linkage that is properly constrained for lifting applications. Consequently, in Section 1.9, a degrees-of-freedom analysis is performed for the X linkage 200 illustrated in FIG. 2.

1.9 Degrees-of-Freedom Analysis for the X Linkage (FIGS. 6A, 6B, 6C)

Referring first to FIG. 6A, consider an imaginary linkage 602. Linkage 602 is similar to linkage 200 of FIG. 2, except that two joints of linkage 200, namely 216 and 218, are disconnected in linkage 602, and the actuator 224 is also removed. Thus, in the imaginary linkage 602 of FIG. 6A, due to the disconnection of joint 216, a first hole 604 in bar 208 is no longer constrained to align with slot 236 of bar 202. Moreover, in the imaginary linkage 602 of FIG. 6A, due to the disconnection of joint 218, a hole 606 in bar 206 is no longer constrained to align with a second hole 608 in bar 208. Consequently, in the imaginary linkage 602, the number of degrees of freedom is N*=4, according to the following reasoning. Assuming base bar 202 is fixed, bar 206 can pivot independently with respect to base bar 202 at joint 210, providing a first, angular degree of freedom $\theta_1$ that measures the angle between bars 202 and 206. Additionally, bar 204 can independently both pivot and slide with respect to bar 206 at joint 214, providing a second, angular degree of freedom $\theta_2$ that measures the angle between bars 206 and 204, as well as a third, translational degree of freedom s that measures the distance between joints 212 and 214. Moreover, bar 208 can independently pivot with respect to bar 204 at joint 212, providing a fourth, angular degree of freedom $\theta_3$ that measures the angle between bars 204 and 208.

Referring now to FIG. 6B, consider an imaginary linkage 610, which is the same as linkage 602 except that holes 606 and 608 are now forced to coincide, thereby reconnecting joint 218 as in the real X linkage 200. This removes two degrees of freedom, because both the x and the y coordinates of hole 604 in bar 208 are constrained to match those of hole 606 in bar 208. Consequently, the number of degrees of freedom for linkage 610 is two less than for linkage 602. In other words, in FIG. 5B, N*=4−2=2. The effect of eliminating these two degrees of freedom is to impose, for linkage 610, two algebraic relations among the variables $\theta_2$, $\theta_3$, and s, so that, for linkage 610, only one of these three is independent. The algebraic relations imposed depend on the geometry of the linkage. For example, if the distance from joint 218 to either of joints 212 or 214 is the same and equal to $L_1$, then joint 218 imposes the following two algebraic relations: $\theta_3=\theta_2$ and $s=2L_1/\cos\theta_2$. That is, for linkage 610, N*=2 because only two degrees of freedom, $\theta_1$ and $\theta_2$, are independent; once $\theta_2$ is specified, $\theta_3$ and s may be computed by the aforesaid algebraic relations.

Referring now to FIG. 5C, consider linkage 612, which is the same as linkage 610, except that hole 604 is now forced to coincide with slot 236, thereby reconnecting joint 216 as in the real X linkage 200. Both of the imaginary disconnected joints have now been reconnected, so linkage 612 is identical to the real X linkage 200, although the actuator 224 is still removed in linkage 612 of FIG. 6C. The reconnection of joint 216 in linkage 612 removes an additional degree of freedom; that is, in addition to the constraints discussed above for linkage 610, the y coordinate of the end of bar 208 is, for linkage 612, constrained to match that of the slot 236. Consequently, in FIG. 5C, N=2−1=1. The effect of eliminating this additional degree of freedom is to impose an additional algebraic relation between the angles $\theta_1$ and $\theta_2$, a relation that depends on the geometry of the linkage. For example, if the distance between joints 210 and 214 and the distance between joints 212 and 216 are both equal to $L_2$, then joint 216 imposes the relation $\theta_2=\theta_1$. Thus the X linkage 200, with all joints connected as in linkage 612 of FIG. 6C, allows only one degree of freedom $\theta_1$. That is, the linkage is characterized by modulation of the distance $H=L_2 \sin\theta_1$, with bar 204 always remaining parallel to bar 202. A single degree of freedom is desired for typical lifting purposes, because extraneous degrees not only serve no purpose, but can be dangerous because they allow unwanted motions.

Referring again to FIG. 2 that illustrates the X linkage 200, in which the linear actuator is present, consider the role of the linear actuator with regard to degrees of freedom. Recall that the linear actuator 224 comprises body 226, column 228, and piston 230. Exploiting the one degree of freedom provided by the four-bar X linkage 612, the linear actuator modulates height H, as described in Section 1.2, by extension and retraction of the actuator piston 228. When the linear actuator is halted in a given position, as when its power is removed, the entire linkage 200 is locked in a fixed position, because the linear actuator, when locked, subtracts the single degree of freedom provided by linkage 612, leaving zero degrees of freedom, so that the linkage is immobilized.

This is generally desired for a lifting linkage driven by a pivotally connected linear actuator: the linkage apart from the actuator should have one degree of freedom, which is exploited by the actuator when it extends and retracts, but is subtracted by the actuator when it stops moving, thereby immobilizing the linkage.

1.10 Degrees-of-Freedom Analysis for Hulsart's Linkage (FIGS. 7A and 7B)

I have discovered that Hulsart's linkage 300 fails to have the desired, single-degree-of-freedom property just described. In fact, it has two extraneous degrees of freedom, as proven by the following analysis.

Using the analytical technique described in Section 1.8 and illustrated by Section 1.9, consider an imaginary linkage 702, illustrated in FIG. 7A, vis-à-vis Hulsart's linkage 300, which is reproduced for convenience as FIG. 7B. The only difference between linkages 702 and 300 is that, in linkage 702, joint 324 of linkage 300 is broken so that bar 312 is not pivotally attached to bar 302. That is, axis 704, which passes though the center of holes 706 in bar 312, is no longer constrained to align with axis 708, which passes through the center of holes 710 in bar 302. Consequently, in the imaginary linkage 702, assuming the base bar 302 is fixed, the number of degrees of freedom is N*=5, because each of the five bars 304, 306, 308, 310, and 312 can pivot independently. Specifically, bar 304 can pivot independently with respect to the base bar 302 at joint 314, providing a first angular degree of freedom $\theta_1$ that measures the angle between bars 302 and 304; bar 306 can pivot independently with respect to bar 304 at joint 316, providing a second angular degree of freedom $\theta_2$ that measures the angle between bars 304 and 306; bar 308 can pivot independently with respect to bar 306 at joint 318, providing a third angular degree of freedom $\theta_3$ that measures the angle between bars 306 and 308; bar 310 can pivot independently with respect to bar 308 at joint 320, providing a fourth degree of freedom $\theta_4$ that measures the angle between bars 308 and 310; and bar 312 can pivot independently with respect to bar 310 at joint 322, providing a fifth angular degree of freedom $\theta_5$ that measures the angle between bars 310 and 312.

Referring now to FIG. 7B, suppose that joint 324, which was imagined to be broken in linkage 702 of FIG. 7A, is now restored in linkage 300. This removes two degrees of freedom, because both the x and the y coordinates of hole 706 in bar 312 are, in linkage 300, constrained to match those of holes 710 in bar 302. Consequently, the number of degrees of freedom for linkage 300 is two less than for linkage 702. In other words, for linkage 300 in FIG. 6B, the number of degrees of freedom is N=5−2=3. Recall that one degree of freedom (N=1) is desired, as discussed in Section 1.9. Because Hulsart's linkage 300 has three degrees of freedom (N=3), it is thereby proven that Hulsart's linkage 300 has two extraneous degrees of freedom.

1.11 Illustrating the Extraneous Degrees of Freedom in Hulsart's Linkage (FIGS. 8A, 8B, 9A, 9B)

The two extraneous degrees of freedom that I have discovered in Hulsart's linkage 300 will now be illustrated. Referring to FIG. 8A, which includes an imaginary Cartesian coordinate system xyz, let Q be the imaginary point in linkage 300 located midway between joints 318 and 320 on the +z-facing surface of bar 308. Then the three degrees of freedom in Hulsart's linkage may be described by three variables: H, $\beta_1$, and $\beta_2$, defined as follows:

$$H \equiv \text{Distance in } y \text{ direction from floor surface 352 to point } Q \tag{3}$$

$$\beta_1 \equiv \text{Angle between the floor surface 352 and the top bar 308} \tag{4}$$

$$\beta_2 \equiv \text{Angle between the floor surface 352 and the axis of lead screw 326} \tag{5}$$

Motion associated with the first degree of freedom, in which only H varies, is illustrated in FIGS. 4A and 4B. In FIG. 4A, H is relatively small; in FIG. 4B, H is relatively large. This is the only degree of freedom that is desired for typical lifting applications.

Motion associated with the extraneous second degree of freedom, in which angle $\beta_1$ varies, is illustrated in FIGS. 8A and 8B. In FIG. 8A, top bar 308 tilts upward to the right, such that angle $\beta_1$ is positive; in FIG. 8B, top bar 308 tilts downward to the right, such that angle $\beta_1$ is negative. This second degree of freedom in Hulsart's linkage is highly undesirable for typical lifting applications, because the load applied to the top bar 308 can thus become dangerously and uncontrollably tilted. There is nothing in Hulsart's linkage that controls the value of angle $\beta_1$. In particular, there is nothing that enforces $\beta_1=0$, which is the condition typically desired in lifting applications.

Motion associated with the extraneous third degree of freedom, in which angle $\beta_2$ varies, is illustrated in FIGS. 9A and 9B. In FIG. 9A, lead screw 326 tilts upward to the right, such that angle A is positive; in FIG. 9B, lead screw 326 tilts downward to the right, such that angle $\beta_2$ is negative. This third degree of freedom in Hulsart's linkage is also undesirable, because it causes the motor platform 342 to move in an uncontrolled fashion with respect to the floor surface 352, and it does nothing to advance the purpose of lifting the load. There is nothing in Hulsart's linkage that controls the value of angle $\beta_2$. In particular, there is nothing that enforces $\beta_2=0$, which is the condition typically desired in lifting applications.

1.12 Controlling Extraneous Degrees of Freedom in the Convex Hexagonal Linkage 100

In Section 1.1 above, it was asserted that convex hexagonal linkage 100 shown in FIG. 1 has two extraneous degrees of freedom unless means are provided to constrain them. This assertion is based on an analysis of linkage 100 that is analogous to the analysis described in Section 1.10 for Hulsart's convex hexagonal linkage 300. The fact that bars 104, 106, 110, and 112 of linkage 100 are convex (< >), whereas bars 304, 306, 310 and 312 of linkage 300 are concave (> <) make no difference to the analysis. That is, by analogy to FIG. 7A, imagine in FIG. 1 that the end of bar 112 having lobes 138 is not constrained to align with bar 102 at joint 124. Then each of bars 104, 106, 108, 110, and 112 has an angular degree of freedom, resulting in five degrees of freedom. Reconnecting bar 112 to bar 102 at joint 124 subtracts two degrees of freedom, resulting in three degrees of freedom for the linkage as shown in FIG. 1. This is two more degrees of freedom than linkage 100 should properly possess, because the only mode of motion should be to move the load-bearing top surface 134 of bar 108 up and down, in the y direction. Unless the two extraneous degrees of freedom are removed, linkage 100 will execute undesired motions such as the tilting of surface 134 that is analogous to the tilting of bar 308 shown in FIGS. 8A and 8B, and tilting of the lead screw 126 that is analogous to the tilting of lead screw 326 in FIGS. 9A and 9B.

Prior-art convex hexagonal linkages typically remove the extraneous degrees of freedom by supplying gear teeth on lobes 136 that mesh with similar teeth on lobes 138, thus removing a first extraneous degree of freedom by enforcing the condition that the angles of bars 104 and 112 with respect to the xz plane are equal and opposite; and moreover, by supplying gear teeth on lobes 140 that mesh with similar teeth on lobes 142, thus removing a second extraneous degree of freedom by enforcing the condition that the angles of bars 106 and 110 with respect to the load-bearing top surface 134 of bar 108 are equal and opposite. Thus prior art solves the problem of the two extraneous degrees of freedom of linkage 100, reducing the number of degrees of freedom from three to one, as desired. However, as mentioned in Section 1.1, the means used to solve the extraneous-degrees-of-freedom problem, namely the gear teeth, restricts the size of the load-bearing top surface 134 in the x direction, thereby limiting the usefulness of linkage 100.

1.13 Summary of Prior-Art Disadvantages

Consequently, every lifting linkage heretofore known suffers from some subset of the following disadvantages:

(a) It has extraneous degrees of freedom, thereby making the linkage unworkable and unsafe.

(b) It removes extraneous degrees of freedom in a manner that limits the size of the load-bearing top surface, thereby limiting the usefulness of the linkage.

(c) It has a relatively low mechanical advantage, thereby limiting the load that can be lifted with an actuator of a given size, weight, acoustic performance, and cost.

(d) It includes sliding joints that, because they bear large loads, either undergo substantial wear or comprise relatively expensive bearing arrangements to avoid such wear.

(e) It includes sliding joints that cause a portion of the load-bearing top surface to be cantilevered beyond its supports, thereby creating the dangerous possibility of tipping the linkage, and also requiring the load-bearing top surface to be heavier than otherwise necessary to withstand stresses due to cantilevering.

(f) It includes elements that protrude substantially beyond the footprint of the load-bearing top surface, thereby posing a tripping hazard for people. The protrusions also occupy space beyond the footprint of the load-bearing top surface, thereby rendering the linkage useless for applications where such space is not available.

In particular, convex hexagonal linkages such as linkage 100 suffer from disadvantages (b) and (f); X linkages such as linkage 200 suffer from disadvantages (c), (d) and (e); and Hulsart's concave hexagonal linkage 300 suffers from disadvantages (a) and (f).

2. SUMMARY

In accordance with one or more embodiments, a mechanical "hex-plus-X" linkage for performing a motion that occurs parallel to an imaginary xy plane of an imaginary Cartesian xyz coordinate system having an imaginary x axis, an imaginary y axis, and an imaginary z axis that define the xy plane as well as an imaginary xz plane and an imaginary yz plane, the linkage comprising a. a base-bar B1 extending along the x axis, bar B1 having a first end located at a small value of x, a second end located at a larger value of x, and a base surface substantially parallel to the xz plane, b. a first lower V bar B2, c. a first upper V bar B3, d. a top bar B4 whose size projected upon the xz plane defines a top footprint, e. a second upper V bar B5, f. a second lower V bar B6, g. a first X bar B7 h. a second X bar B8, i. a first joint J1 at which the first end of bar B1 is pivotally attached to a first end of bar B2, j. a second joint J2 at which a second end of bar B2 is pivotally attached to a first end of bar B3, k. a third joint J3 at which a second end of bar B3 is pivotally attached to a first end of bar B4, l. a fourth joint J4 at which a second end of bar B4 is pivotally attached to a first end of bar B5, m. a fifth joint J5 at which a second end of bar B5 is pivotally attached to a first end of bar B6, n. a sixth joint J6 at which a second end of bar B6 is pivotally attached to the second end of bar B1, o. a seventh joint J7 at which a first end of bar B7 is pivotally attached near the first end of bar B1, p. an eighth joint J8 at which a first end of bar B8 is pivotally attached near the first end of bar B4, q. a ninth joint J9 at which a second end of bar B7 is pivotally and slidably attached near the second end of bar B4, r. a tenth joint J10 at which a second end of bar B8 is pivotally and slidably attached near the second end of bar B1, and s. an eleventh joint J11 at which bar B7 is pivotally attached to bar B8 t. actuation means having a first end that is pivotally attached at joint J5 and a second end that is pivotally attached at joint J2, the actuation means being capable of increasing and decreasing a knee-to-knee distance between joints J2 and J5 by applying thereto oppositely directed actuation forces of magnitude F, whereby, by varying the knee-to-knee distance using the actuation means, a distance H measured parallel to the y axis between bars B1 and B4 is caused to undergo a modulation in which the distance H is increased or decreased despite externally applied, oppositely directed forces of a magnitude P that act upon bars B1 and B4 to oppose the modulation.

Moreover, let the x coordinates of joints J1 through J6 be denoted $\hat{x}_1$ through $\hat{x}_6$ respectively. In several embodiments, $\hat{x}_3$ is substantially equal to $\hat{x}_1$, and $\hat{x}_4$ is substantially equal to $\hat{x}_6$. Moreover, in these embodiments, $\hat{x}_2$ is greater than $\hat{x}_3$ throughout the motion and $\hat{x}_5$ is less than $\hat{x}_4$ throughout the motion, whereby, throughout the motion, a hexagon formed by bars B1, B2, B3, B4, B5 and B6 is concave, and consequently, throughout the motion, the V bars B2, B3, B5 and B6 remain within the top footprint.

3. ADVANTAGES

Accordingly, several advantages of one or more aspects are as follows:

(a) the hex-plus-X linkage provides safe modulation of the distance H by providing only one degree of freedom, thereby avoiding unwanted, extraneous degrees of freedom;

(b) extraneous degrees of freedom are prevented in a manner that does not limit the size of the top footprint;

(c) the hex-plus-X linkage has a relatively high mechanical advantage, defined as a ratio P/F, thereby allowing modulation of the distance H to occur with a relatively small value of the actuation force F;

(d) the slidable joints J9 and J10 transmit forces in typical operation of the linkage that are relatively small compared to the applied force P, thereby minimizing wear at these joints;

(e) the top bar B4 is substantially fully supported across the top footprint, avoiding substantial cantilevered portions thereof;

(f) no element of the hex-plus-X linkage protrudes substantially beyond the top footprint, thereby avoiding substantial encumbrances outside the top footprint that would occupy valuable space and potentially pose a tripping hazard.

Other advantages of one or more aspects will be apparent from a consideration of the drawings and ensuing description.

4. BRIEF DESCRIPTION OF THE DRAWINGS

In the drawings, closely related figures have the same number but different alphabetic suffixes.

FIG. 1 illustrates a prior-art convex-hexagonal linkage for lifting

FIG. 2 illustrates a prior-art X linkage for lifting

FIG. 3 illustrates a prior-art concave-hexagonal linkage for lifting (Hulsart, U.S. Pat. No. 2,661,927)

Figure 4A:
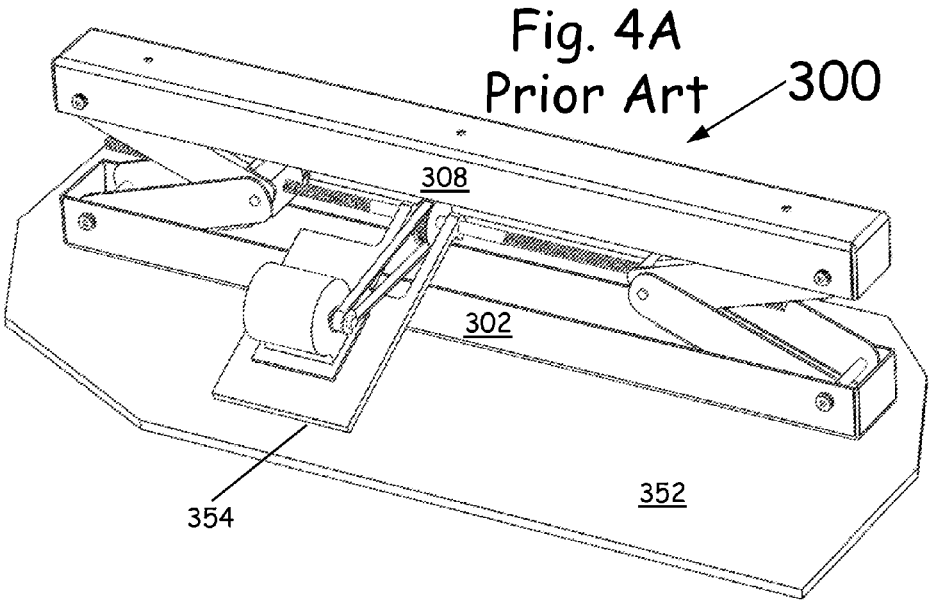
Fig. 4A Prior Art
Figure 4B:
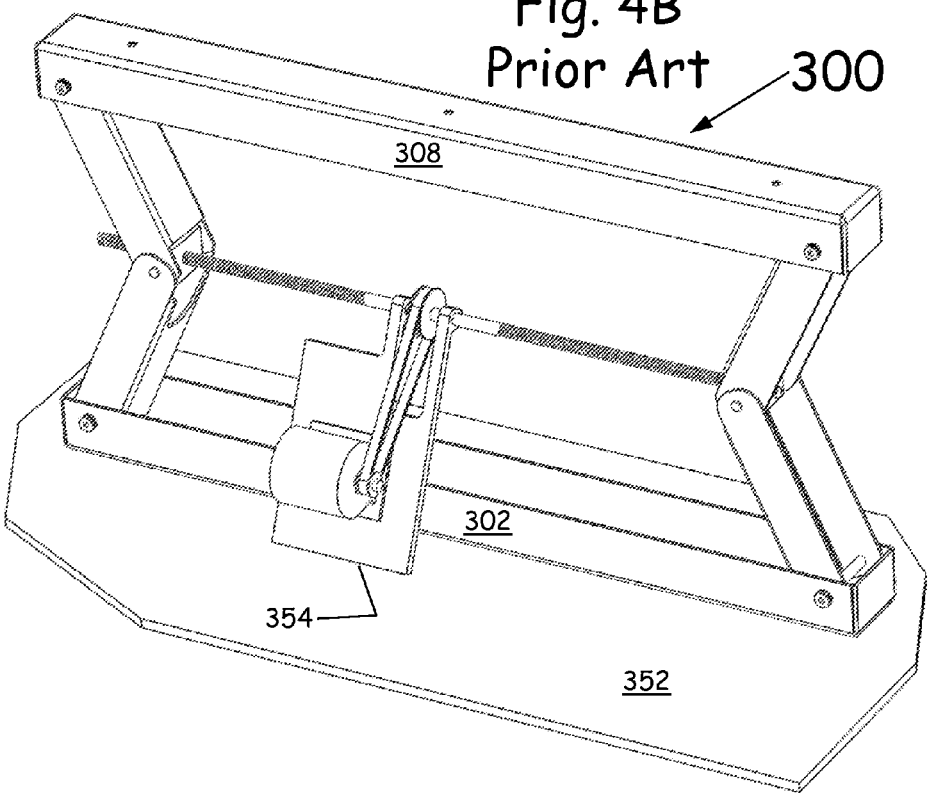
Fig. 4B Prior Art

FIGS. 4A and 4B illustrate a disadvantage of Hulsart's linkage

Figure 5B:
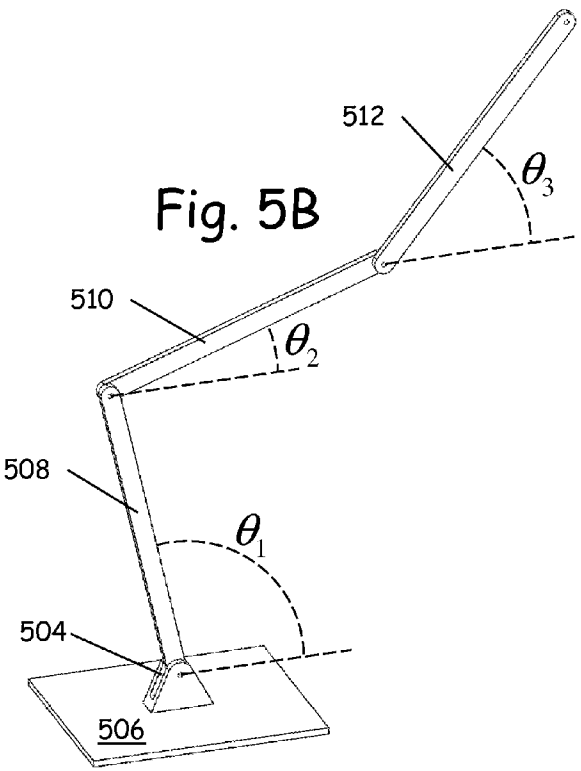
Figure 5A:
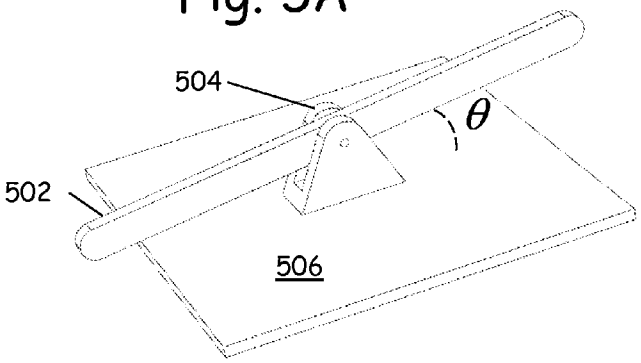
Figure 6A:
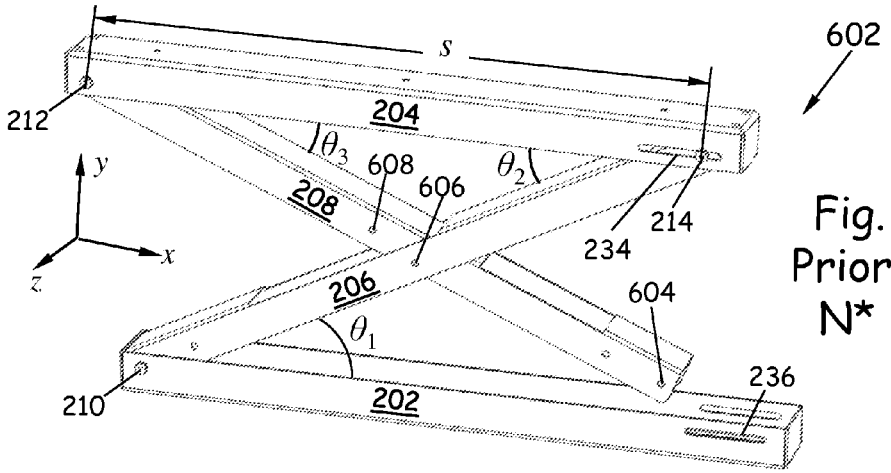
Fig. 6A Prior Art
Figure 6B:
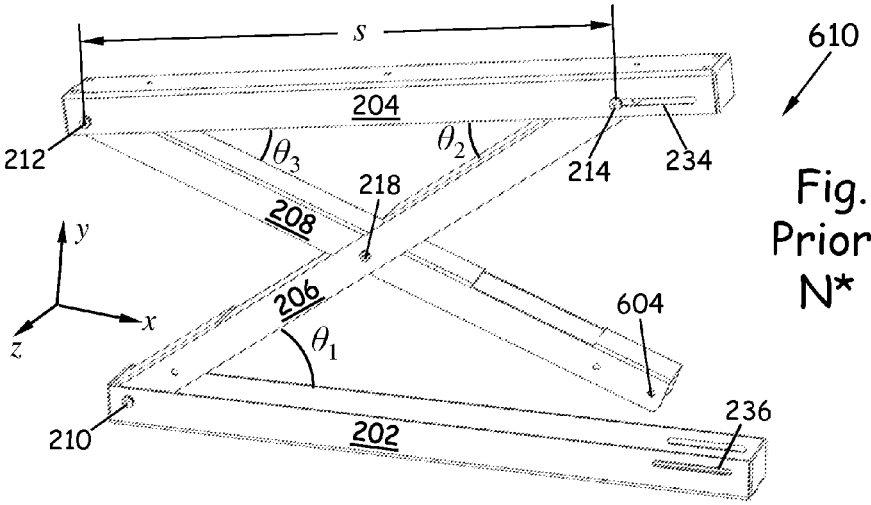
Fig. 6B Prior Art
Figure 6C:
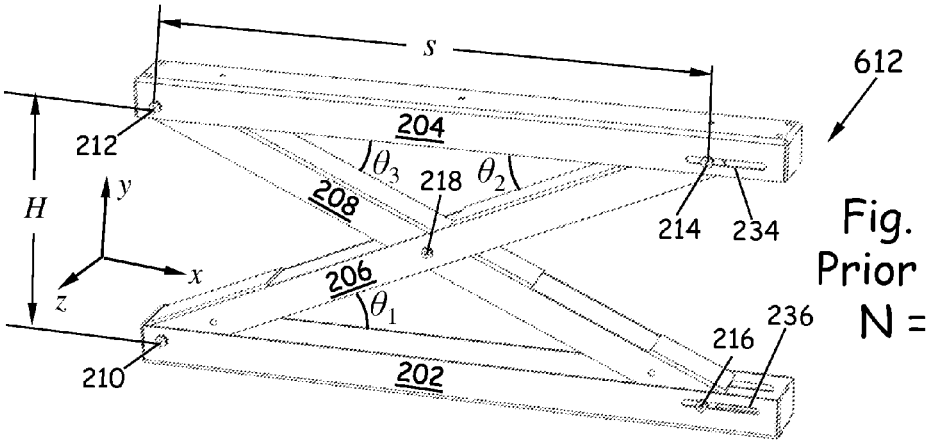
Fig. 6C Prior Art
Figure 7A:
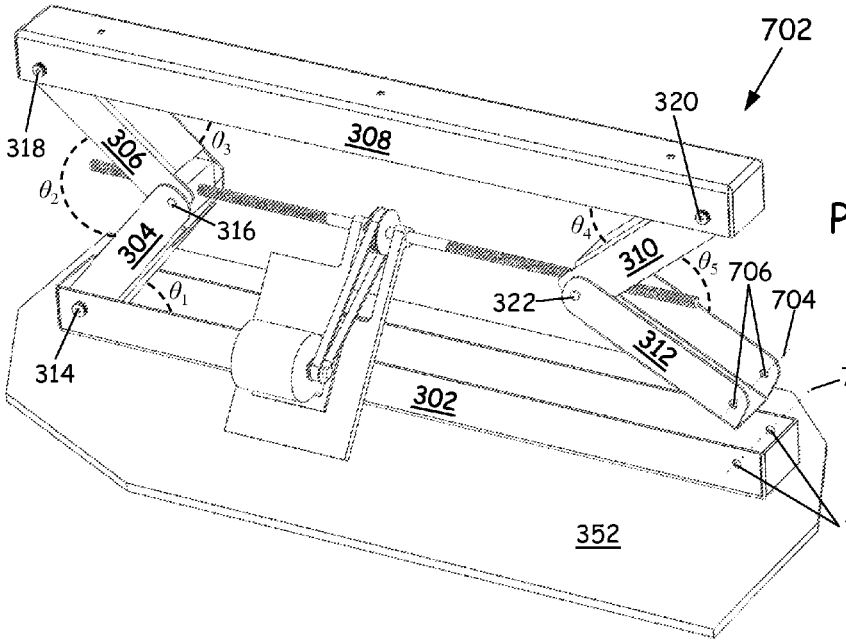
Fig. 7A Prior Art
Figure 7B:
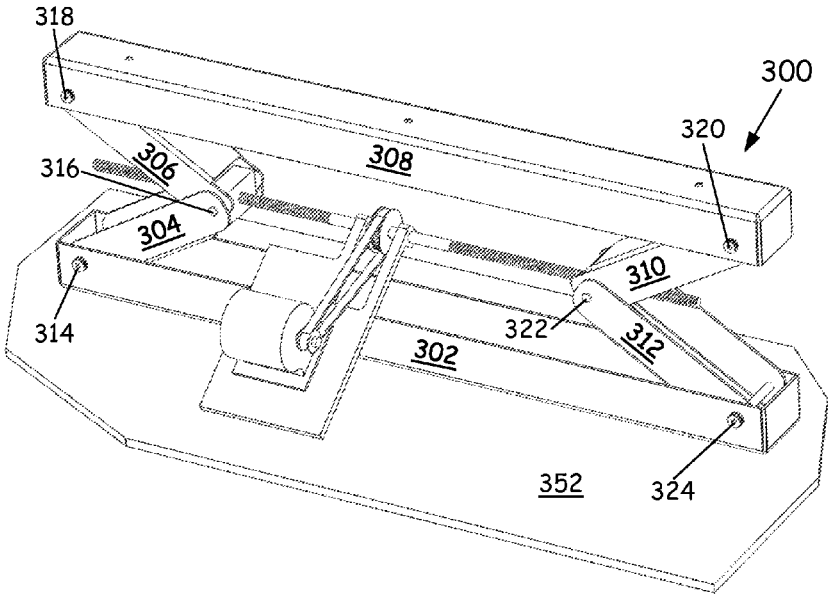
Fig. 7B Prior Art
Figure 8A:
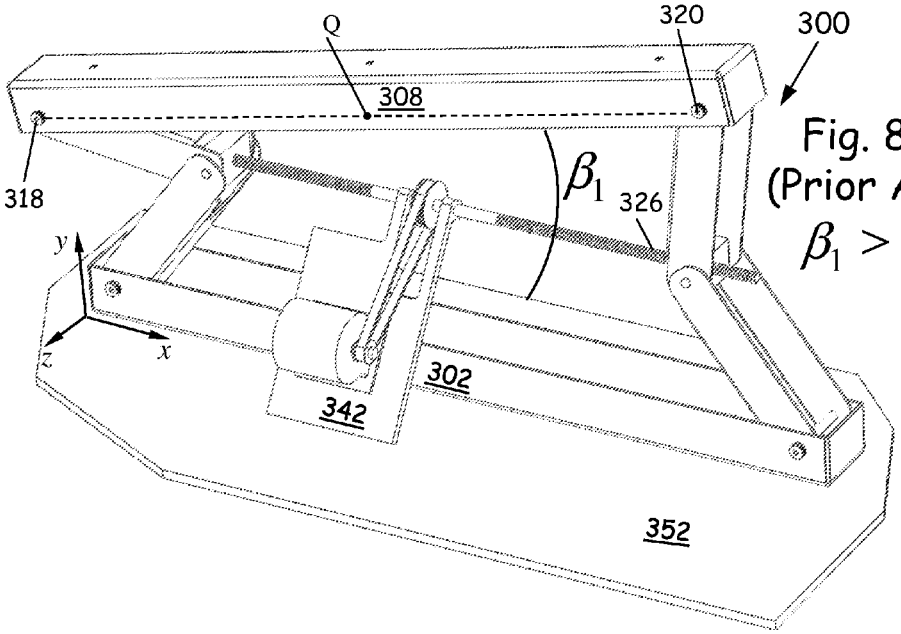
Fig. 8A (Prior Art)
Figure 8B:
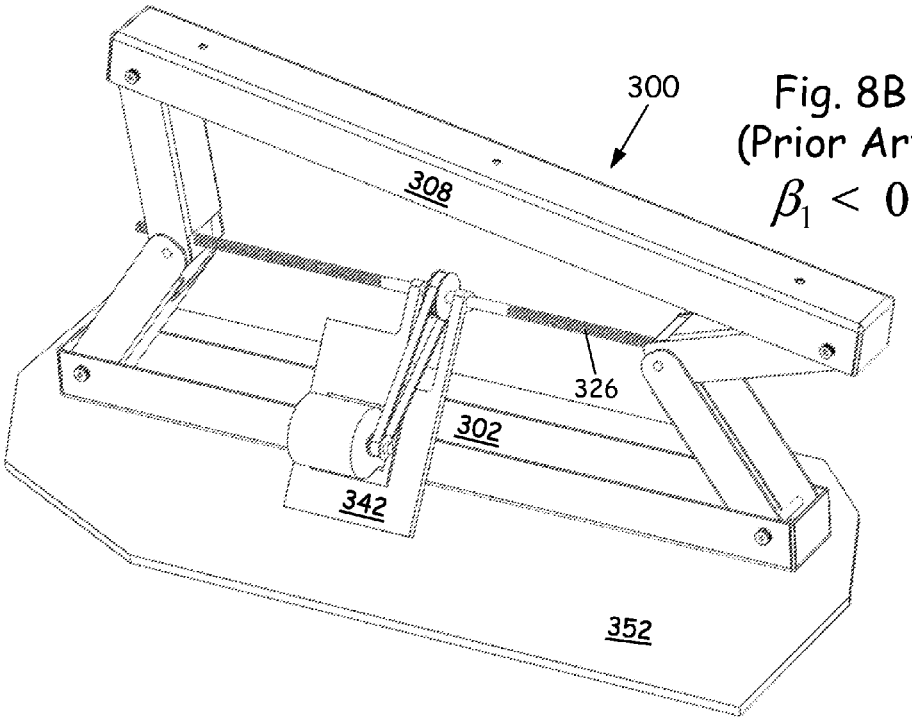
Fig. 8B (Prior Art)
Figure 9A:
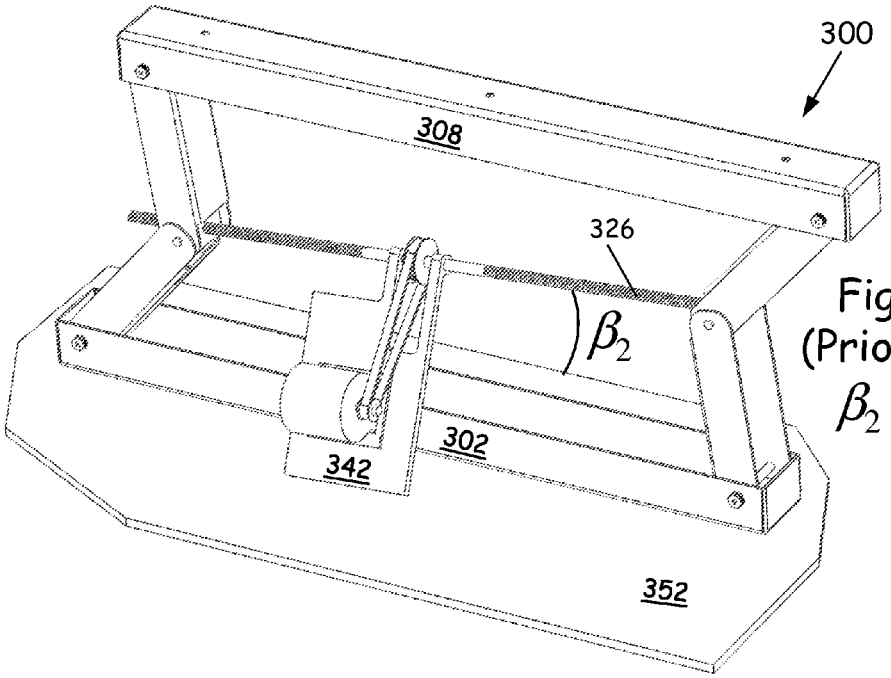
Fig. 9A (Prior Art)
Figure 9B:
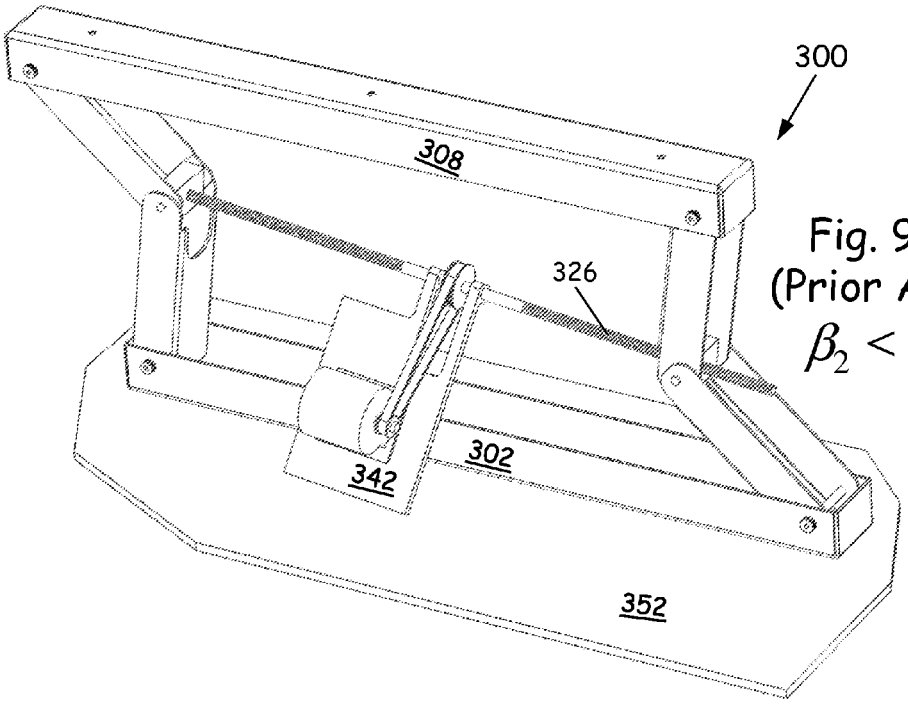
Fig. 9B (Prior Art)
Figure 10:
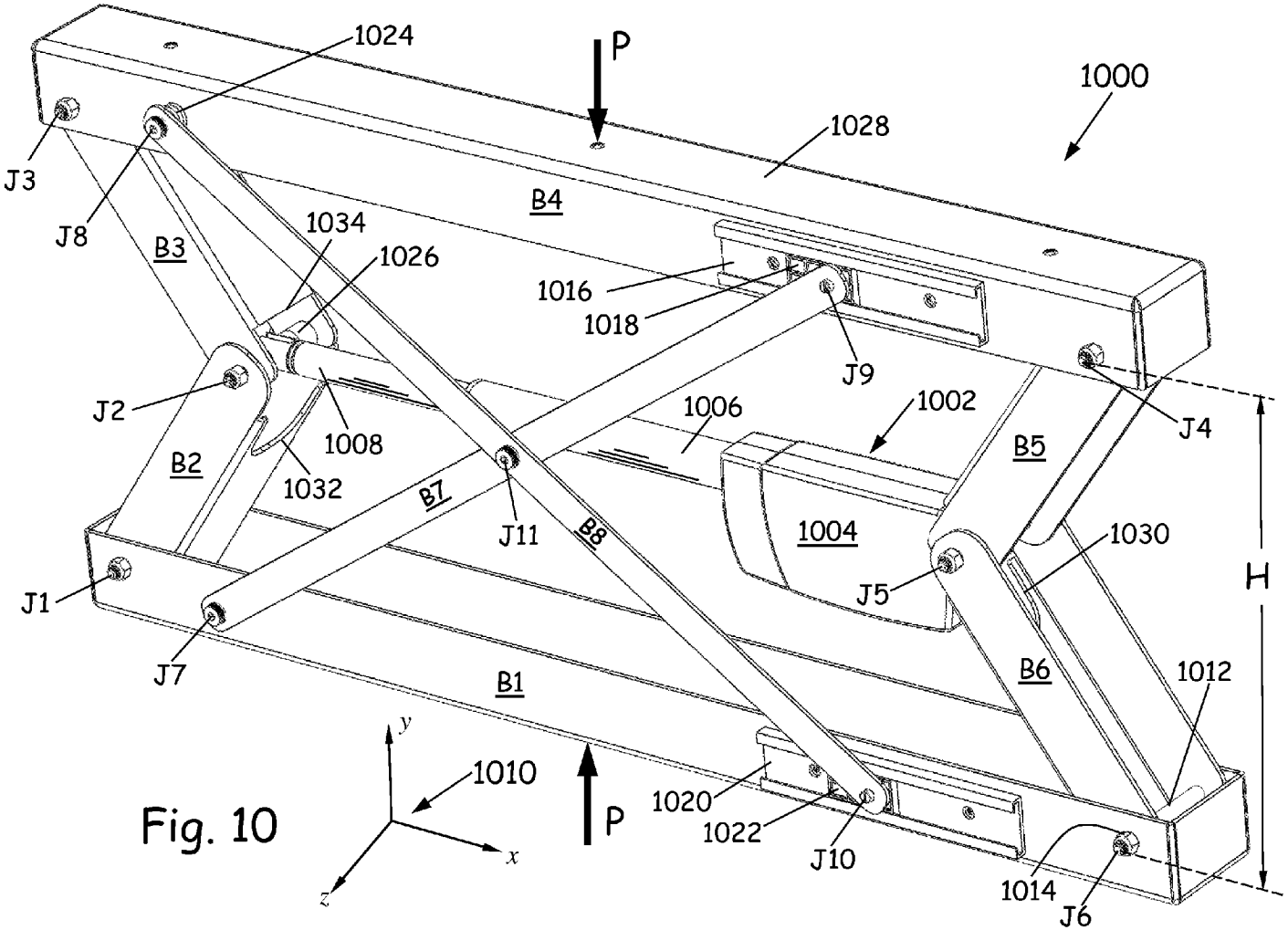
Figure 11:
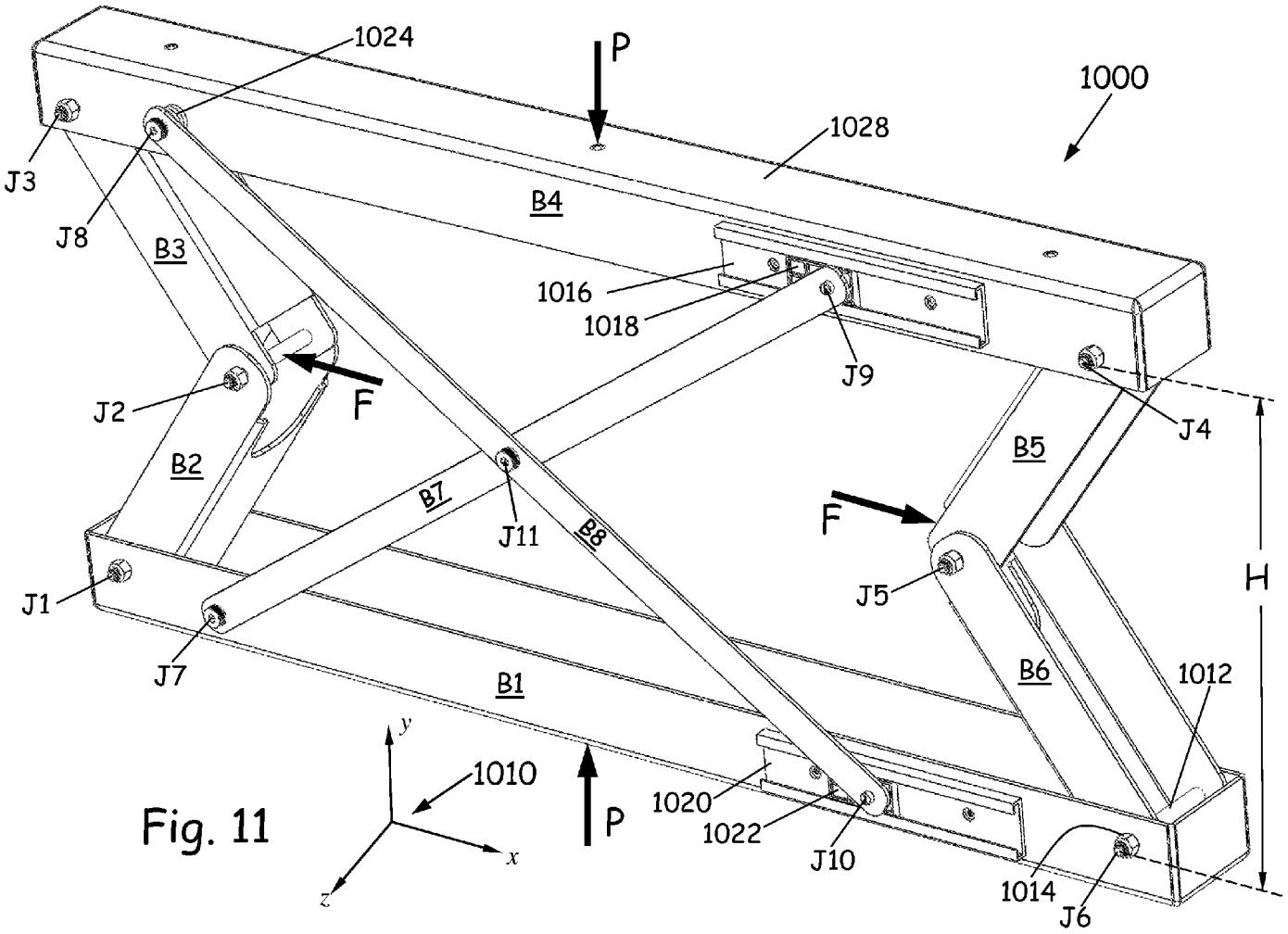
Figure 12:
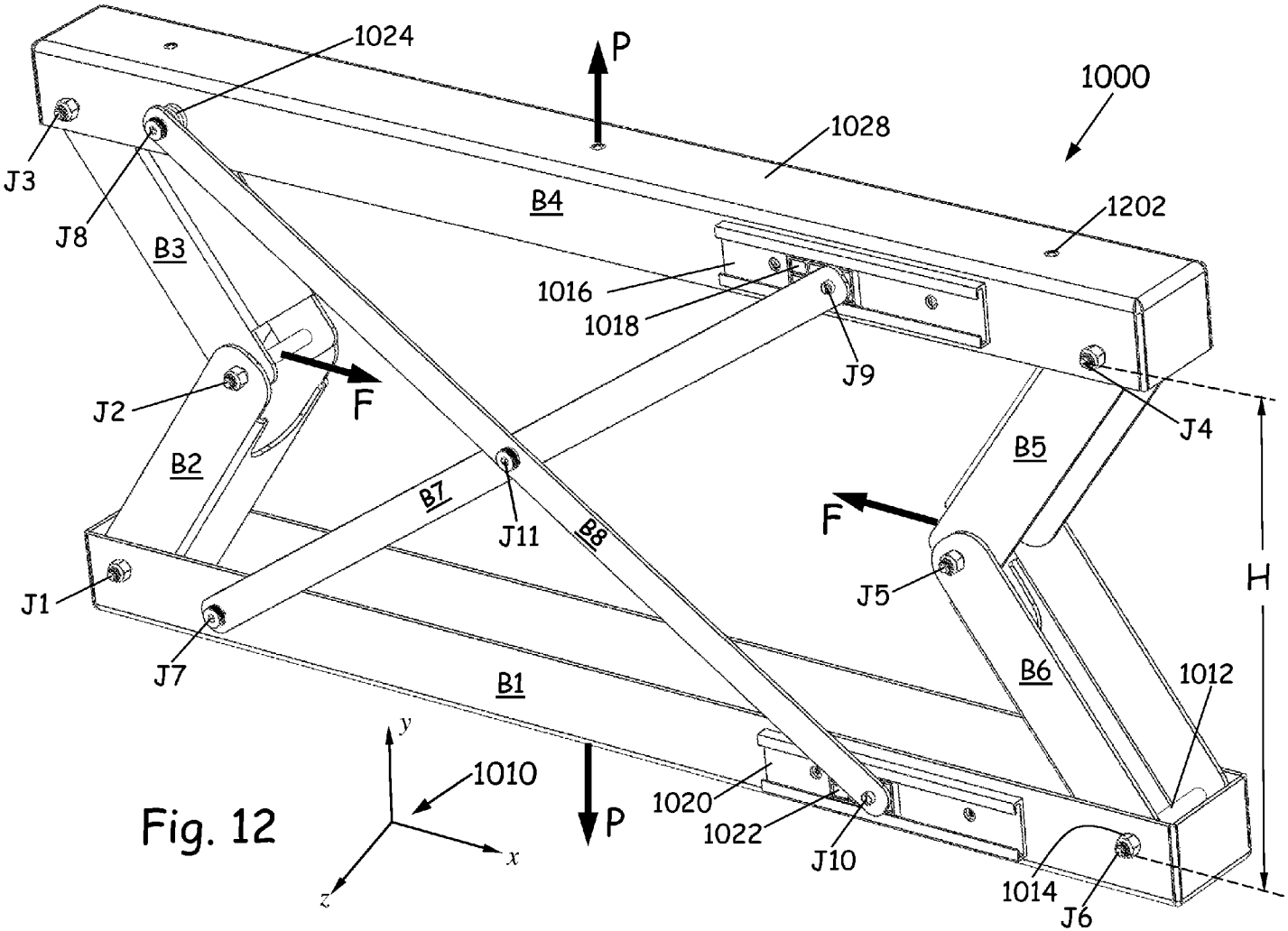
Figure 13A:
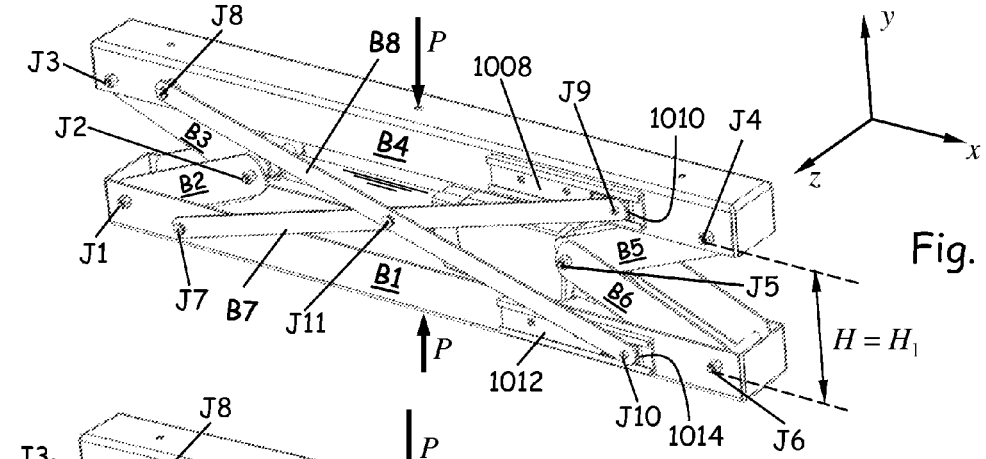
Figure 13B:
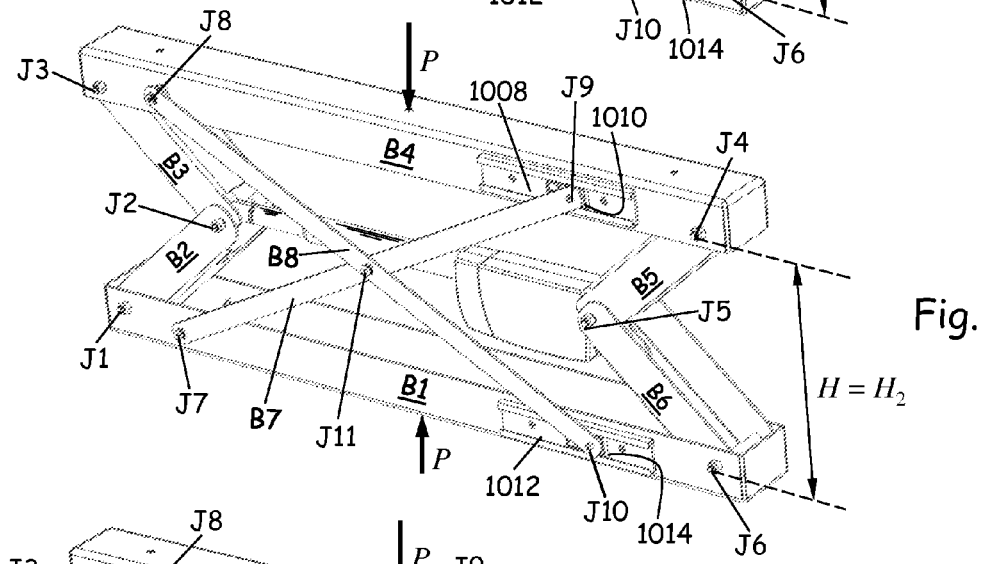
Figure 13C:
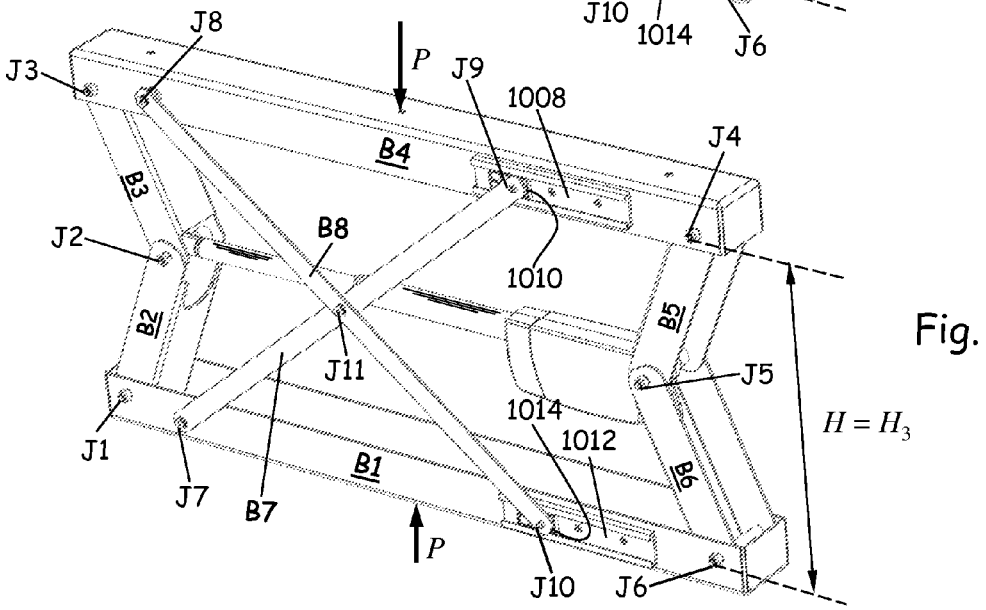
Figure 14A:
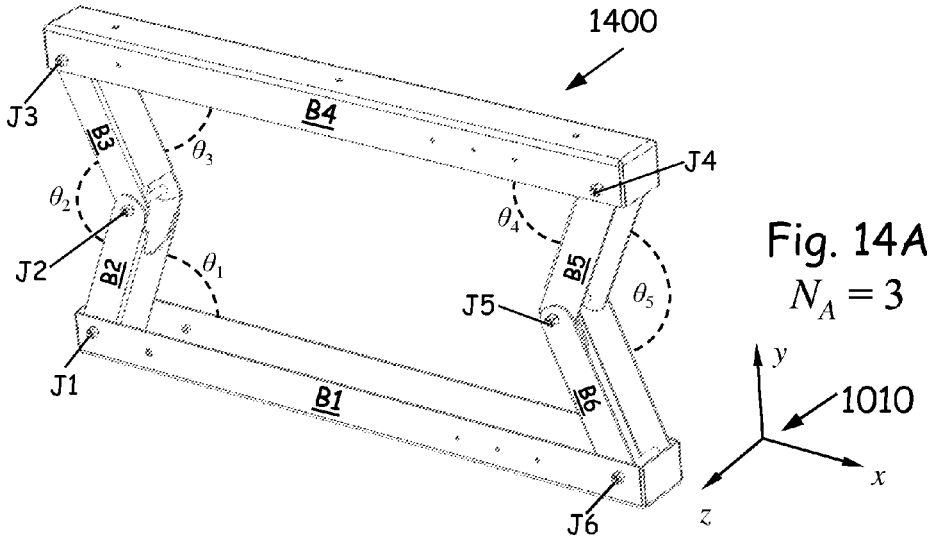
Figure 14B:
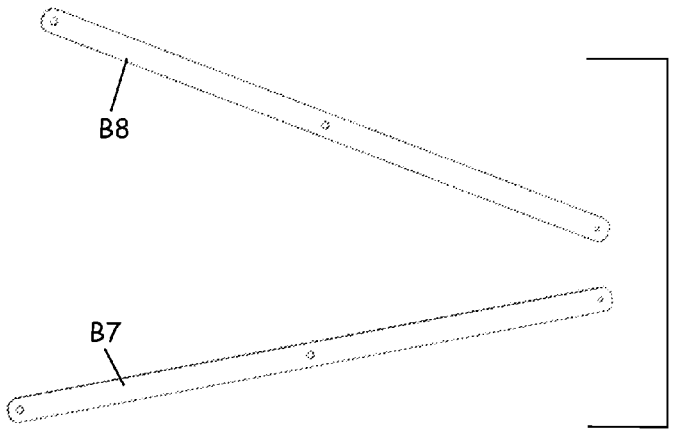
Figure 14C:
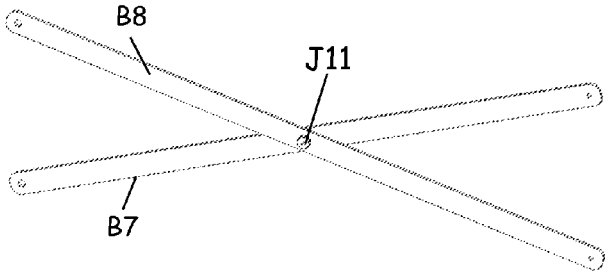
Figure 14D:
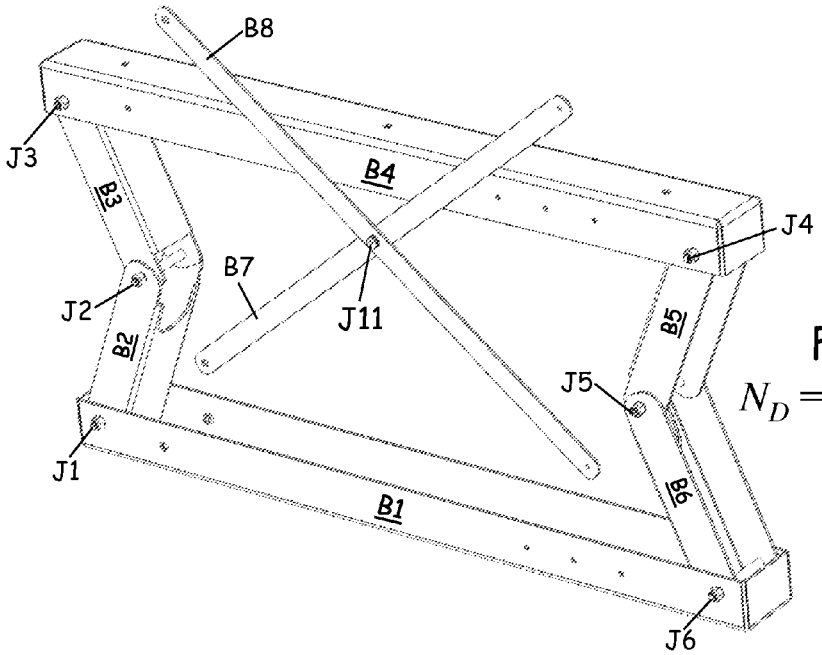
Figure 14E:
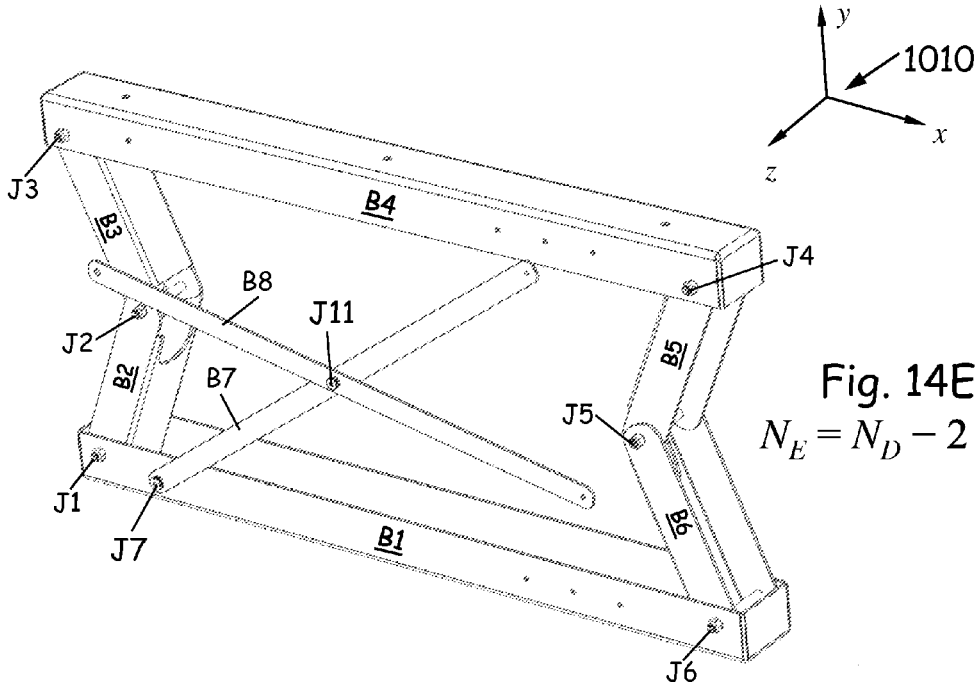
Figure 14F:
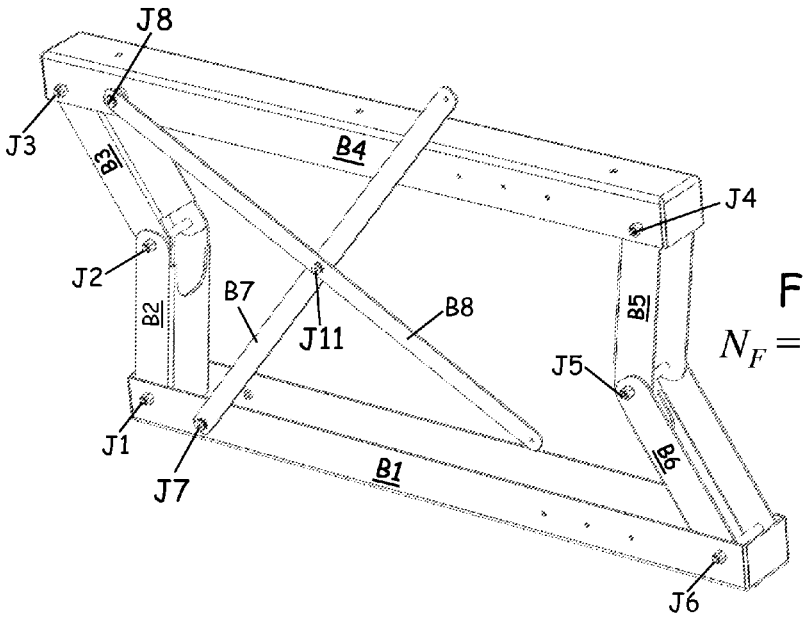
Figure 14G:
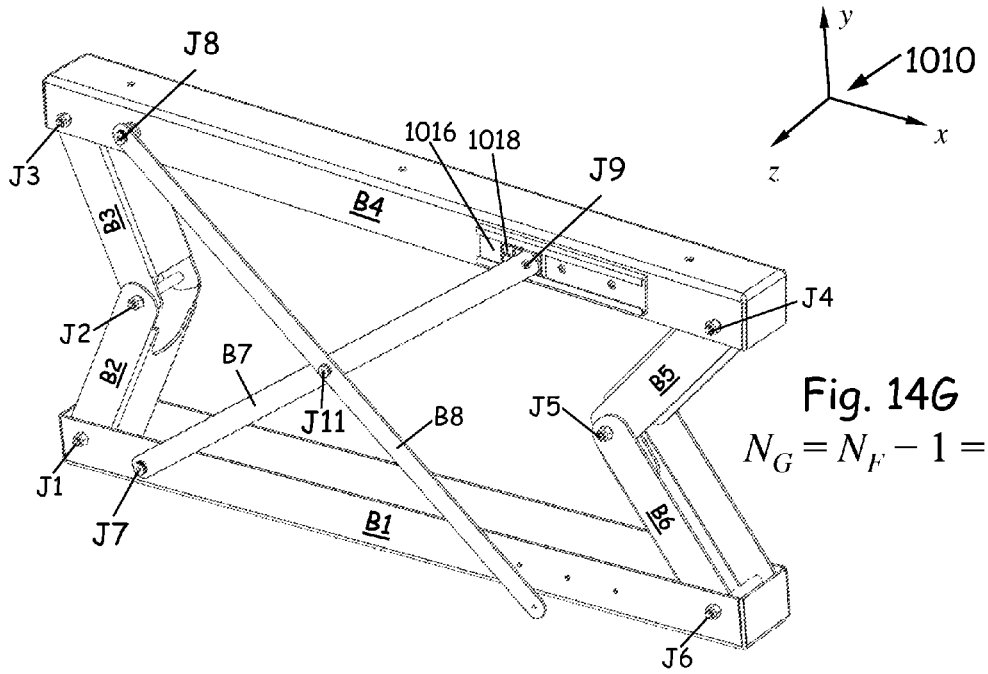
Figure 14H:
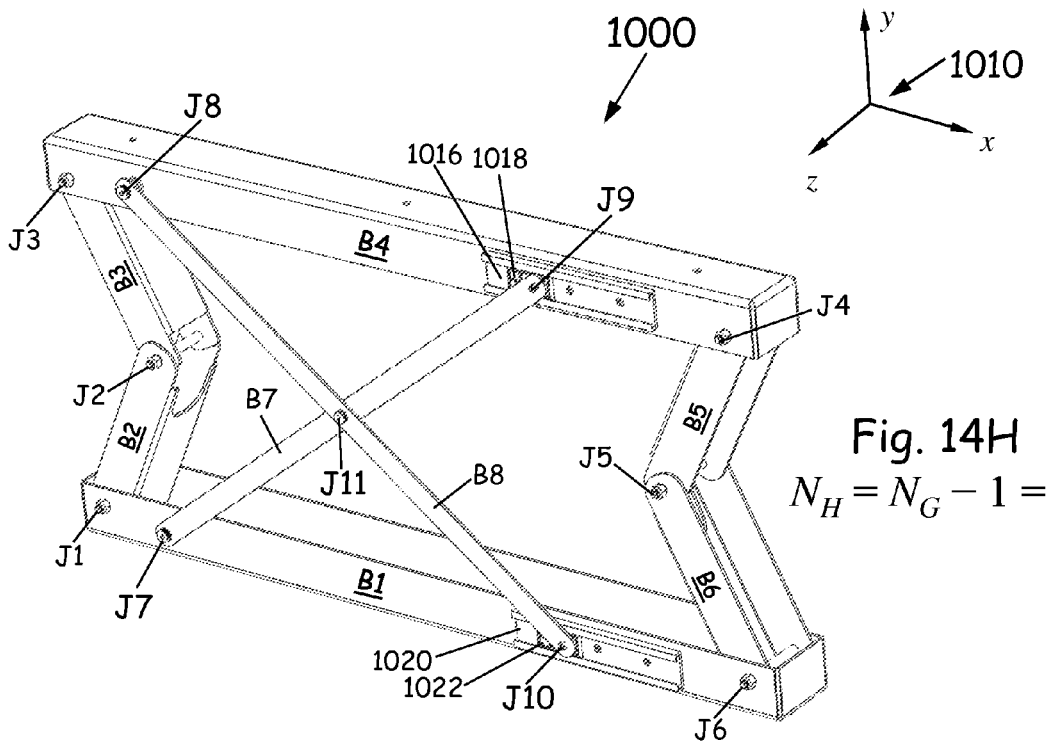
Figure 15A:
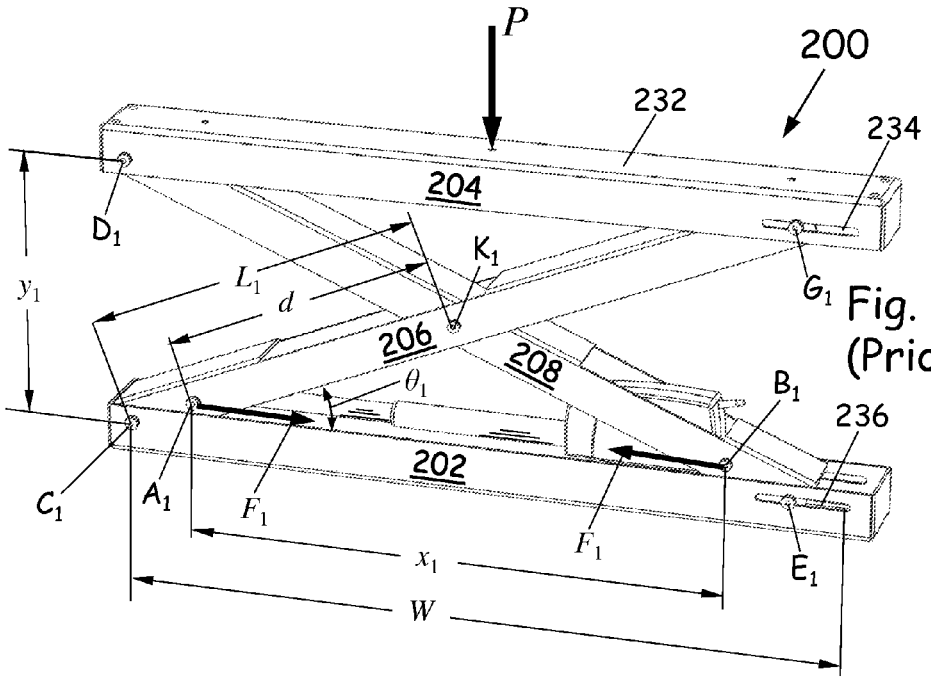
Fig. 15A (Prior Art)
Figure 15B:
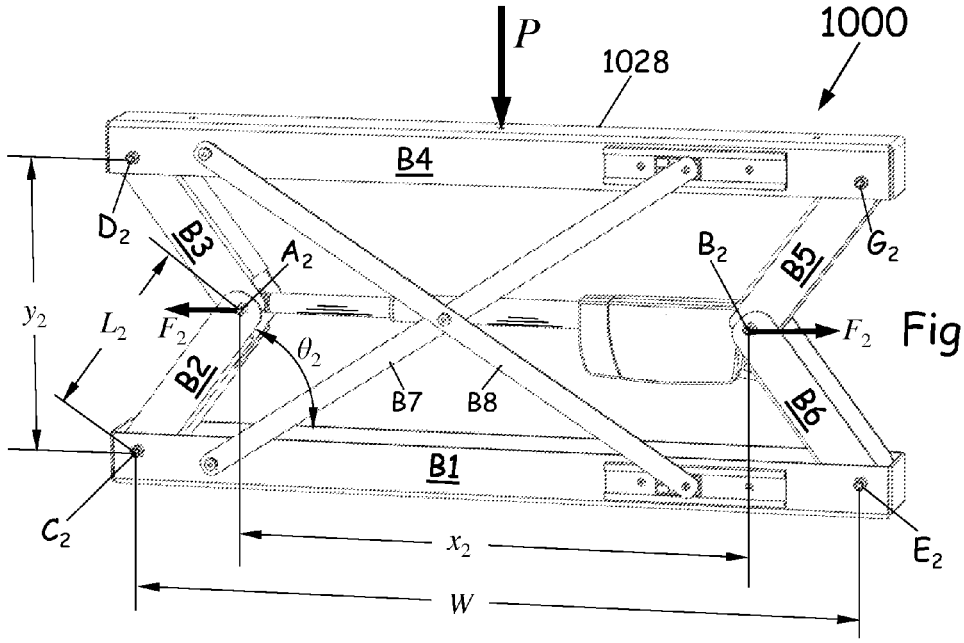
Figure 16:
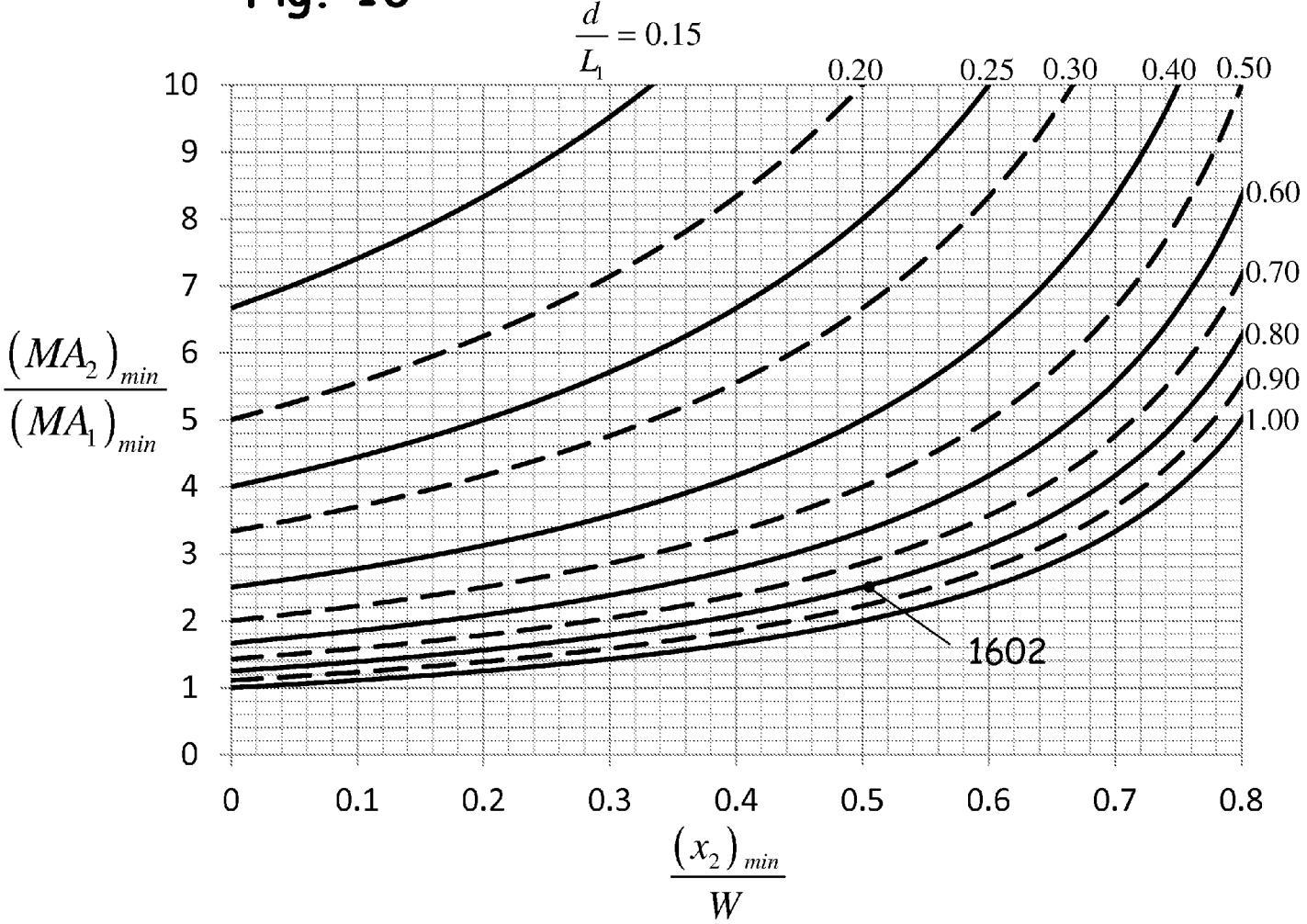
Figure 17A:
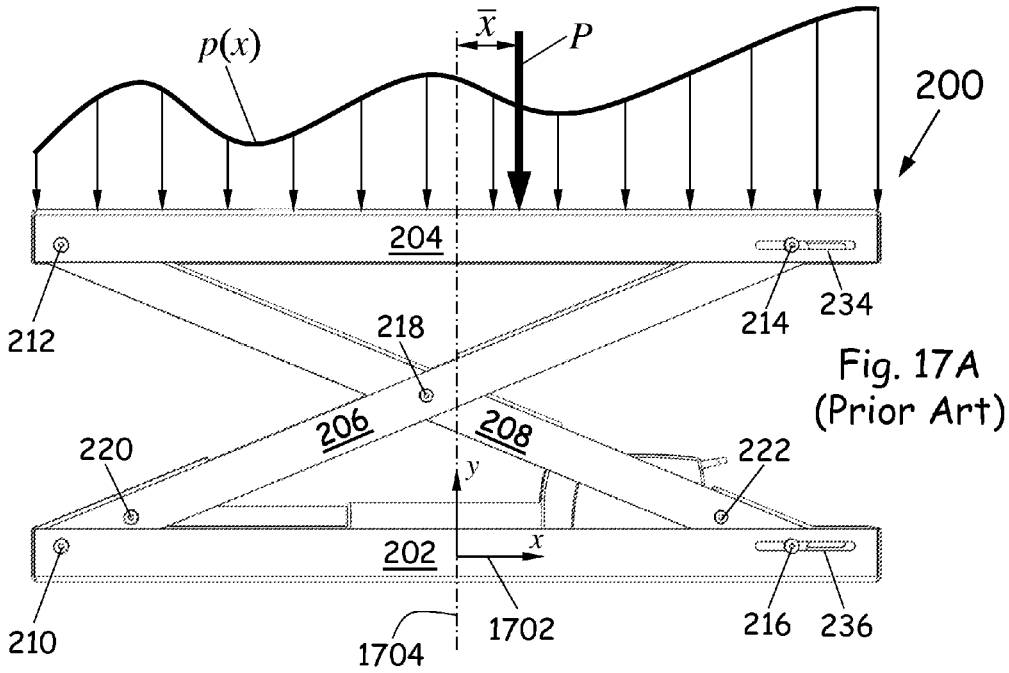
Fig. 17A (Prior Art)
Figure 18A:
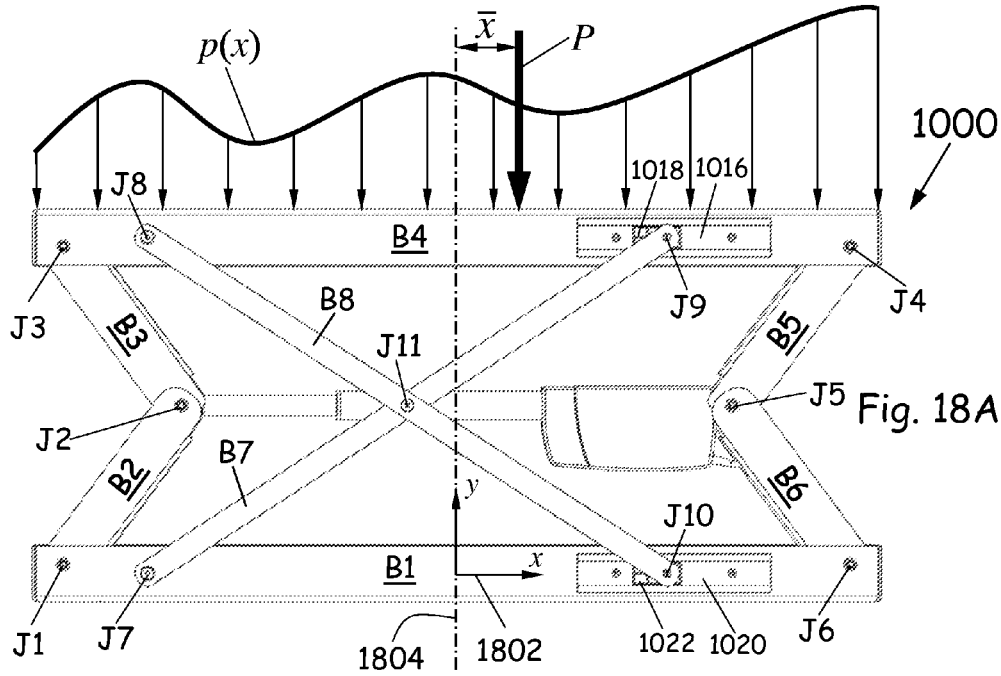
Figure 17B:
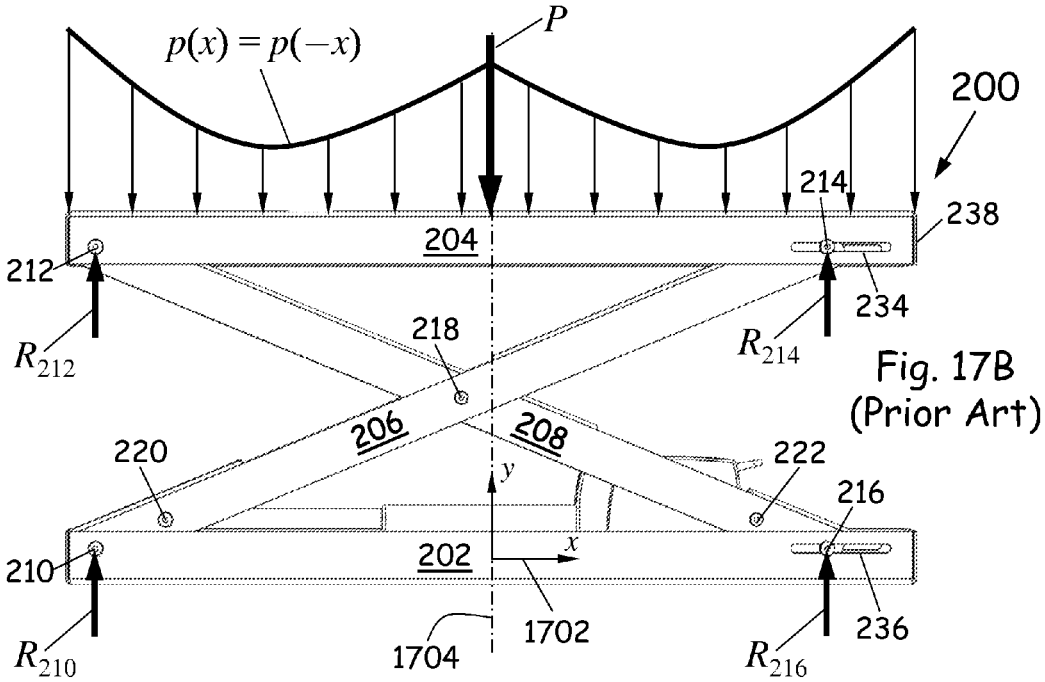
Fig. 17B (Prior Art)
Figure 18B:
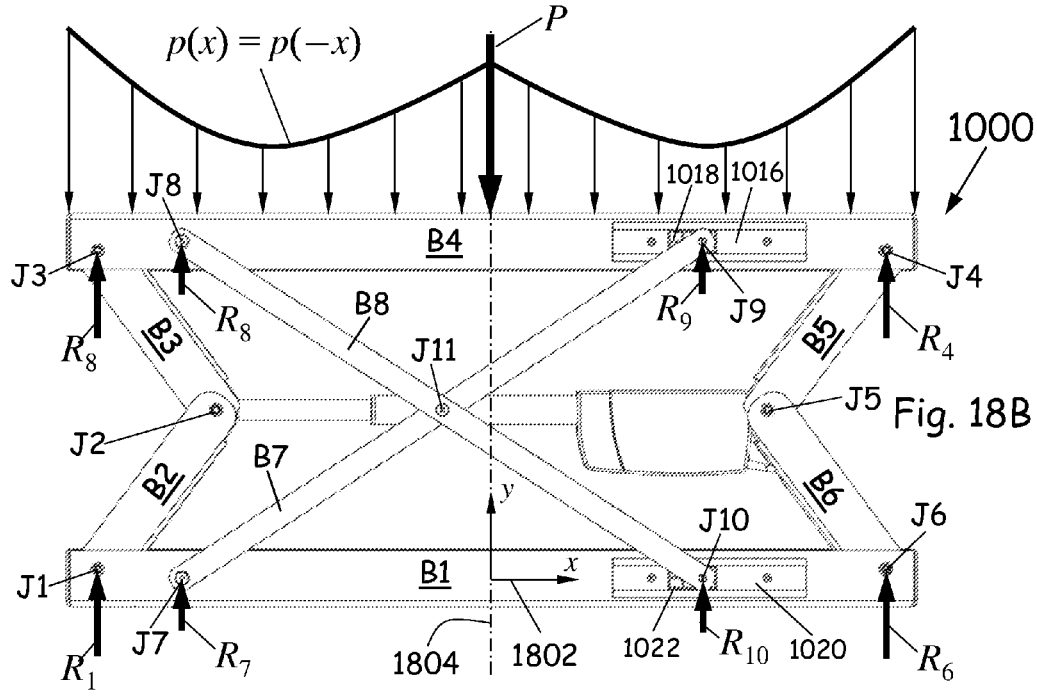
Figure 19:
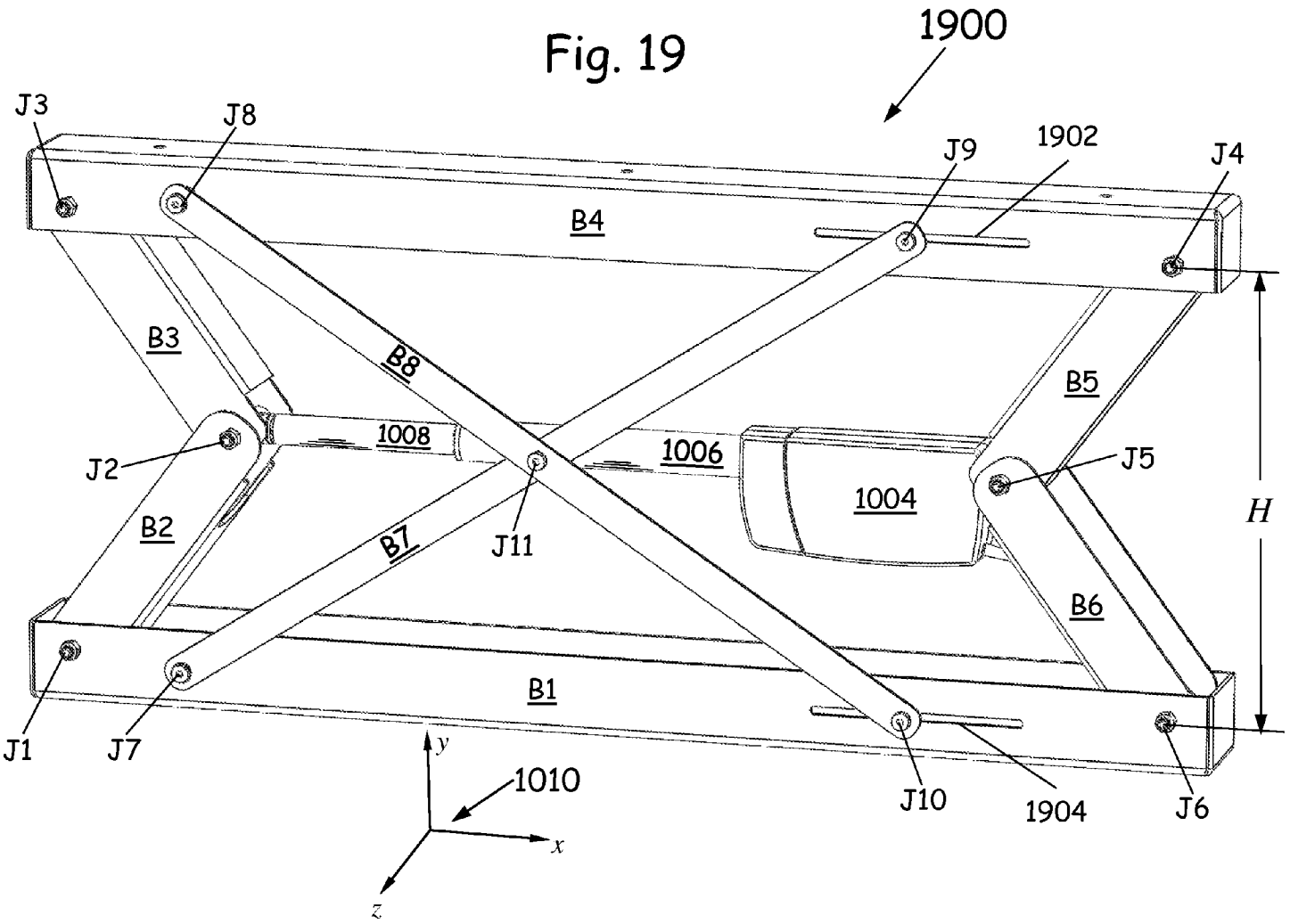
Figure 20:
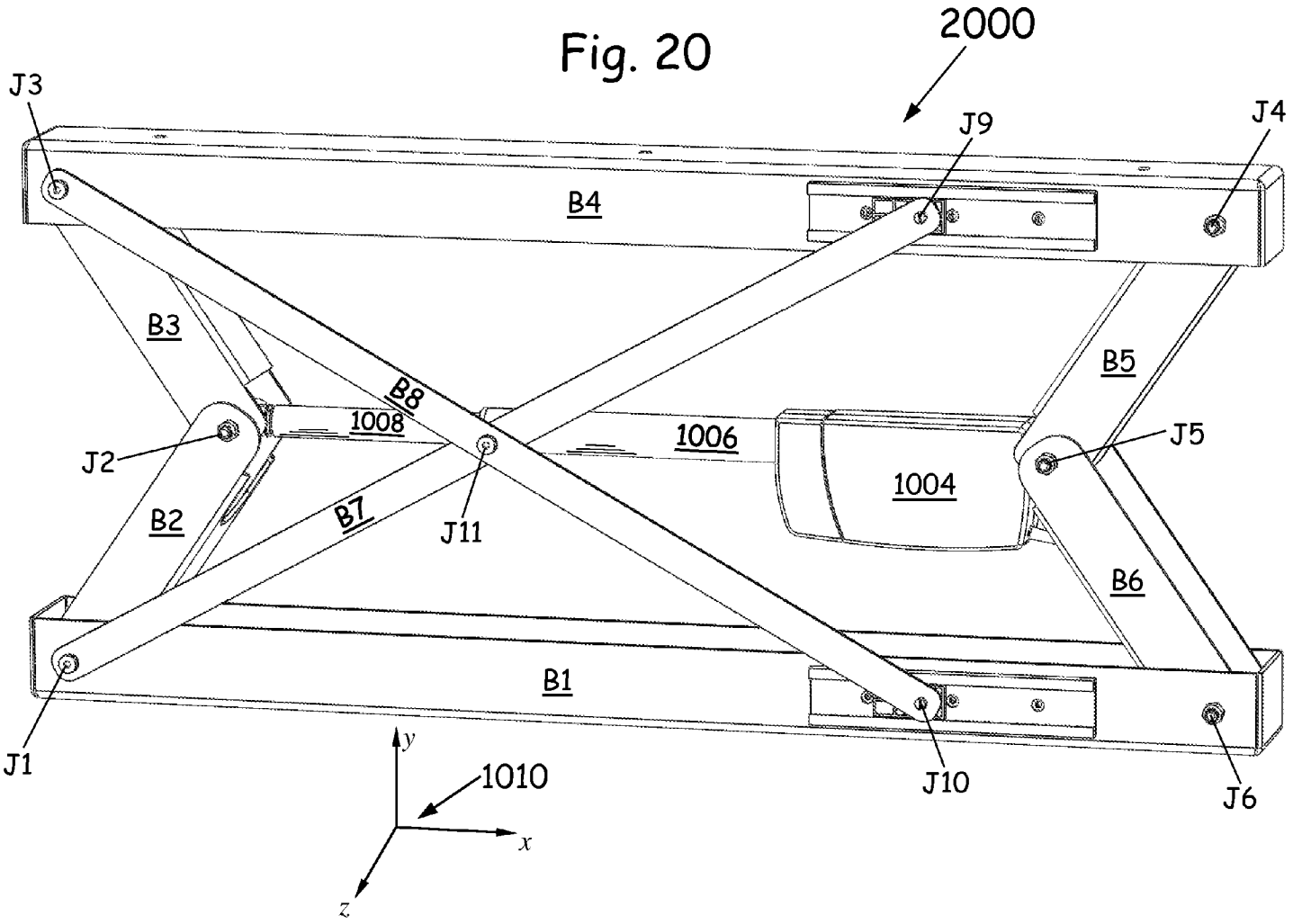
Figure 21:
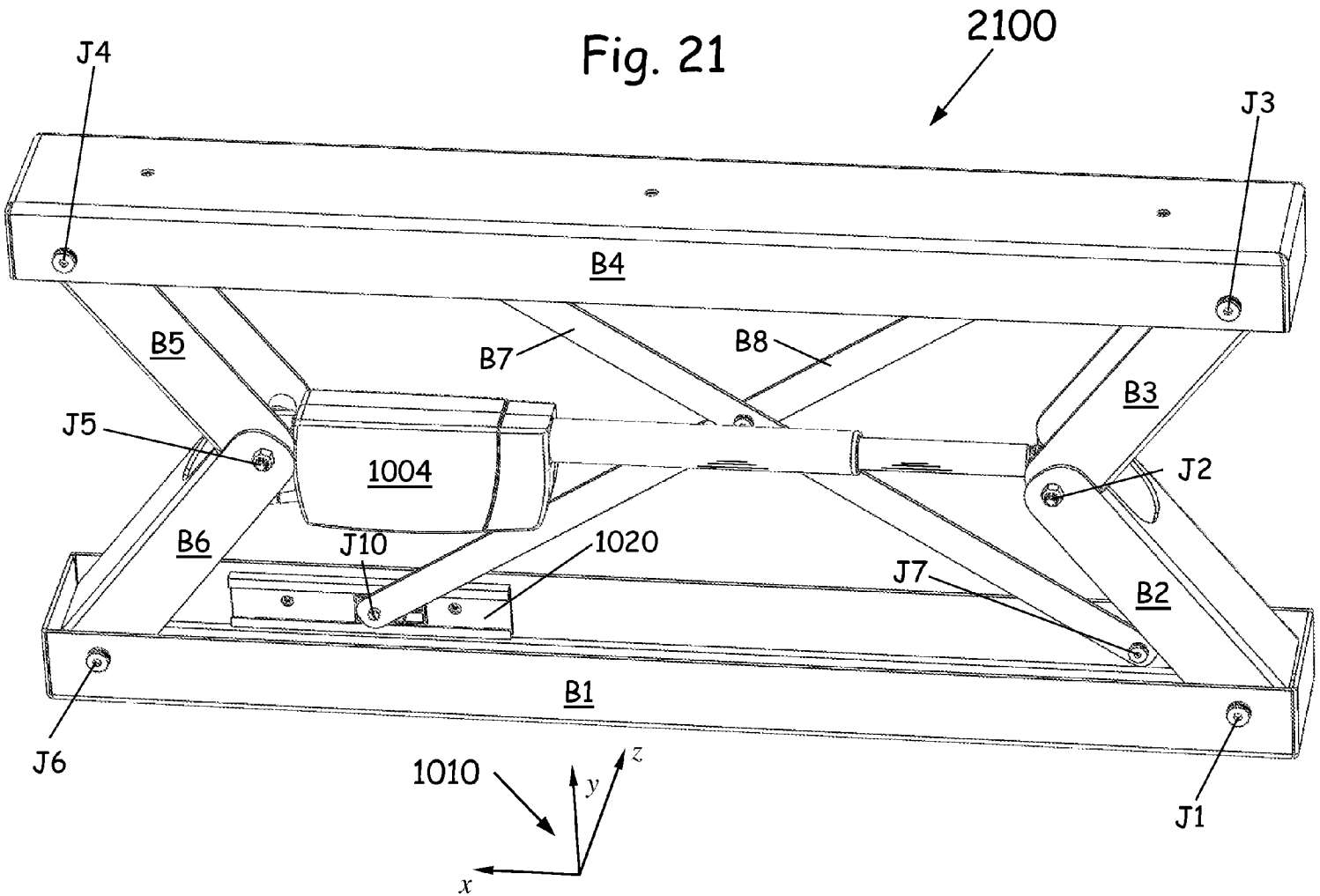
Figure 22A:
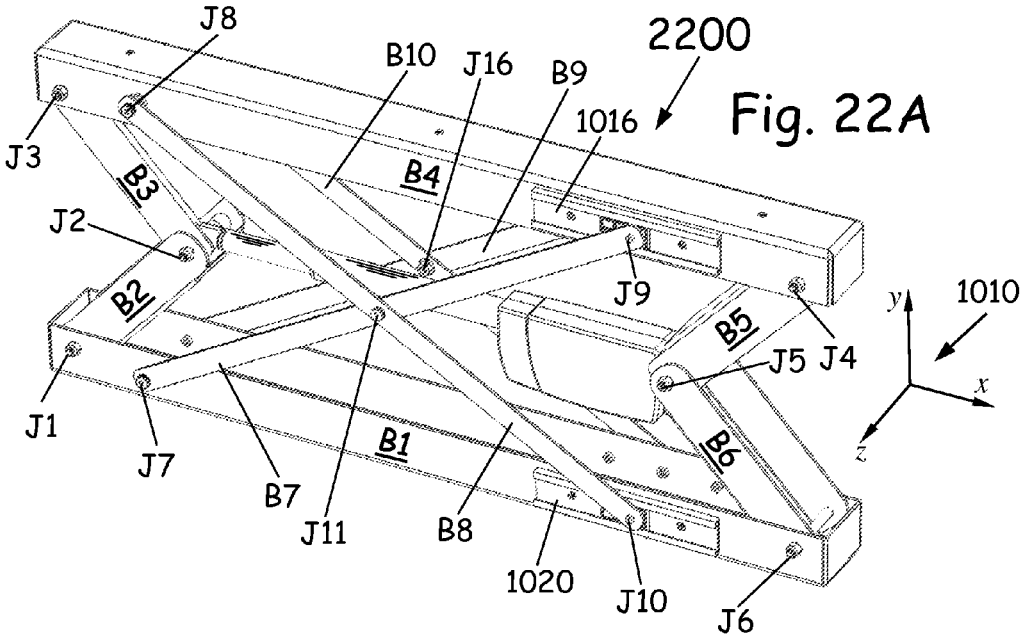
Figure 22B:
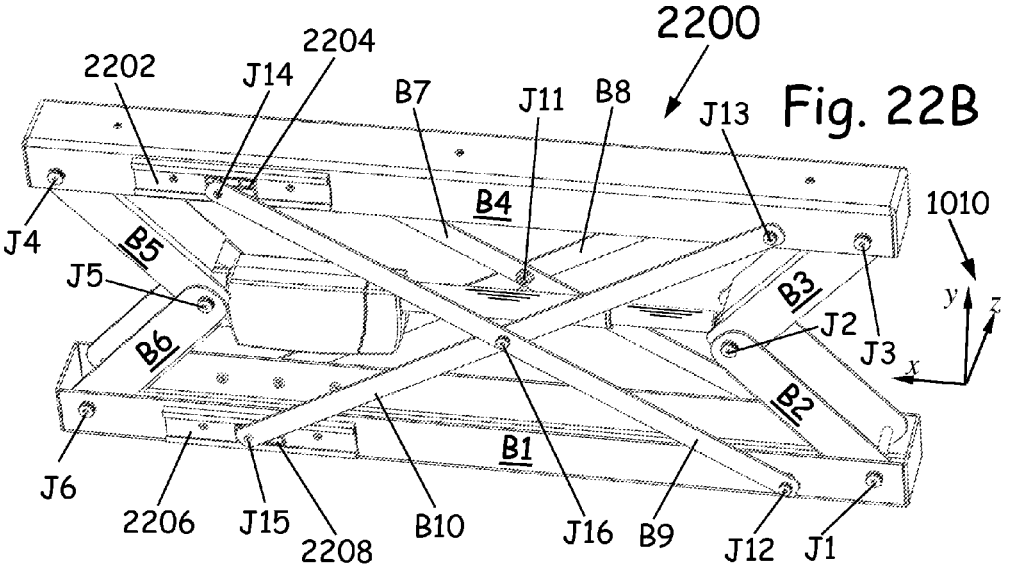
Figure 23:
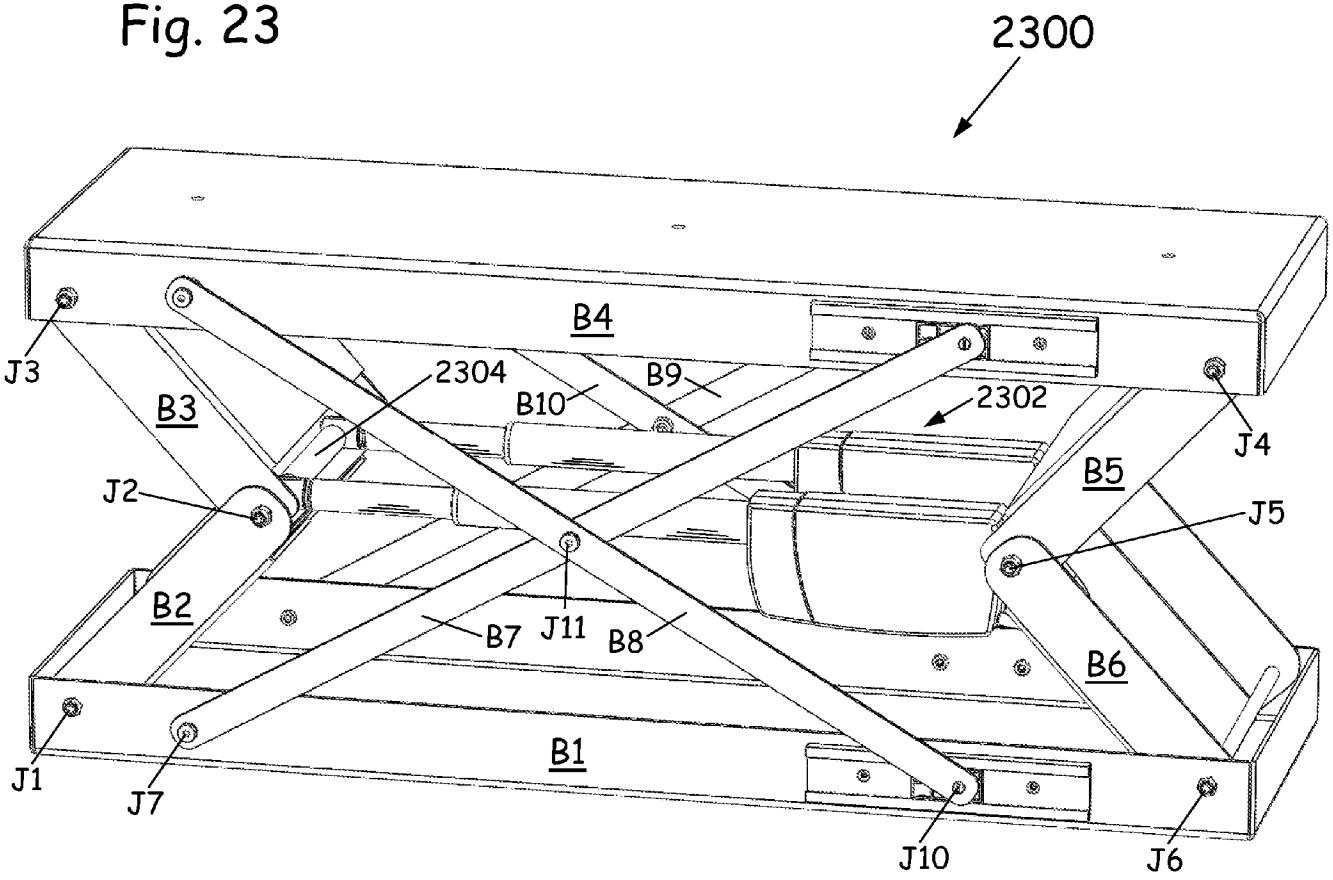
Figure 24:
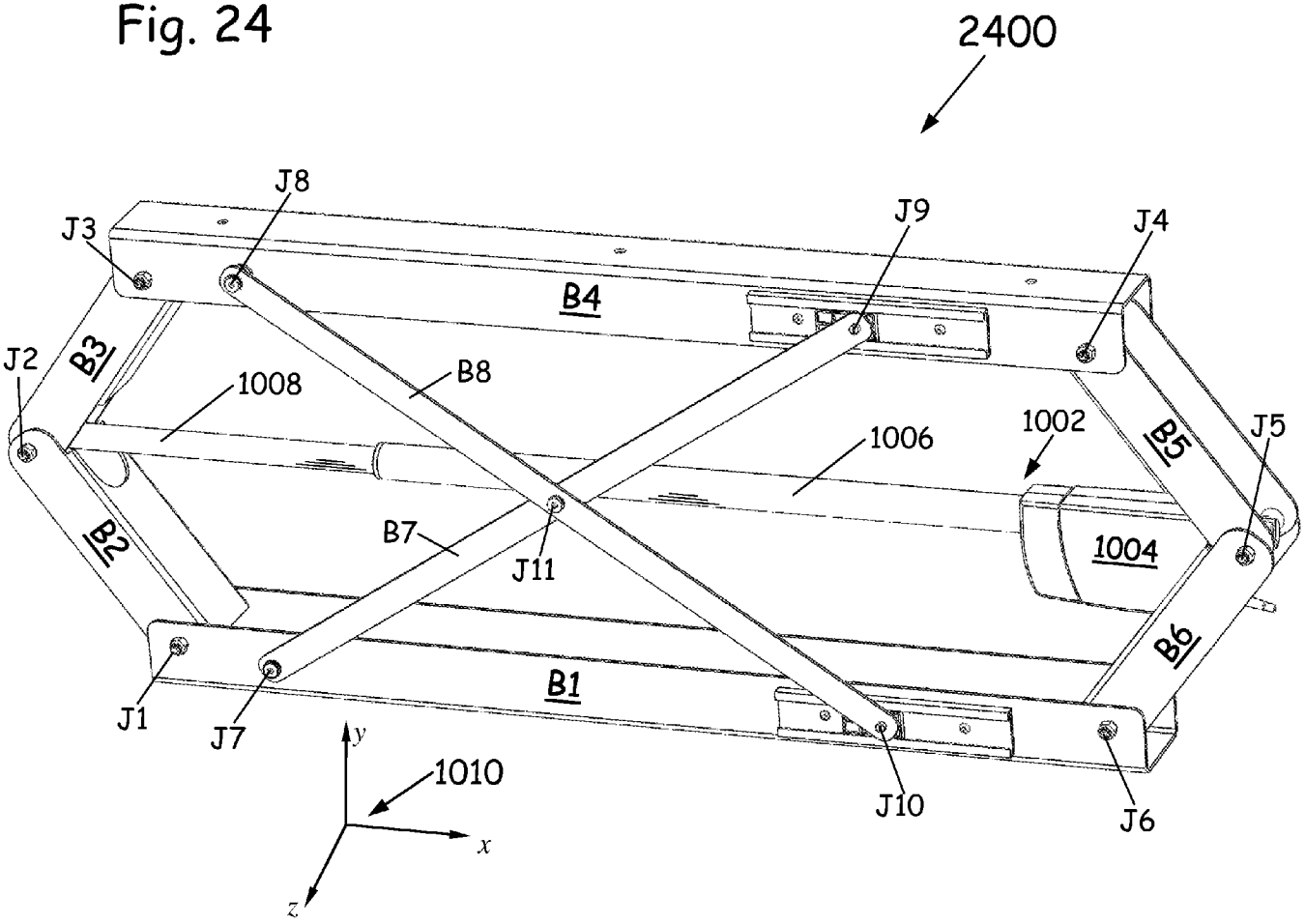
Figure 25:
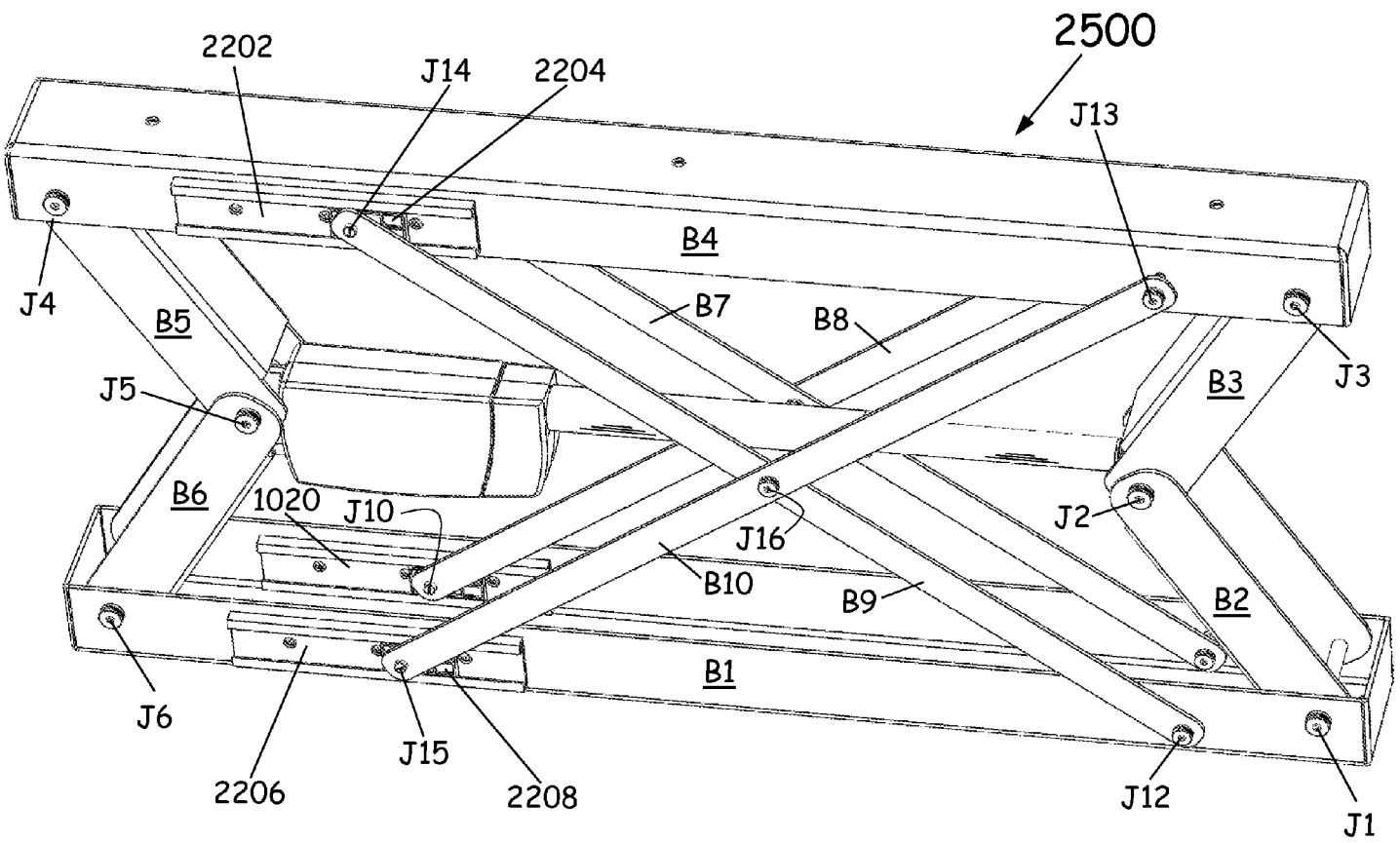
Figure 26:
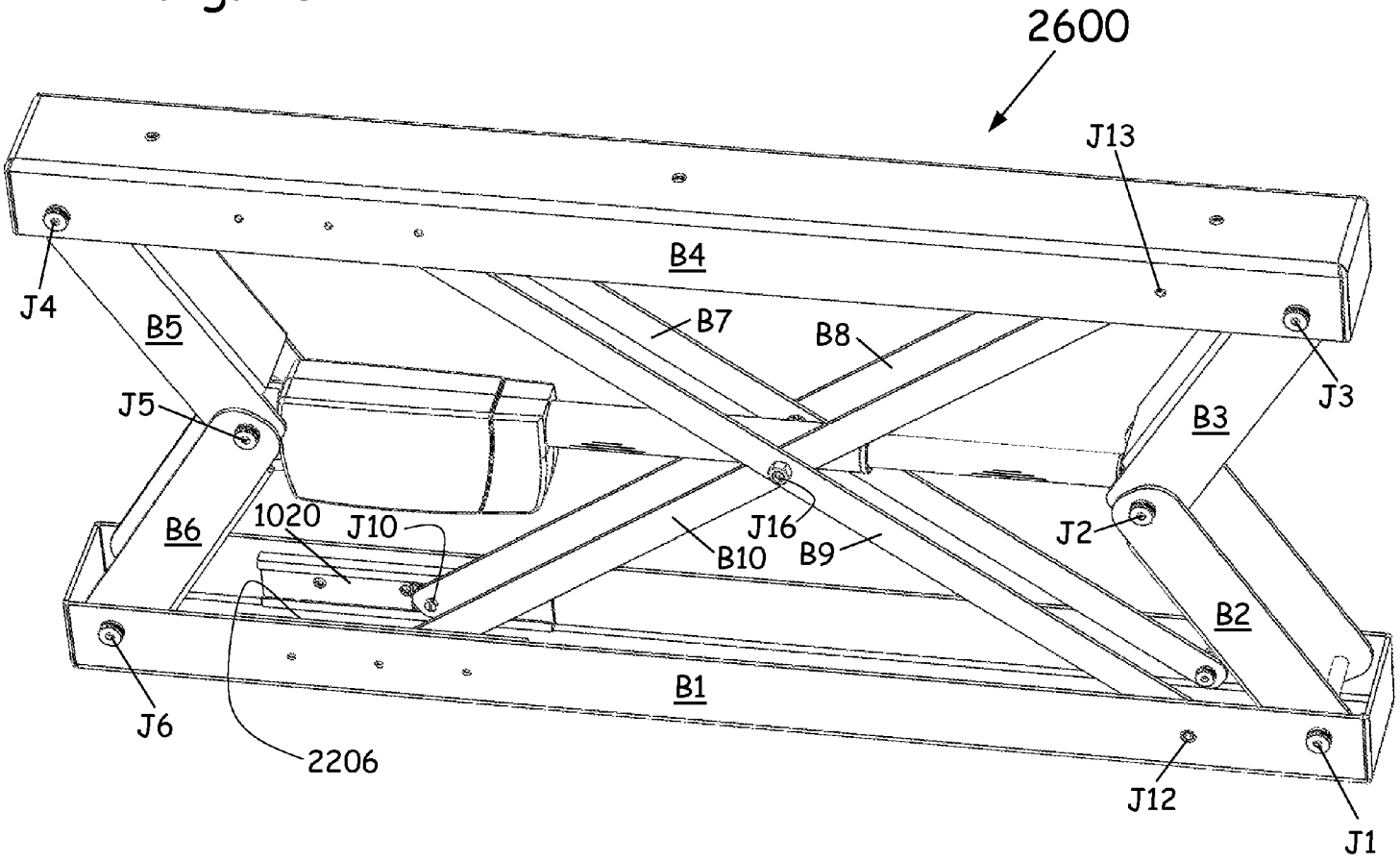

FIGS. 5A and 5B illustrate the concept of degrees of freedom for two simple linkages FIGS. 6A, 6B, and 6C illustrate how to discern the number of degrees of freedom for the prior-art X linkage FIGS. 7A and 7B illustrate how to discern the number of degrees of freedom for Hulsart's linkage FIGS. 8A and 8B illustrate a first extraneous degree of freedom of Hulsart's linkage FIGS. 9A and 9B illustrate a second extraneous degree of freedom of Hulsart's linkage FIG. 10 illustrates a first embodiment of the hex-plus-X linkage FIG. 11 illustrates a compressive application of the hex-plus-X linkage FIG. 12 illustrates a tensile application of the hex-plus-X linkage FIGS. 13A, 13B, and 13C illustrate operation of the hex-plus-X linkage FIGS. 14A through 14H demonstrate that the hex-plus-X linkage has one degree of freedom FIGS. 15A and 15B illustrate an analysis of mechanical advantage which proves that the hex-plus-X linkage has a superior mechanical advantage vis-à-vis the X linkage FIG. 16 illustrates the quantitative result of the analysis of mechanical advantage FIGS. 17A and 18A illustrate an analysis of force borne by sliding joints in the hex-plus-X linkage vis-à-vis the X linkage FIGS. 17B and 18B further illustrate the analysis of force borne by sliding joints in the hex-plus-X linkage vis-à-vis the X linkage FIG. 19 illustrates a second embodiment of the hex-plus-X linkage FIG. 20 illustrates a third embodiment of the hex-plus-X linkage FIG. 21 illustrates a fourth embodiment of the hex-plus-X linkage FIGS. 22A and 22B illustrate a fifth embodiment of the hex-plus-X linkage FIG. 23 illustrates a sixth embodiment of the hex-plus-X linkage FIG. 24 illustrates a seventh embodiment of the hex-plus-X linkage FIG. 25 illustrates an eighth embodiment of the hex-plus-X linkage and FIG. 26 illustrates a ninth embodiment of the hex-plus-X linkage.

5. DRAWINGS

List of Reference Numerals

Reference numerals introduced in FIG. 1 are in the range 100-199; those introduced in FIG. 2 are in the range 200-299; and so on. For various embodiments of the hex-plus-X linkage, a prefix letter "B" denotes a bar, and a prefix letter "J" denotes a joint.

100 Prior-art, six-bar, convex-hexagonal linkage
102 Base bar
104 First articulating bar
106 Second articulating bar
108 Top bar
110 Third articulating bar
112 Fourth articulating bar
114 Joint between bars 102 and 104
116 Joint between bars 104 and 106
118 Joint between bars 106 and 108
120 Joint between bars 108 and 110
122 Joint between bars 110 and 112
124 Joint between bars 112 and 102
126 Lead screw
128 Motor
130 Gearbox
132 Lead nut
134 Load-bearing top surface of bar 108
136 Lobes on bar 104
138 Lobes on bar 112
140 Lobes on bar 106
142 Lobes on bar 110
200 Prior-art X Linkage
202 Base bar
204 Top bar
206 First X bar
208 Second X bar
210 Pivoting joint between bars 202 and 206
212 Pivoting joint between bars 204 and 208
214 Pivoting and sliding joint between bars 204 and 206
216 Pivoting and sliding joint between bars 202 and 208
218 Pivoting joint between bars 206 and 208
220 Pivoting joint between bar 206 and actuator piston 230
222 Pivoting joint between bar 208 and actuator body 226
224 Actuator
226 Actuator body
228 Actuator column
230 Actuator piston
232 Load-bearing top surface of bar 204
234 Slot in bar 204
236 Slot in bar 202
238 Cantilevered end of bar 204
240 End of bar 202 beneath cantilever
300 Prior-art, concave-hexagonal linkage (Hulsart)
302 Base bar
304 Lower-left V bar
306 Upper-left V bar
308 Top bar
310 Upper-right V bar
312 Lower-right V bar
314 Pivoting joint between bars 302 and 304
316 Pivoting joint between bars 304 and 306
318 Pivoting joint between bars 306 and 308
320 Pivoting joint between bars 308 and 310
322 Pivoting joint between bars 310 and 312

324 Pivoting joint between bars 312 and 302
326 Lead screw
328 Right-threaded portion of lead screw
330 Smooth center portion of lead screw
332 Left-threaded portion of lead screw
334 Right-threaded lead nut
336 Left-threaded lead nut
338 Motor
340 Motor shaft
342 Motor platform
344 Arms of motor platform
346 Motor sprocket
348 Lead-screw sprocket
350 Belt or chain
352 Floor surface
354 Edge of motor platform
502 Rigid bar
504 Clevis
506 Fixed base
508 First pivoting bar
510 Second pivoting bar
512 Third pivoting bar
602 Imaginary X-linkage with two joints disconnected
604 First hole in bar 208
606 Hole in bar 206
608 Second hole in bar 208
610 Imaginary X-linkage with one joint disconnected
612 Linkage 200 with actuator hidden
702 Imaginary version of Hulsart's linkage with one joint disconnected
704 Axis of holes 706 in bar 312
706 Holes in bar 312
708 Axis of holes 710 in bar 302
710 Holes in bar 302
1000 First embodiment of a hex-plus-X linkage
B1 Base bar
B2 First lower V bar
B3 First upper V bar
B4 Top bar
B5 Second upper V bar
B6 Second lower V bar
B7 First X bar
B8 Second X bar
1002 Linear Actuator
1004 Body of linear actuator
1006 Cylinder of linear actuator
1008 Piston of linear actuator
J1 Pivoting joint attaching B1 to B2
J2 Pivoting joint attaching B2 to B3
J3 Pivoting joint attaching B3 to B4
J4 Pivoting joint attaching B4 to B5
J5 Pivoting joint attaching B5 to B6
J6 Pivoting joint attaching B6 to B1
J7 Pivoting joint attaching B7 to B1
J8 Pivoting joint attaching B8 to B4
J9 Pivoting and sliding joint attaching B7 to B4
J10 Pivoting and sliding joint attaching B8 to B1
J11 Pivoting joint attaching B7 to B8
1010 xyz coordinate system
1012 Shoulder Screw
1014 Nut
1016 First bearing channel
1018 First slider
1020 Second bearing channel
1022 Second slider
1024 Spacer at joint J8
1026 Piston-centering spacer
1028 Load-bearing top surface of bar B4
1030 Cutout in bar B6
1032 Cutout in bar B2
1034 Cutout in bar B3
1400 Hexagonal assembly of linkage 1000
1602 Example of mechanical-advantage superiority
1702 xy coordinate system on centerline 1704 of X linkage
1704 Centerline of X linkage
1802 xy coordinate system on centerline 1804 of hex-plus-X linkage
1804 Centerline of hex-plus-X linkage
1900 Second embodiment of a hex-plus-X linkage
1902 Slot in bar B4
1904 Slot in bar B1
2000 Third embodiment of a hex-plus-X linkage
2100 Fourth embodiment of a hex-plus-X linkage
2200 Fifth embodiment of a hex-plus-X linkage
B9 Third X bar
B10 Fourth X bar
J12 Pivoting joint attaching B9 to B1
J13 Pivoting joint attaching B10 to B4
J14 Pivoting and sliding joint attaching B9 to B4
J15 Pivoting and sliding joint attaching B10 to B1
J16 Pivoting joint attaching B9 to B10
2300 Sixth embodiment of a hex-plus-X linkage
2302 Second linear actuator
2304 Axial spacer
2400 Seventh embodiment of a hex-plus-hex linkage

6. DETAILED DESCRIPTION

First Embodiment (FIG. 10)

A first embodiment of a hex-plus-X linkage 1000 is illustrated in FIG. 10. It is designed to perform a motion parallel to an imaginary xy plane of an imaginary Cartesian xyz coordinate system 1010 having an imaginary x axis, an imaginary y axis, and an imaginary z axis that define the xy plane as well as an imaginary xz plane and an imaginary yz plane.

In accordance with the first embodiment, the hex-plus-X linkage 1000 comprises eight bars, including

- a base bar B1 that extends along the x axis, having a first end located at a small value of x and a second end located at a larger value of x, and also having a base surface substantially parallel to the xz plane
- a first lower V bar B2
- a first upper V bar B3
- a top bar B4 having a load-bearing top surface 1028 whose size projected upon the xz plane defines a top footprint
- a second upper V bar B5
- a second lower V bar B6
- a first X bar B7,
- a second X bar B8, and further comprises a linear actuator 1002 that typically comprises an actuator body 1004, an annular cylinder 1006, and a piston 1008. Well known in the art, the linear actuator 1002 may be powered electrically, pneumatically, hydraulically, or otherwise. For example, electrically powered linear actuators are available from Thomson Industries of Radford, Va.

Bars B1 through B6 are attached end-to-end in a loop by pivoting joints to form a hexagonal assembly. Specifically, a first end of bar B1 is pivotally attached to a first end of bar B2 at a joint J1, a second end of bar B2 is pivotally attached to a first end of bar B3 at a joint J2, a second end of bar B3 is pivotally attached to a first end of bar B4 at a joint J3, a second bar of bar B4 is pivotally attached to a first end of bar B5 at a joint J4, a second end of bar B5 is pivotally attached to a first end of bar B6 at a joint J5, and a second end of bar B6 is pivotally attached to a second end of bar B1 at a joint J6.

Let the x coordinates of joints J1 through J6 be denoted $\hat{x}_1$ through $\hat{x}_6$ respectively. In this embodiment and in several other embodiments shown herein, $\hat{x}_3$ is substantially equal to $\hat{x}_1$, and $\hat{x}_4$ is substantially equal to $\hat{x}_6$. Moreover, $\hat{x}_2$ is greater than $\hat{x}_3$ throughout the motion, and $\hat{x}_5$ is less than $\hat{x}_4$ throughout the motion, whereby, throughout the motion, a hexagon formed by bars B1, B2, B3, B4, B5 and B6 is concave, and consequently, throughout the motion, the V bars B2, B3, B5 and B6 remain substantially within the top footprint. This provides the advantage of avoiding substantial encumbrances outside the top footprint that would, as in the prior-art linkage 100, occupy valuable space and potentially pose a tripping hazard.

The X bars B7 and B8 are pivotally attached to each other at a joint J11 to form an X assembly. To eliminate extraneous degrees of freedom in the hexagonal assembly, the X assembly is attached thereto at four joints. Specifically, a first end of bar B7 is pivotally attached near the first end of bar B1 at a joint J7; a first end of bar B8 is pivotally attached near the first end of bar B4 at a joint J8; a second end of bar J7 is pivotally and slidably attached to bar B4 at a joint J9; and a second end of bar J8 is pivotally and slidably attached to bar B1 at a joint J10. As will be demonstrated in Section 7.3, such connection of the X assembly (B7, B8) to the hexagonal assembly (B1, B2, . . . , B6) produces an eight-bar linkage (B1, B2, . . . , B8) that has just one mechanical degree of freedom, as is desired in many applications, whereby a distance H between the bottom bar B1 and the top bar B4 may be modulated by operation of the linear actuator 1002.

The body 1004 of the linear actuator 1002 is pivotally connected to joint J5, and the piston 1008 of linear actuator 1004 is pivotally connected to joint J2. Operation of the actuator 1002 in a forward direction causes the piston 1008 to extend from the cylinder 1006, thereby increasing a knee-to-knee distance d between joints J2 and J5, and thus increasing the distance H by articulation of the V bars (B2, B3) and (B5, B6). Conversely, operation of the actuator 1002 in a backward direction causes the piston 1008 to retract into the cylinder 1006, thereby decreasing the knee-to-knee distance d, and thus decreasing the distance H. Operation of the hex-plus-X linkage 1000 is further described in Section 7.2.

In FIG. 10, I contemplate that each of bars B1 through B6 has a U-channel cross-section, comprising a base flange, a first side flange having an inner surface facing in the negative z direction and an outer surface facing in the positive z direction, and a second side flange having an inner surface facing in the positive z direction and an outer surface facing in the negative z direction. However, other cross sections for bars B1 through B6 are also contemplated. Let the bars be denoted by an index i, in which i=1 for bar B1, i=2 for bar B2, and so on. With U-channel cross-sections, in the first embodiment 1000, each of the bars B1 through B6 has, parallel to the z axis, an inner dimension $w_i$ measured between the inner surfaces of the first and second side flanges, and an outer dimension $W_i$ measured between the outer surfaces of the first and second side flanges. The outer dimension of each of the lower V bars B2 and B6 is slightly less than the inner dimension of base bar B1 (i.e., $W_2<w_1$ and $W_6<w_1$), so that joints J1 and J6 may freely pivot, and so that the lower V bars B2 and B6 may nest inside the base bar B1. The outer dimensions of the upper V bars B3 and B5 are slightly less than the inner dimensions of the lower V bars B2 and B6 respectively (i.e., $W_3<w_2$ and $W_5<w_6$), so that joints J2 and J5 may freely pivot, and so that the upper V bar B3 may nest inside the lower V bar B2, and the upper V bar B5 may nest inside the lower V bar B6. The outer dimension of each of the upper V bars B3 and B5 is slightly smaller than the inner dimension of the top bar B4 (i.e., $W_3<w_4$ and $W_5<w_4$), so that joints J3 and J4 may freely pivot, and so that V bars B3 and B5 may nest inside top bar B4.

Each of the pivoting joints J1 through J8, as well as joint J11, may comprise a shoulder screw and a nut. Well known in the art, a shoulder screw comprises a head, a smooth shoulder having a shoulder length L, and a threaded portion whose diameter is smaller than that of the shoulder. A proximal end of the shoulder abuts the head. A distal end of the shoulder abuts the threaded portion at a stopping surface where the larger-diameter shoulder meets the smaller-diameter threaded portion. To create a pivoting joint, the nut is tightened against the stopping surface, but the joint does not bind because the shoulder length L is chosen to provide a slight amount of axial play in the joint. For example, in FIG. 10, joint J6 comprises a shoulder screw 1012 and a nut 1014 that is threaded upon the threaded portion of the shoulder screw. The smooth shoulder of shoulder screw 1012 passes through clearance holes in both side flanges of bar B1 and in both side flanges of bar B6. Length L of the smooth shoulder of shoulder screw 1012 is chosen to be slightly longer than the outer dimension $W_1$ of bar B1 in the z direction. Consequently, bar B1 is not deformed when the nut 1014 is tightened against the stopping surface of shoulder screw 1012, and thus bar B1 does not bind on bar B6.

Alternatively, some or all of the pivoting joints J1 through J8, as well as J11, may comprise a clevis-pin assembly, well known in the art. A clevis-pin assembly comprises a clevis pin and one or two cotter pins, or a clevis pin and one or two retaining rings. Other alternative, well-known means may also be used to provide the pivoting joints.

Each of the pivoting-and-sliding joints J9 and J10 comprises a bearing assembly. For example, at joint J9, a first bearing assembly may comprise a first bearing channel 1016 and a first slider 1018 that slides therein. Such a bearing assembly is available, for example, from PCB Linear of Roscoe, Ill., or from Velmex, Inc. of Bloomfield, N.Y. The bearing channel 1016 is affixed to bar B4. Slider 1018 comprises a tapped hole into which is threaded a shoulder screw whose smooth shoulder portion passes through a clearance hole in bar B7. The stopping surface of the shoulder screw is tightened against slider 1018, but because the shoulder length L of the shoulder screw is slightly longer than a thickness of bar B7 in the z direction, bar B7 may freely pivot with respect to the slider 1018.

Likewise at joint J10, a second bearing assembly may comprise a second bearing channel 1020 and a second slider 1022. The bearing channel 1020 is affixed to bar B1. Slider 1022 comprises a tapped hole into which is threaded a shoulder screw whose smooth shoulder portion passes through a clearance hole in bar B8. The stopping surface of the shoulder screw is tightened against slider 1022, but because the shoulder length L of the shoulder screw is slightly longer than a thickness of bar B8 in the z direction, bar B8 may freely pivot with respect to the slider 1022.

Alternatively, each of the rotating-and-sliding joints J9 and J10 in FIG. 10 may be provided otherwise. For example, joint J9 may be provided by cutting a slot in each of the two side flanges of bar B4, and passing a shoulder screw or clevis pin therethrough, in a manner somewhat analogous to that shown in FIG. 2 for prior-art linkage 200, wherein shoulder screw 216 passes through slots 236.

Because the bearing channel 1020 and the slider 1022 have a combined, bearing-assembly thickness in the z direction, a spacer or set of spacers 1024 may be used at joint J8 to keep bar B8 parallel to the xy plane. Similarly, a spacer (not visible in FIG. 10) may be used at joint J7 to keep bar B7 parallel to the xy plane. For a similar purpose, depending on the z dimensions of bars B1, B4, B7 and B8, a spacer may also be used at joint J9, between bar B7 and slider 1018, or at joint J10, between bar B8 and slider 1022. All of these spacers may, for example, be washers. Alternatively, to obviate spacers, one or both of bars B7 and B8 may comprise one or two jogs. For example, to obviate spacer 1024 at joint J8, bar B8 may have an inward jog near its first end, thereby creating near joint J8 a short portion of bar B8 that is parallel to the remainder of bar B8, but is relatively nearer to the positive-z-facing surface of bar B4. The inward jog thus compensates for the bearing-assembly thickness at joint J10. Likewise, to obviate a spacer at joint J7, bar B7 may have a jog near its first end to compensate for the bearing-assembly thickness at joint J9.

At pivoting joint J2, to center the piston 1008 in the z direction, a piston-centering spacer 1026 may be used on either side thereof. Only one of these piston-centering spacers is visible in FIG. 10. Likewise, at pivoting joint J5, to center the actuator body 1004 in the z direction, a body-centering spacer may be used on either side thereof. Neither of these body-centering spacers is visible in FIG. 10.

Depending on the geometry of the actuator 1002, the base flange of one or more of the V bars B2, B3, B5, B6 may have cutout near joints J2 and J5 to accommodate the actuator. For example, to accommodate the actuator body 1004, bar B6 may have a cutout 1030 near joint J5. Such a cutout may be replicated in bar B2, as cutout 1032 near joint J2, even though cutout 1032 is not needed to accommodate the actuator; in that case, the cutout 1034 exists merely to make bars B2 and B6 identical for manufacturing efficiency and convenience. Likewise, bar B3 may have a cutout 1034 that replicates an actuator-accommodating cutout in bar B5 (not visible in FIG. 10), so that bars B3 and B5 are identical for manufacturing efficiency and convenience.

7. OPERATION

First Embodiment

7.1 Compressive vs. Tensile Applications (FIGS. 11 and 12)

FIGS. 11 and 12 show the eight-bar, hex-plus-X linkage with linear actuator 1002 hidden.

Referring first to FIG. 11, modulation of the distance H may be achieved by application of a force F to joint J2 in the negative x direction, and by application of an equal and opposite force F to joint J5 in the positive x direction. Such outwardly directed forces F may be provided, for example, by the linear actuator 1002 shown in FIG. 10. Alternatively, the forces F may be provided by other means. For example, a motor frame may be pivotally connected at joint J5, the motor frame holding a motor whose shaft is coaxial with a lead screw whose distal end engages a lead nut that is pivotally connected to joint J2. The outwardly directed forces F shown in FIG. 11 are suitable to increase distance H in applications where the hex-plus-X linkage 1000 is under a compressive load P as shown in FIG. 11. For example, when bar B1 rests on a surface such as a floor that faces in the positive y direction, and a weight or other load P is applied in the negative y direction to the load-bearing top surface 1028 of bar B4, outwardly directed forces F of sufficient magnitude will lift the load.

Referring to FIG. 12, modulation of the distance H may also be achieved by application of a force F to joint J2 in the positive x direction, and by application of an equal and opposite force F to joint J5 in the negative x direction. Such inwardly directly forces may likewise be provided by the linear actuator 1002, or by other means such as the motor, lead screw and lead nut previously described. Such inwardly directed forces F are suitable to decrease distance H in applications where the hex-plus-X linkage 1000 is under a tensile load P as shown in FIG. 12. For example, suppose the top surface 1028 of bar B4 is attached to a fixed surface such as a ceiling, by means of several attachment points 1202 for example, so that the linkage 1000 is suspended from the fixed surface, with a weight or other load P applied in the negative y direction to bar B1. In such a case, inwardly directed forces F of sufficient magnitude will lift the load.

7.2 Motion of the Linkage (FIGS. 13A, 13B, and 13C)

Motion of the first embodiment of the hex-plus-X linkage 1000 is shown in FIGS. 13A, 13B, and 13C. These figures assume the compressive load P shown in FIG. 11; operation of the linkage under a tensile load is similar.

FIG. 13A shows a first configuration of the hex-plus-X lineage 1000 in which the distance H has a relatively small value $H_1$. FIG. 13B shows a second configuration of the hex-plus-X linkage 1000 in which the distance H has a medium value $H_2$. FIG. 13C shows a third configuration of the hex-plus-X linkage 1000 in which the distance H has a large value $H_3$. Continuous motion between these configurations, from $H=H_1$ to $H=H_2$ to $H=H_3$, occurs as the actuator 1002 is driven in a forward direction that causes the piston 1008 to extend, thereby raising the load P in a safe and controlled fashion. Conversely, continuous motion in the opposite direction, from $H=H_3$ to $H=H_2$ to $H=H_1$, occurs as the actuator 1002 in driven in a reverse direction that causes the piston 1008 to retract, thereby lowering the load P in a safe and controlled fashion.

In operation, the hex-plus-X linkage 1000 has several advantages over prior-art art linkages, as previously summarized in Section 3 ("Advantages") as items (a) through (f). Three of these advantages are discussed in detail in the next three sections: Section 7.3 discusses advantage (a), Section 7.4 discusses advantage (c), and Section 7.5 discusses advantage (d).

7.3 Advantage (a): No Extraneous Degrees of Freedom (FIGS. 14A Through 14H)

It will now be shown that the eight bars B1, B2, . . . , B8 of hex-plus-X linkage 1000, connected as shown in FIG. 10 by the eleven joints J1, J2, . . . , J11, possess only one degree of freedom, as desired for lifting applications. This single degree of freedom, parameterized by the distance H, is exploited by the linear actuator 1002 when it extends and retracts the piston 1008 to raise and lower the load P. This single degree of freedom is subtracted by the linear actuator 1002 when it stops moving, thereby immobilizing the linkage, as desired for safe handling of the load.

Referring first to FIG. 14A, consider the hexagonal assembly 1400 of hex-plus-X linkage 1000. Hexagonal assembly 1400 comprises the bars B1 through B6 connected by the joints J1 through J6. An angle between bars B1 and B2 is denoted $\theta_1$; an angle between bars B2 and B3 is denoted $\theta_2$; an angle between bars B3 and B4 is denoted $\theta_3$; an angle between bars B4 and B5 is denoted $\theta_4$; and an angle between bars B5 and B6 is denoted $\theta_5$. As previously explained in connection with FIGS. 7A and 7B, assuming base bar B1 is fixed, such a closed, planar hexagonal linkage has three degrees of freedom, because if joint J6 were broken (as joint 324 was imagined to be broken in FIG. 7A), then the angles $\theta_1$ through $\theta_5$ would all be independent, yielding five degrees of freedom. However, referring to the xyz coordinate system 1010, when joint J6 is attached as in FIG. 14A, two degrees of freedom are removed, because both an x and a y coordinate of bar B6 must then match corresponding coordinates of bar B1. Consequently, the hexagonal assembly 1400 has three degrees of freedom, denoted in FIG. 14A by the label "$N_A$=3".

It remains to be shown that, by addition of bars B7 and B8, and joints J7, J8, J9, J10, and J11, the degrees of freedom for the hex-plus-X linkage 1000 is reduced to one, as desired.

Referring to FIG. 14B, consider the two bars B7 and B8 alone. Each of these bars, confined to a plane parallel to the xy plane but otherwise completely unconstrained, has three degrees of freedom, characterized by an x coordinate and a y coordinate of the first end of the bar, as well as an angle that the bar makes with the x axis. Consequently, unconstrained bars B7 and B8 together have six degrees of freedom. Therefore, FIG. 14B is labeled "$N_B$=6".

Referring to FIG. 14C, joining bars B7 and B8 together at joint J11 produces the X assembly, in which joint J11 forces both an x coordinate and a y coordinate on bar B7 to coincide with corresponding coordinates on bar B8, thereby subtracting two degrees of freedom from the two free bars B7 and B8 shown in FIG. 14B. That is, the X assembly in FIG. 14C has four degrees of freedom: $N_C=N_B-2=6-2=4$.

Referring to FIG. 14D, consider an unconnected combination of the hexagonal assembly and the X assembly; that is, before these two sub-assemblies are attached to each other at joints J7, J8, J9 and J10. The hexagonal assembly has $N_A=3$ degrees of freedom, and the X assembly has $N_C=4$ degrees of freedom, so the unconnected combination of the two sub-assemblies has seven degrees of freedom: $N_D=N_A+N_C=4+3=7$.

Referring to FIG. 14E, consider a first partial connection that adds joint J7 to the unconnected combination of FIG. 14D. Joint J7 forms a pivoting attachment of bar B7 to bar B1. This attachment subtracts two degrees of freedom from the unconnected combination of FIG. 14D, because it forces both an x coordinate and a y coordinate on bar B7 to coincide with corresponding coordinates on bar B1. Thus, the first partial connection has five degrees of freedom: $N_E=N_D-2=7-2=5$.

Referring to FIG. 14F, consider a second partial connection that adds joint J8 to the first partial connection. Joint J8 forms a pivoting attachment of bar B8 to bar B4. This attachment subtracts two degrees of freedom from the arrangement shown in FIG. 14E, because it forces both an x coordinate and a y coordinate on bar B8 to coincide with corresponding coordinates on bar B4. Thus the second partial connection has three degrees of freedom: $N_F=N_E-2=5-2=3$.

Referring to FIG. 14G, consider a third partial connection that adds joint J9 to the second partial connection. Joint J9 forms a pivoting-and-sliding attachment of bar B7 to the slider 1018. This attachment subtracts one degree of freedom from the arrangement shown in FIG. 14F, because it forces a y coordinate of bar B7 to coincide with a y coordinate of bar B4, inasmuch as the bearing channel 1016 is affixed to bar B4. Thus, the third partial connection has two degrees of freedom: $N_G=N_F-1=3-1=2$.

Referring to FIG. 14H, consider a full connection of hex-plus-X linkage 1000, which adds joint J10 to the third partial connection. (The actuator 1002 of hex-plus-X linkage 1000 is hidden in FIG. 14H.) Joint J10 forms a pivoting-and-sliding attachment of bar B8 to the slider 1022. This attachment subtracts one degree of freedom from the third partial connection shown in FIG. 14G, because it forces a y coordinate of bar B8 to coincide with a y coordinate of bar B1, inasmuch as the bearing channel 1020 is affixed to bar B1. Thus, the full connection of hex-plus-X linkage 1000 has one degree of freedom: $N_H=N_G-1=2-1=1$.

In summary, it has been shown that the hex-plus-X linkage 1000, as distinguished from Hulsart's hexagonal linkage 300, has only one degree of freedom, as desired for a lifting linkage. This single degree of freedom is used to modulate the distance H between bars B1 and B4; that is, it is exploited by the actuator 1002 (FIG. 10) when it extends and retracts to raise and lower the load P, and it is subtracted by the actuator 1002 when the actuator stops moving, thereby immobilizing the hex-plus-X linkage 1000, as desired for safe handling of the load.

7.4 Advantage (c): Superior Mechanical Advantage (FIGS. 15 and 16)

Mechanical advantage, defined in Section 1.1 by equation (1), is larger for the hex-plus-X linkage 1000 than it is for the prior-art X linkage 200. As a result, the hex-plus-X linkage of a given size is able to lift a given load P with a smaller force F than is an X linkage of the same size subject to the same load P. This typically allows the hex-plus-X linkage of a given size to use a small, quieter, and less-expensive actuator than would be viable for an X linkage of the same size subject to the same load P. This advantage of the hex-plus-X linkage is quantified mathematically as follows.

Referring to FIG. 15A showing the X-linkage 200 as well as to FIG. 15B showing the hex-plus-X linkage 1000, let $P$=Vertical load (weight) applied to top surface 232 of the $X$ linkage 200 (FIG. 15$A$), and likewise applied to top surface 1028 of the hex-plus-$X$ linkage 1000 (FIG. 15$B$). (6)

Imagine that the lower bar of each linkage rests on a fixed surface, such that each linkage must do work to raise the load P.

For mathematical purposes, it is convenient to designate joints by subscripted letters. Thus, for the prior-art X-linkage 200, previously shown in FIG. 2, joints are renamed as follows, as illustrated in FIG. 15A:

$A_1$≡Joint 220; $B_1$≡Joint 222; $C_1$≡Joint 210; $D_1$≡Joint 212; $E_1$≡Joint 216; $G_1$≡Joint 214; $K_1$≡Joint 218. (7)

Likewise, for the hex-plus-X linkage 1000, previously shown in FIG. 10, joints are renamed as follows, as illustrated in FIG. 15B:

$A_2$≡Joint $J2$; $B_2$≡Joint $J5$; $C_2$≡Joint $J1$; $D_2$≡Joint $J3$; $E_2$≡Joint $J6$; $G_2$≡Joint $J4$. (8)

For the prior-art X linkage 200, referring to FIG. 15A, let $F_1$≡Inward horizontal force applied equally and oppositely to joints $A_1$ and $B_1$; (9)

$x_1$≡Horizontal distance between joints $A_1$ and $B_1$; (10)

$y_1$≡Vertical distance between joints $C_1$ and $D_1$. (11)

Similarly, for the hex-plus-X linkage, referring to FIG. 15B, let $F_2$≡Outward horizontal force applied equally and oppositely to joints $A_2$ and $B_2$; (12)

$x_2$≡Horizontal distance between joints $A_2$ and $B_2$; (13)

$y_2$≡Vertical distance between joints $C_2$ and $D_2$. (14)

Define an index i, where $i$≡1 for the prior-art $X$ linkage 200

$i$≡2 for the hex-plus-$X$ linkage 1000. (15)

For either linkage, consider motion between two positions, in which the horizontal distance $x_i$ changes by an infinitesimal amount $dx_i$, while the vertical distance $y_i$ increases by an infinitesimal amount $dy_i$. By conservation of work and energy, in an ideal, lossless system, the work $F_i|dx_i|$ done by the horizontal forces $F_i$ must equal the work required to raise the load P. That is, $$F_i|dx_i|=Pdy_i \tag{16}$$

By the definition stated as equation (1), the mechanical advantage $MA_i$ of linkage i is the ratio of the vertical load P to the magnitude of the horizontal force $F_i$:

$$MA_i \equiv \frac{P}{F_i}. \tag{17}$$

Substituting (16) into (17) yields $$MA_i \equiv \frac{|dx_i|}{dy_i}. \tag{18}$$

Consequently, the mechanical advantages of the two linkages may be compared by studying changes in the dimensions $x_i$ and $y_i$.

For the prior-art X linkage 200, referring to FIG. 15A, assume the typical case $$\overline{C_1K_1}=\overline{E_1K_1}=\overline{D_1K_1}=\overline{G_1K_1}\equiv L_1, \tag{19}$$

and $$\overline{A_1K_1}=\overline{B_1K_1}\equiv d. \tag{20}$$

Let $$\theta_1\equiv\text{Angle between bars 202 and 206.} \tag{21}$$

Then, by inspection of FIG. 15A, distances $x_1$ and $y_1$ are related to the geometry of the X linkage 200 as follows:

$$x_1=2d\cos\theta_1;\ y_1=2L_1\sin\theta_1. \tag{22}$$

Taking derivatives in (22) with respect to $\theta_1$ gives $$\frac{dx_1}{d\theta_1}=-2d\sin\theta_1;\quad \frac{dy_1}{d\theta_1}=2L_1\cos\theta_1. \tag{23}$$

Substituting (23) into (18) yields the mechanical advantage of the X linkage as $$MA_1 \equiv \frac{|dx_1|}{dy_1}=\frac{\left|\frac{dx_1}{d\theta_1}\right|}{\frac{dy_1}{d\theta_1}}=\frac{d}{L_1}\tan\theta_1. \tag{24}$$

Similarly, for the hex-plus-X linkage 1000, referring to FIG. 15B, assume the typical case $$\overline{A_2C_2}=\overline{A_2D_2}=\overline{B_2E_2}=\overline{B_2G_2}\equiv L_2. \tag{25}$$

Let $$\theta_2\equiv\text{Angle between bars } B1 \text{ and } B2 \tag{26}$$

and $$W\equiv\overline{C_2E_2}. \tag{27}$$

Then, by inspection of FIG. 15B, distances $x_2$ and $y_2$ are related to the geometry of the hex-plus-X linkage 1000 as follows:

$$x_2=W-2L_2\cos\theta_2;\ y_2=2L_2\sin\theta_2. \tag{28}$$

Taking derivatives in (28) with respect to $\theta_2$ gives $$\frac{dx_2}{d\theta_2}=2L_2\sin\theta_2;\quad \frac{dy_2}{d\theta_2}=2L_2\cos\theta_2. \tag{29}$$

Substituting (29) into (18) for i=2 yields the mechanical advantage of the hex-plus-X linkage 1000 as $$MA_2 \equiv \frac{|dx_2|}{dy_2}=\frac{\left|\frac{dx_2}{d\theta_2}\right|}{\frac{dy_2}{d\theta_2}}=\tan\theta_2. \tag{30}$$

Comparing (24) and (30) reveals that the mechanical advantage $MA_2$ of the hex-plus-X linkage is larger than the mechanical advantage $MA_1$ of the prior-art X linkage for two reasons. First, the factor $$\frac{d}{L_1}$$

that appears in the expression for $MA_1$ is always less than unity because of the practical need to fit the actuator 224 into the available space between bars 202, 206 and 208 without interfering with the base bar 202. Second, for a given overall linkage size, the minimum value of $\theta_1$ is typically less than the minimum value of $\theta_2$, as will be shown below.

Consider each linkage in a most-compressed configuration, where $\theta_i$ assumes its minimum value, denoted $(\theta_i)_{min}$. For the prior-art X linkage 200, in the most-compressed configuration, the sliding joints $E_1$ and $G_1$ in FIG. 15A are slid as far as possible to the right in the slots 236 and 234. For the hex-plus-X linkage, in the most compressed configuration, the actuator is at its most-compressed limit, $$x_2=(x_2)_{min}. \tag{31}$$

According to equations (24) and (30), the mechanical advantage for each linkage is smaller in the most-compressed configuration than it is in any other configuration. Consequently, the most-compressed configuration should be used to judge the mechanical advantage of the two linkages 200 and 1000, because this configuration will limit the load P that each linkage can lift with a given actuator. Let $$(MA_i)_{min}\equiv\text{Mechanical advantage of linkage i in the most-compressed configuration} \tag{32}$$

To compare the two linkages fairly, suppose that the linear actuator 224 used with the X linkage 200 is the same as the linear actuator 1002 used with the hex-plus-X linkage 1000. Suppose that this linear actuator can deliver, at most, a maximum force $F_{max}$. Then, applying equation (2), the maximum load $(P_{max})_i$ that can be lifted by linkage i, starting from the most-compressed configuration, is limited to $$(P_{max})_i=(MA_i)_{min}F_{max}. \tag{33}$$

That it, the maximum load that can be lifted by linkage i is directly proportional to $(MA_i)_{min}$. The superiority of the hex-plus-X linkage 1000 (i=2) over the prior-art X linkage 200 (i=1) in this regard will now be demonstrated mathematically.

For fair comparison of the two linkages, assume that the two linkages have the same width in the most-compressed configuration:

$$(\overline{C_1E_1})_{max}=\overline{C_2E_2}\equiv W. \tag{34}$$

Likewise, for fair comparison, assume that, in the most-compressed configuration, the two linkages have the same height, $$(y_1)_{min}=(y_2)_{min}\equiv H_{min}. \tag{35}$$

Then, in the most-compressed configuration, by inspection of FIG. 15A, $$\tan(\theta_1)_{min}=\frac{\frac{1}{2}H_{min}}{\frac{1}{2}W}=\frac{H_{min}}{W}, \tag{36}$$

whereas, by inspection of FIG. 15B, $$\tan(\theta_2)_{min}=\frac{\frac{1}{2}H_{min}}{\frac{1}{2}[W-(x_2)_{min}]}=\frac{H_{min}}{W-(x_2)_{min}}. \tag{37}$$

Comparing equations (36) and (37) demonstrates that for any values of $H_{min}$ and W, $(\theta_2)_{min}$ is always larger than $(\theta_1)_{min}$, because $(x_2)_{min}$ is always larger than zero.

Substituting (36) into (24) and (37) into (30) yields the mechanical advantages of the two linkages in the most-compressed configuration:

$$(MA_1)_{min}=\left(\frac{d}{L_1}\right)\left(\frac{H_{min}}{W}\right); \tag{38}$$

$$(MA_2)_{min}=\frac{H_{min}}{W-(x_2)_{min}}. \tag{39}$$

Dividing (39) by (38) yields $$\frac{(MA_2)_{min}}{(MA_1)_{min}}=\frac{1}{\left(\frac{d}{L_1}\right)\left[1-\frac{(x_2)_{min}}{W}\right]} \tag{40}$$

Thus, in the critical, most-compressed configuration, the hex-plus-X linkage 1000 always has a higher mechanical advantage than the prior-art X linkage 200, because each of the two factors in the denominator of (40) is less than unity. Equation (40) is plotted in FIG. 16, with $$\frac{(x_2)_{min}}{W}$$

as the abscissa, $$\frac{(MA_2)_{min}}{(MA_1)_{min}}$$

as the ordinate, and $$\left(\frac{d}{L_1}\right)$$

as the parameter that varies from curve to curve. For example, using geometry as drawn in the various figures, if W=865 mm, d=350 mm, $L_1$=432.5 mm, then $$\left(\frac{d}{L_1}\right)=0.809,\ \frac{(x_2)_{min}}{W}=0.506, \tag{41}$$

and $$\frac{(MA_2)_{min}}{(MA_1)_{min}}=2.50.$$

This case is referred to in FIG. 16 by a black dot indicated by reference numeral 1602. Equation (41) implies that, for this example case 1602, if linkages 200 and 1000 of the same size use the same linear actuator, then the hex-plus-X linkage 1000 can lift a load that is two-and-a half times larger than can be lifted by the X linkage 200. Alternatively, if linkages 200 and 100 of the same size are designed to lift the same load P, then the hex-plus-X linkage 1000 may use a linear actuator having a two-and-a-half-times lower force rating F than that used in the X linkage 200, and hence the actuator used in the hex-plus-X linkage 1000 may be considerably smaller, quieter, and less expensive than that used in the X linkage 200.

7.5 Advantage (d): Sliding Joints Bear Minimal Load (FIGS. 17 and 18)

Referring to FIGS. 17A and 18A, consider the sliding joints J9 and J10 of the hex-plus-X linkage 1000 (FIG. 18A) vis-à-vis the sliding joints 214 and 216 of the X linkage 200 (FIG. 17A). As will be shown in this section, joints J9 and J10 typically bear considerably smaller loads than joints 214 and 216. Consequently the hex-plus-X linkage 1000 has considerably less wear at its sliding joints J9 and J10 than the X linkage has at its sliding joints 214 and 216. This implies that the bearing channels (1016, 1020) and sliders (1018, 1022) for the hex-plus-X linkage 1000 may be lighter duty and less expensive than analogous bearing surfaces at the slots 234 and 236 of the X linkage 200.

The reason for this advantage of the hex-plus-X linkage 1000 over the X linkage 200 may be appreciated by comparing typical instances of the two linkages. In linkage 200 (FIG. 17A), define an xy coordinate system 1702 whose origin is centrally located along the base bar 202, such that a centerline 1704 of the linkage coincides with x=0. Likewise, for linkage 1000 (FIG. 18A), define an analogous xy coordinate system 1802 whose origin is centrally located along the base bar B1, such that a centerline 1804 of the linkage coincides with x=0. In both cases, assume the top bar, having a length L in the x direction, is parallel to the base bar; that is, in FIG. 17 bar 204 is parallel to bar 202, and in FIG. 18, bar B4 is parallel to bar B1. Moreover, in FIG. 18, assume a typical case in which the V bars B2, B3, B5 and B6 are symmetric. That is, letting ($\overline{J1,J2}$) denote a distance between joints J1 and J2, and likewise for other pairs of joints, assume that ($\overline{J1,J2}$)=($\overline{J6,J5}$) and ($\overline{J2,J3}$)=($\overline{J5,J4}$).

For each linkage, assume that a vertical load p(x) is distributed across the top of the linkage, and that the base bar of each linkage rests on a rigid surface. The units of p(x) are force per length. For each linkage, the distributed load p(x) produces a resultant force $$P \equiv \int_{-L/2}^{L/2} p(x)dx, \tag{42}$$

as represented by a large downward arrow acting upon bar 204 in FIG. 17A, and likewise represented by a large downward arrow acting upon bar B4 in FIG. 18A. The resultant force Pin each of FIGS. 17A and 18A acts at a resultant location $\bar{x}$ defined by $$\bar{x} \equiv \frac{\int_{-L/2}^{L/2} xp(x)}{P}. \tag{43}$$

For the X linkage 200, the resultant load P is transmitted downward to the base bar 202 through bars 206 and 208. Consequently, considerable load is transmitted across the sliding joints 214 and 216. In contrast, for the hex-plus-X linkage 1000, the resultant load P is transmitted downward to the base bar B1 primarily through the V bars B2, B3, B5 and B6. Relatively little load is carried through the X bars B7 and B8; consequently, relatively little load is transmitted through the sliding joints J9 and J10.

To appreciate these assertions quantitatively, consider a special-case illustrated in FIGS. 17B and 18B, in which p(x) is symmetrically distributed about the centerline of each linkage. That is, in the special case, p(x) for the X linkage 200 in FIG. 17B is distributed symmetrically about the centerline 1704, and p(x) for the hex-plus-X linkage 1000 in FIG. 18B is distributed symmetrically about the centerline 1804. The special case is defined mathematically by $$p(x)=p(-x). \tag{44}$$

Consequently, in FIG. 17B, the resultant force P acts along the centerline 1704; in FIG. 18B, the resultant force P acts along the centerline 1804. That is, in special case (44), for each linkage, $$\bar{x}=0. \tag{45}$$

First, referring to FIG. 17B, consider the X linkage for special case (44). Consider vertical reaction forces $R_{212}$ and $R_{214}$ imposed on bar 204 by joints 212 and 214 respectively, and imagine bar 204 as a free body in static equilibrium. Let x coordinates of joints 212 and 214 be denoted $x_{212}$ and $x_{214}$ respectively. Equilibrium of vertical forces implies $$R_{212}+R_{214}=P. \tag{46}$$

Moment equilibrium about the centerline 1704 at x=0 implies $$R_{212}x_{212}+R_{214}x_{214}=0, \tag{47}$$

Eliminating $R_{212}$ from equations (46) and (47) yields $$R_{214} = \frac{P}{1+\left(\frac{x_{214}}{-x_{212}}\right)}, \tag{48}$$

where the quantity $-x_{212}$ is positive because $x_{212}$ is negative. Thus, when bar 204 is in a low position such that joint 214, sliding in slot 234, is located nearest the cantilevered end 238 of bar 204 where $x_{214}=-x_{212}$, it follows from equation (48) that $$R_{214} = \frac{P}{2}. \tag{49}$$

Conversely, when bar 204 is in a high position such that joint 214 is located furthest from the cantilevered end 238 of bar 204 such that $x_{214}<-x_{212}$, it follows from equation (48) that $$R_{214} > \frac{P}{2}. \tag{50}$$

Combining equations (49) and (50), it follows that throughout the motion of the X-linkage 200, $$R_{214} \geq \frac{P}{2}; \tag{51}$$

that is, in the special case (44), the sliding joint 214 bears at least half of the applied load P. A similar analysis, considering reactions forces $R_{210}$ and $R_{216}$ imposed on bars 206 and 208 respectively by joints 210 and 216 respectively, and imagining, as a free body in static equilibrium, the entire linkage except bar 202, joint 210, and joint 216, yields $$R_{216} \geq \tfrac{1}{2}P. \tag{52}$$

That is, in special case (44), the sliding joint 216, like sliding joint 214, bears at least half of the applied load P. Because the applied load P can be large for lifting applications, the reaction forces $R_{214}$ and $R_{216}$ at the sliding joints 214 and 216 are thus large, and consequently the potential for wear at these joints is considerable. In typical X-linkages, such wear is typically minimized by relatively heavy-duty, expensive bearing arrangements at sliding joints 214 and 216.

In contrast, referring to FIG. 18B, consider the hex-plus-X linkage in special case (44). Consider reaction forces $R_3$, $R_8$, $R_9$, and $R_4$ imposed on bar B4 by joints J3, J8, J9 and J4 respectively. Let x coordinates of joints J3, J8, J9 and J4 be denoted $x_3$, $x_8$, $x_9$, and $x_4$ respectively. Reaction force $R_9$ is of particular interest because this force is transmitted through the sliding joint J9. However, $R_9$ cannot be determined directly because the linkage 1000 is statically indeterminate. That is, considering bar B4 as a free body, static equilibrium thereof provides only two relations among the four unknown reaction forces $R_3$, $R_8$, $R_9$, and $R_4$; namely, equilibrium of vertical forces, $$R_3+R_8+R_9+R_4=P, \tag{53}$$

and equilibrium of moments about the centerline x=0, $$R_3x_3+R_8x_8+R_9x_9+R_4x_4=0. \tag{54}$$

However, for special case (44), it may be concluded (ignoring the small weight of bars B7 and B8) that $$R_8=R_9=0. \tag{55}$$

This conclusion is reached by imaging that bars B7 and B8 together with joints J7, J8, J9, J10 and J11 are temporarily removed, leaving only the hexagonal assembly, which comprises bars B1 through B6 and joints J1, J2, J3, J4, J5, and J6. Because this hexagonal assembly as well as the load p(x) are, by assumption, perfectly symmetric about the centerline 1804, it follows that the hexagonal assembly requires no help from the X bars B7 and B8 to remain in equilibrium, because the hexagonal assembly by itself establishes a symmetric balance of forces. Consequently, imagining that the X bars B7 and B8 together with joints J7, J8, J9, J10 and J11 are now replaced, it follows that no axial force, shear force, or moment is transmitted through either of the X bars B7 and B8, because any such load would destroy the aforesaid symmetrical balance of forces. Symmetry would be destroyed because the X bars and the associated joints J7 through J11 are not symmetric about x=0; that is, joints J7 and J8 to the left of x=0 are pivoting-only joints whereas the joints J9 and J10 to the right of x=0 are pivoting-and-sliding joints. Consequently, because X bars B7 and B8 transmit no loads, it follows that the reaction forces $R_8$ and $R_9$ are zero: equilibrium analysis of a small piece of X bar B8 near joint J8, considered as a free body, demands $R_8=0$; equilibrium analysis of a small piece of X bar B7 near joint J9, considered as a free body, demands $R_9=0$. Therefore, in special case (44), the sliding joints J9 experiences zero force, and thus zero wear.

An argument analogous to that comprising equations (53) through (55) may be made regarding reaction forces $R_1$, $R_7$, $R_{10}$, and $R_6$ imposed on bars B2, B7, B8 and B6 respectively by joints J1, J7, J10, and J6 respectively. Consider as a free body the entire hex-plus-X linkage 1000 except bar B1 and the four joints J1, J7, J6, and J10, where J10 comprises bearing channel 1020 and slider 1022. Then, in special case (44), the conclusion $$R_7=R_{10}=0 \tag{56}$$

is reached by reasoning analogous to that which led to equation (55). Consequently, in special case (44), the sliding joint J10, like sliding joint J9, experiences zero force, and thus zero wear.

In a general case depicted by FIG. 18A, where the load p(x) is not symmetric about x=0, and thus the resultant load P is not centrally located, the X bars B7 and B8 do carry load, inasmuch as they act to prevent the extraneous degrees of freedom discussed in Sections 1.11 and 7.3. Consequently, for the general case of asymmetric loading, the sliding joints J9 and J10 do transmit force and experience wear. However, even for the general case, a considerable portion of the load is transmitted through the V bars B2, B3, B5, and B6, as may be appreciated by the foregoing analysis of the special case (44). Consequently, wear experienced at pivoting-and-sliding joints J9 and J10 of the hex-plus-X linkage is, even in the general case, considerably less than that experienced at pivoting-and-sliding joints 214 and 216 of the X linkage.

8. DESCRIPTION AND OPERATION OF ALTERNATIVE EMBODIMENTS

FIGS. 19-23

Referring to FIG. 19, a second embodiment 1900 is a modification of linkage 1000 that provides, in place of the bearing channel 1016 and slider 1018, a slot 1902 that is cut through one or both side flanges of bar B4, such that joint J9 slides in a slot 1902 as the distance H between bars B1 and B4 is modulated. The second embodiment likewise provides, in place of the bearing channel 1020 and the slider 1022, a slot 1904 that is cut through one or both side flanges of bar B1, such that joint J10 slides in slot 1904 as the distance H between bars B1 and B4 is modulated.

Referring to FIG. 20, a third embodiment 2000 is a modification of linkage 1000 in which joint J7 is merged with joint J1, and joint J8 is merged with joint J3. That is, the pivoting of bars B2 and B7 with respect to bar B1 both occur at joint J1 about the same axis of rotation. Likewise, the pivoting of bars B3 and B8 with respect to bar B4 both occur at joint J3 about the same axis of rotation.

Referring to FIG. 21, a fourth embodiment 2100 places bars B7 and B8 inside rather than outside of the U-channel cross sections of bars B1 and B4. To illustrate this placement of bars B7 and B8, the viewpoint in FIG. 21 is toward the positive z direction of xyz coordinate system 1010, rather than toward the negative z direction as in previous figures. This placement of bars B7 and B8 inside the U-channel cross sections of bars B1 and B4 implies that, at joint J7, bar B7 is connected to the inner surface rather than the outer surface of the first side flange of bar B1; likewise, at joint J8 (not visible in FIG. 21), bar B8 is connected to the inner surface rather than the outer surface of the first side flange of bar B4. Moreover, at joint J10, the bearing channel 1020 abuts the inner surface rather than the outer surface of the first side flange of bar B1; likewise, and at joint J9 (not visible in FIG. 21), the bearing channel 1016 abuts the inner surface rather than the outer surface of the first side flange of bar B4.

Referring to FIGS. 22A and 22B, a fifth embodiment 2200 comprises an additional X assembly as well as four joints used to attach it to the hexagonal assembly. FIG. 22A shows the fifth embodiment 2200 as viewed looking toward the negative z direction of the xyz coordinate system 1010; FIG. 22B shows the fifth embodiment 2200 as viewed looking toward the positive z direction. The additional X assembly, best seen in FIG. 22B, comprises a third X bar B9, a fourth X bar B10, and a joint J16 at which bars B9 and B10 are pivotally attached to each other. The additional X assembly is attached to the hexagonal assembly in a manner that mirrors the attachment of the X assembly shown in the first embodiment (FIG. 10). That is, referring to FIG. 22B, a first end of bar B9 is pivotally attached near the first end of bar B1 at a joint J12; a first end of bar B10 is pivotally attached near the first end of bar B4 at a joint J13; a second end of bar B9 is pivotally and slidably attached to bar B4 at a joint J14 by means of a third bearing channel 2202 and a third slider 2204; and a second end of bar B10 is pivotally and slidably attached to bar B1 at a joint J15 by means of a fourth bearing channel 2206 and a fourth slider 2208. Such connection of the additional X assembly to the hexagonal assembly provides additional stabilization against extraneous degrees of freedom; this additional stabilization may be desirable in some applications of hex-plus-X linkages; for example, when a size S of bars B1 through B6 in the z direction is relatively large.

Referring to FIG. 23, a sixth embodiment 2300 adds an additional linear actuator 2302 to linkage 2200. The additional linear actuator 2302 is similar to linear actuator 1002, and is similarly attached to the hexagonal assembly at joints J2 and J5. Axial spacers such as 2304 are used to keep each actuator in a desired axial location along the shoulder screw, clevis pin, or other such device used to provide joints J2 and J5, as previously described in connection with the first embodiment. Such a plurality of actuators may be desirable, for example, if the size S of bars B1 through B6 in the z direction is relatively large so that the plurality of actuators fits in available space, and if the applied load P is so large that a single linear actuator alone cannot lift it.

Referring to FIG. 24, in a seventh embodiment 2400, the hexagon formed by bars B1, B2, B3, B4, B5 and B6 is convex thoughout the motion. That is, referring to the x coordinates $\hat{x}_2$, $\hat{x}_3$, $\hat{x}_4$ and $\hat{x}_5$ of joints J3, J4, J5, and J6 respectively, in seventh embodiment, $\hat{x}_2<\hat{x}_3$ and $\hat{x}_5>\hat{x}_4$ throughout the motion. This embodiment sacrifices advantage (f) recited in Section 3; that is, the V bars B2, B3, B4 and B5 of the seventh embodiment protrude beyond the top footprint. Nevertheless, such an embodiment may be useful to accommodate certain sizes of the linear actuator 1002.

Referring to FIG. 25, an eighth embodiment 2500 comprises, like the fifth embodiment (FIG. 22), the additional X assembly (bars B9 and B10, and joint J16) as well as the bearing channels 2202 and 2206, the sliders 2204 and 2208, and the four joints J12, J13, J14, and J15 that attach the additional X assembly to the hexagonal assembly. In the eighth embodiment (FIG. 25), the X assembly comprising the first and second X bars B7 and B8 is attached, as in the fourth embodiment (FIG. 21), to the inner surfaces of the first side flanges of bars B1 and B4, whereas the additional X assembly comprising the third and fourth X bars B9 and B10 is attached, as in the fifth embodiment (FIG. 22), to the outer surfaces of the second side flanges of bars B1 and B4.

Referring to FIG. 26, a ninth embodiment 2600 comprises, like the eighth embodiment (FIG. 25), the additional X assembly (bars B9 and B10, and joint J16) as well as the bearing channels 2202 and 2206, the sliders 2204 and 2208, and the four joints J12, J13, J14, and J15 that attach the additional X assembly to the hexagonal assembly. In the ninth embodiment (FIG. 26), as in the eighth embodiment (FIG. 25), the X assembly comprising the first and second X bars B7 and B8 is attached to the inner surfaces of the first side flanges of bars B1 and B4. The ninth embodiment differs from the eighth embodiment in that the additional X assembly (comprising bars B9 and B10) is attached to the inner (rather than the outer) surfaces of the second side flanges of bars B1 and B4. This placement of bars B9 and B10 inside the U-channel cross sections of bars B1 and B4 implies that, at joint J12, bar B9 is connected to the inner surface rather than the outer surface of the second side flange of bar B1; likewise, at joint J13, bar B10 is connected to the inner surface rather than the outer surface of the first side flange of bar B4. Moreover, the bearing channel 2206 abuts the inner surface rather than the outer surface of the second side flange of bar B1; likewise, the bearing channel 2202 (not visible in FIG. 26) abuts the inner surface rather than the outer surface of the second side flange of bar B4.

9. CONCLUSION, RAMIFICATIONS, AND SCOPE

Thus the reader will see that at least one embodiment of the hex-plus-X linkage provides several advantages for the purpose of modulating a distance between the base bar B1 and the top bar B4: first, the hex-plus-X linkage has no extraneous degrees of freedom; second, the size of its load-bearing top surface is not limited by the means used to remove extraneous degrees of freedom; third, it has a relatively high mechanical advantage that allows it to lift a relatively large load with a relatively small, quiet, and inexpensive actuator; fourth, it avoids sliding joints that bear large loads, thereby minimizing wear at its sliding joints; fifth, it avoids dangerous, cantilevered portions of the load-bearing top surface; and sixth, it avoids encumbering, possibly dangerous elements that extend substantially beyond the footprint of the load-bearing top surface. While the above description contains much specificity, this should not be construed as limitations on the scope, but rather as an exemplification of several embodiments thereof. Many other variations are possible. Accordingly, the scope should be determined not by the embodiments illustrated, but by the appended claims and their legal equivalents.

I claim:

1. A mechanical linkage for performing a motion that occurs parallel to an imaginary xy plane of an imaginary Cartesian xyz coordinate system having an imaginary x axis, an imaginary y axis, and an imaginary z axis that define the xy plane as well as an imaginary xz plane and an imaginary yz plane, the linkage comprising a. a base-bar B1 extending along the x axis, bar B1 having a first end located at a small value of x and a second end located at a larger value of x, b. a first lower V bar B2, c. a first upper V bar B3, d. a top bar B4 whose size projected upon the xz plane defines a top footprint, e. a second upper V bar B5, f. a second lower V bar B6, g. a first X bar B7 h. a second X bar B8, i. a first joint J1 at which the first end of bar B1 is pivotally attached to a first end of bar B2, j. a second joint J2 at which a second end of bar B2 is pivotally attached to a first end of bar B3, k. a third joint J3 at which a second end of bar B3 is pivotally attached to a first end of bar B4, l. a fourth joint J4 at which a second end of bar B4 is pivotally attached to a first end of bar B5, m. a fifth joint J5 at which a second end of bar B5 is pivotally attached to a first end of bar B6, n. a sixth joint J6 at which a second end of bar B6 is pivotally attached to the second end of bar B1, o. a seventh joint J7 at which a first end of bar B7 is pivotally attached near the first end of bar B1, p. an eighth joint J8 at which a first end of bar B8 is pivotally attached near the first end of bar B4, q. a ninth joint J9 at which a second end of bar B7 is pivotally and slidably attached near the second end of bar B4, r. a tenth joint J10 at which a second end of bar B8 is pivotally and slidably attached near the second end of bar B1, and s. an eleventh joint J11 at which bar B7 is pivotally attached to bar B8 t. actuation means having a first end that is pivotally attached at joint J5 and a second end that is pivotally attached at joint J2, the actuation means being capable of increasing and decreasing a knee-to-knee distance between joints J2 and J5 by applying thereto oppositely directed actuation forces of magnitude F, whereby, by varying the knee-to-knee distance using the actuation means, a distance H measured parallel to the y axis between bars B1 and B4 is caused to undergo a modulation in which the distance H is increased or decreased despite externally applied, oppositely directed forces of a magnitude P that act upon bars B1 and B4 to oppose the modulation, the modulation of distance H being thereby accomplished with a number of advantages: first, the linkage has only one degree of freedom, allowing modulation of the distance H, and consequently the linkage avoids unwanted, extraneous degrees of freedom; second, such extraneous degrees of freedom are prevented in a manner that does not limit the size of the top footprint; third, the linkage has a relatively high mechanical advantage, defined as a ratio P/F, thereby allowing the modulation of distance H to occur, for a given value of the applied force P, with a relatively small value of the actuation force F; fourth, the slidable joints J9 and J10 transmit forces in typical operation of the linkage that are relatively small compared to the applied force P, thereby minimizing wear at these joints; and fifth, the top bar B4 is substantially fully supported across the top footprint, avoiding substantial cantilevered portions thereof.

2. A mechanical linkage as described in claim 1 in which, referring to the xyz coordinate system in which joints J1 through J6 have x coordinates $\hat{x}_1$ through $\hat{x}_6$ respectively, $\hat{x}_3$ is substantially equal to $\hat{x}_1$, $\hat{x}_4$ is substantially equal to $\hat{x}_6$, $\hat{x}_2$ is greater than $\hat{x}_3$ throughout the motion, and $\hat{x}_5$ is less than $\hat{x}_4$ throughout the motion, whereby, throughout the motion, a hexagon formed by bars B1, B2, B3, B4, B5 and B6 is concave, and consequently, throughout the motion, the V bars B2, B3, B5 and B6 remain substantially within the top footprint, the linkage thereby having the additional advantage of avoiding substantial encumbrances outside the top footprint that would undesirably occupy valuable space and potentially pose a tripping hazard.

3. A mechanical linkage as described in claim 1 in which the actuation means is electrically powered.

4. A mechanical linkage as described in claim 1 in which the actuation means is pneumatically powered.

5. A mechanical linkage as described in claim 1 in which the actuation means is hydraulically powered.

6. A mechanical linkage as described in claim 1 in which slidability at joint J9 is provided by a first bearing channel that is rigidly connected to bar B4 and by a first slider that slides within the first bearing channel throughout the motion; and likewise, slidability at joint J10 is provided by a second bearing channel that is rigidly connected to bar B1 and by a second slider that slides within the second bearing channel throughout the motion.

7. A mechanical linkage as described in claim 1 in which slidability at joint J9 is provided by a first slot, located near the second end of bar B4, in which joint J9 slides throughout the motion; and likewise, slidability at joint J10 is provided by a second slot, located near the second end of bar B1, in which joint J10 slides throughout the motion.

8. A mechanical linkage as described in claim 1 in which joints J7 and J1 are merged, whereby bars B2 and B7 pivot with respect to bar B1 about the same axis of rotation.

9. A mechanical linkage as described in claim 1 in which joints J3 and J8 are merged, whereby bars B3 and B8 pivot with respect to bar B4 about the same axis of rotation.

10. A mechanical linkage as described in claim 1 in which joints J7 and J1 are merged, and joints J3 and J8 are merged, whereby, because joints J7 and J1 are merged, bars B2 and B7 pivot with respect to bar B1 about the same axis of rotation, and because joints J3 and J8 are merged, bars B3 and B8 pivot with respect to bar B4 about the same axis of rotation.

11. A mechanical linkage as described in claim 1 in which bars B7 and B8 lie outside the top footprint.

12. A mechanical linkage as described in claim 1 in which bars B7 and B8 lie inside the top footprint.

13. A mechanical linkage as described in claim 1, in which, denoting the bars by an index i having value i=1 for bar B1, i=2 for bar B2, and so on, each of bars B1, B2, B3, B4, B5 and B6 has a U-channel cross section, each thus comprising a base flange, a first side flange projecting substantially at right angles from a first side of the base flange, and a second side flange projecting substantially at right angles from a second side of the base flange opposite the first side, thereby forming a U-shape having an inside width w, measured from an inward-facing surface of the first side flange to an inward-facing surface of the second side flange, and also having an outside width $W_i$ measured from an outward-facing surface of the first side flange to an outward-facing surface of the second side flange, and in which the following inequalities hold: $W_2<w_1$, $W_6<w_1$, $W_3<w_2$, $W_5<w_6$, $W_3<w_4$, $W_5<w_4$; whereby, as the motion occurs, bars B2 and B6 nest within bar B1, bars B3 and B5 nest within bars B2 and B5 respectively, and bars B3 and B5 nest within bar B4.

14. A mechanical linkage as described in claim 13, in which bars B7 and B8 are attached to bars B1 and B4 on the outward-facing surfaces of the first side flanges thereof.

15. A mechanical linkage as described in claim 13, in which bars B7 and B8 are attached to bars B1 and B4 on the inward-facing surfaces of the first side flanges thereof.

16. A mechanical linkage as described in claim 13, also comprising a. a third X bar B9 b. a fourth X bar B10 c. a twelfth joint J12 at which a first end of bar B9 is pivotally attached to the first end of bar B1, d. a thirteenth joint J13 at which a first end of bar B10 is pivotally attached to the first end of bar B4, e. a fourteenth joint J14 at which a second end of bar B9 is pivotally and slidably attached near the second end of bar B4, f. a fifteenth joint J15 at which a second end of bar B10 is pivotally and slidably attached near the second end of bar B1, g. a sixteenth joint J16 at which bar B9 is pivotally attached to bar B10, whereby the linkage is further stabilized against extraneous motions.

17. A mechanical linkage as described in claim 16 in which bars B7 and B8 are attached to the outward-facing surfaces of the first side flanges of bars B1 and B4, and bars B9 and B10 are attached to the outward-facing surfaces of the second side flanges of bars B1 and B4.

18. A mechanical linkage as described in claim 16 in which bars B7 and B8 are attached to the inward-facing surfaces of the first side flanges of bars B1 and B4, and bars B9 and B10 are attached to the outward-facing surfaces of the second side flanges of bars B1 and B4.

19. A mechanical linkage as described in claim 16 in which bars B7 and B8 are attached to the inward-facing surfaces of the first side flanges of bars B1 and B4, and bars B9 and B10 are attached to the inward-facing surfaces of the second side flanges of bars B1 and B4.

20. A method for performing a motion that occurs parallel to an imaginary xy plane of an imaginary Cartesian xyz coordinate system having an imaginary x axis, an imaginary y axis, and an imaginary z axis that define the xy plane as well as an imaginary xz plane and an imaginary yz plane, the method comprising a. providing a base-bar B1 extending along the x axis, bar B1 having a first end located at a small value of x and a second end located at a larger value of x, b. providing a first lower V bar B2, c. providing a first upper V bar B3, d. providing a top bar B4 whose size projected upon the xz plane defines a top footprint, e. providing a second upper V bar B5, f. providing a second lower V bar B6, g. providing a first X bar B7 h. providing a second X bar B8, i. providing a first joint J1 at which the first end of bar B1 is pivotally attached to a first end of bar B2, j. providing a second joint J2 at which a second end of bar B2 is pivotally attached to a first end of bar B3, k. providing a third joint J3 at which a second end of bar B3 is pivotally attached to a first end of bar B4, l. providing a fourth joint J4 at which a second end of bar B4 is pivotally attached to a first end of bar B5, m. providing a fifth joint J5 at which a second end of bar B5 is pivotally attached to a first end of bar B6, n. providing a sixth joint J6 at which a second end of bar B6 is pivotally attached to the second end of bar B1, o. providing a seventh joint J7 at which a first end of bar B7 is pivotally attached near the first end of bar B1, p. providing an eighth joint J8 at which a first end of bar B8 is pivotally attached near the first end of bar B4, q. providing a ninth joint J9 at which a second end of bar B7 is pivotally and slidably attached near the second end of bar B4, r. providing a tenth joint J10 at which a second end of bar B8 is pivotally and slidably attached near the second end of bar B1, and s. providing an eleventh joint J11 at which bar B7 is pivotally attached to bar B8 t. providing actuation means having a first end that is pivotally attached at joint J5 and a second end that is pivotally attached at joint J2, the actuation means being capable of increasing and decreasing a knee-to-knee distance between joints J2 and J5 by applying thereto oppositely directed actuation forces of magnitude F, whereby, by varying the knee-to-knee distance using the actuation means, a distance H measured parallel to the y axis between bars B1 and B4 is caused to undergo a modulation in which the distance H is increased or decreased despite externally applied, oppositely directed forces of a magnitude P that act upon bars B1 and B4 to oppose the modulation, the modulation of distance H being thereby accomplished with a number of advantages: first, the method provides only one degree of freedom, allowing modulation of the distance H, and consequently the method avoids unwanted, extraneous degrees of freedom; second, such extraneous degrees of freedom are prevented in a manner that does not limit the size of the top footprint; third, the method provides a relatively high mechanical advantage, defined as a ratio P/F, thereby allowing the modulation of distance H to occur, for a given value of the applied force P, with a relatively small value of the actuation force F; fourth, the slidable joints J9 and J10 transmit forces in typical operation of the method that are relatively small compared to the applied force P, thereby minimizing wear at these joints; and fifth, the top bar B4 is substantially fully supported across the top footprint, avoiding substantial cantilevered portions thereof.

* * * * *